US009605515B2

(12) United States Patent
O'Malley

(10) Patent No.: US 9,605,515 B2
(45) Date of Patent: Mar. 28, 2017

(54) FLUID COLLECTION RESERVOIR AND ANTI-SPILL MECHANISM

(71) Applicant: Matthew Carl O'Malley, Lake Balboa, CA (US)

(72) Inventor: Matthew Carl O'Malley, Lake Balboa, CA (US)

( * ) Notice: Subject to any disclaimer, the term of this patent is extended or adjusted under 35 U.S.C. 154(b) by 0 days.

(21) Appl. No.: 14/944,170

(22) Filed: Nov. 17, 2015

(65) Prior Publication Data

US 2016/0069164 A1 Mar. 10, 2016

Related U.S. Application Data

(63) Continuation of application No. 14/479,271, filed on Sep. 6, 2014, now abandoned.

(51) Int. Cl.

| | |
|---|---|
| ***E21B 33/043*** | (2006.01) |
| ***E21B 41/00*** | (2006.01) |
| ***E21B 43/01*** | (2006.01) |
| ***E21B 17/01*** | (2006.01) |
| ***E21B 47/00*** | (2012.01) |
| ***E21B 47/10*** | (2012.01) |

(52) U.S. Cl.

CPC ..... *E21B 41/0007* (2013.01); *E21B 17/01* (2013.01); *E21B 43/0122* (2013.01); *E21B 47/0001* (2013.01); *E21B 47/1015* (2013.01)

(58) Field of Classification Search

CPC ... E21B 43/0122; E21B 17/012; E21B 33/043
USPC ..... 441/35, 40; 114/361; 210/170.05, 242.3, 210/923; 166/338, 344, 345, 346, 351, 166/352, 363, 364, 367

See application file for complete search history.

(56) References Cited

U.S. PATENT DOCUMENTS

| | | | | | |
|---|---|---|---|---|---|
| 2,128,012 | A | * | 8/1938 | O'Rourke | E02B 3/04 405/21 |
| 2,804,633 | A | * | 9/1957 | Taylor | B63C 9/02 135/114 |
| 2,859,457 | A | * | 11/1958 | Manhart | B63C 9/02 441/38 |
| 2,935,024 | A | * | 5/1960 | Kofahl | F04B 47/00 166/351 |
| 2,988,144 | A | * | 6/1961 | Conrad | E21B 7/12 137/236.1 |
| 3,054,124 | A | * | 9/1962 | Silverstone | B63C 9/02 441/38 |

(Continued)

*Primary Examiner* — Matthew R Buck
*Assistant Examiner* — Edwin Toledo-Duran

(57) ABSTRACT

An apparatus for collecting fluids into a reservoir, wherein the reservoir is floating on a body of water and has an opening in the bottom of the reservoir through which the fluids, such as petro-based products, arrive flowing upward from a submersible structure, such as a riser from a fluid source. The reservoir has a canopy and mechanism connected to the rim of the side walls of the reservoir allowing the canopy to pivot. The pivoting canopy and mechanism attached along the rim of the reservoir restrains the fluids contained inside from spilling over the rim into the body of water, say an ocean, and also restrains the ocean waters from spilling over into the reservoir containing the fluids. The reservoir can be used as a temporary holding vessel for the fluids, whereby the fluids can then be vacuumed into a drillship.

20 Claims, 43 Drawing Sheets

(56) References Cited

U.S. PATENT DOCUMENTS 3,067,712 A * 12/1962 Doerpinghaus ..... B63B 35/285 114/246
3,113,699 A * 12/1963 Crawford ..... B65D 88/78 137/236.1
3,261,398 A * 7/1966 Haeber ..... E21B 41/04 166/352
3,308,881 A * 3/1967 Chan ..... E21B 43/0135 166/339
3,339,512 A * 9/1967 Siegel ..... B65D 88/78 114/257
3,366,173 A * 1/1968 McIntosh ..... E21B 43/017 166/356
3,401,746 A * 9/1968 Stevens ..... E21B 35/00 166/352
3,409,055 A * 11/1968 Bily ..... B63B 22/023 137/236.1
3,424,241 A * 1/1969 Triplett ..... E21B 7/128 166/339
3,592,468 A * 7/1971 Simendinger, Jr. ..... B63B 35/73 114/346
3,626,701 A * 12/1971 Laffont ..... B63B 35/4406 114/264
3,631,984 A * 1/1972 Rath ..... E02B 15/06 210/170.05
3,643,447 A * 2/1972 Pogonowski ..... E02B 17/00 114/257
3,756,294 A * 9/1973 Rainey ..... B63B 25/082 137/312
3,837,310 A * 9/1974 Toyama ..... B65D 88/78 114/257
4,083,070 A * 4/1978 Martin ..... B63B 7/08 441/40
4,216,559 A * 8/1980 Switlik, Jr. ..... B63B 39/02 114/125
4,365,576 A * 12/1982 Cook ..... B63B 35/44 114/257
4,382,716 A * 5/1983 Miller ..... E21B 43/0122 405/52
4,422,801 A * 12/1983 Hale ..... E21B 17/012 166/350
4,433,940 A * 2/1984 Harrison ..... F17C 3/005 405/210
4,702,832 A * 10/1987 Renfrow ..... B01D 17/0208 210/242.3
4,762,180 A * 8/1988 Wybro ..... E21B 7/128 166/350
4,790,936 A * 12/1988 Renfrow ..... B01D 17/0208 210/242.3
5,046,896 A * 9/1991 Cole ..... B63B 22/021 166/344
5,050,680 A * 9/1991 Diehl ..... E21B 33/037 137/312
5,070,807 A * 12/1991 Lewis ..... B63B 17/02 114/345
5,117,914 A * 6/1992 Blandford ..... E21B 43/017 166/344
5,297,632 A * 3/1994 Blandford ..... E21B 43/017 166/344
5,433,273 A * 7/1995 Blandford ..... E21B 43/017 166/344
6,206,743 B1 * 3/2001 Martin ..... B63C 9/06 441/37
6,685,520 B1 * 2/2004 Wiggins ..... B63B 43/12 114/348
6,712,559 B2 * 3/2004 Lenormand ..... E21B 17/012 166/350
7,063,582 B2 * 6/2006 Boujon ..... B63C 9/04 441/38
7,080,673 B2 * 7/2006 Pollack ..... F17C 5/06 141/284
7,309,267 B1 * 12/2007 Henry ..... B64C 25/56 244/107
7,837,526 B1 * 11/2010 Doffay ..... B63B 35/36 114/345
7,886,829 B2 * 2/2011 Edwards ..... B63B 22/24 166/344
2006/0144622 A1 * 7/2006 Bailey ..... E21B 33/085 175/230
2010/0311292 A1 * 12/2010 Ibsen ..... B63B 7/082 441/38

* cited by examiner 100a
107
102b
100b 100a
109
102b
100b 100b
102b
100b 116
100c
136
140
102a 102c FIG. 16a
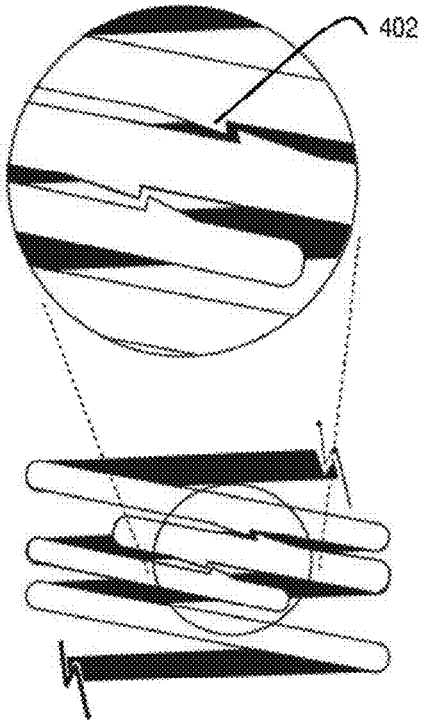
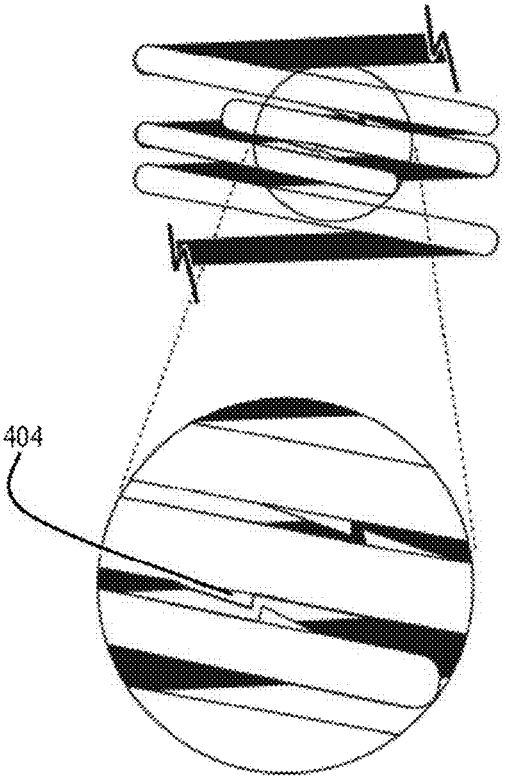
FIG. 16b
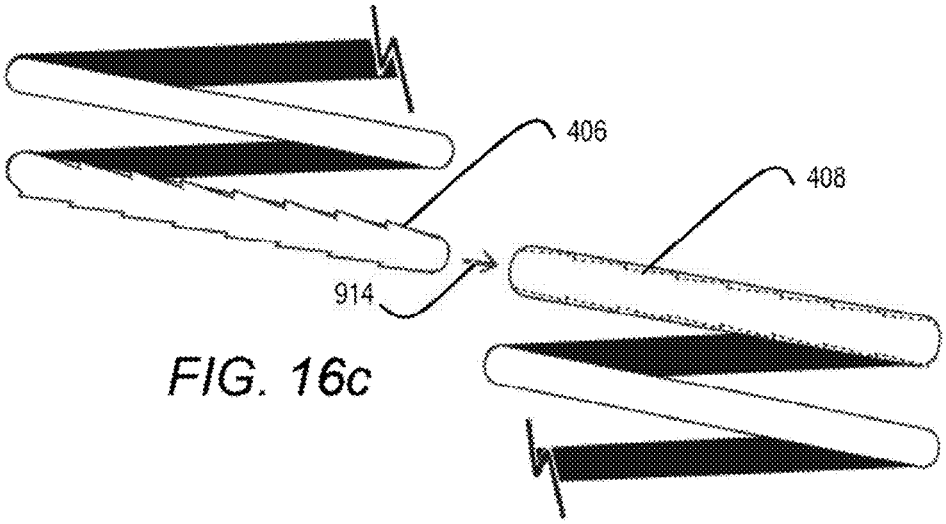
FIG. 16c

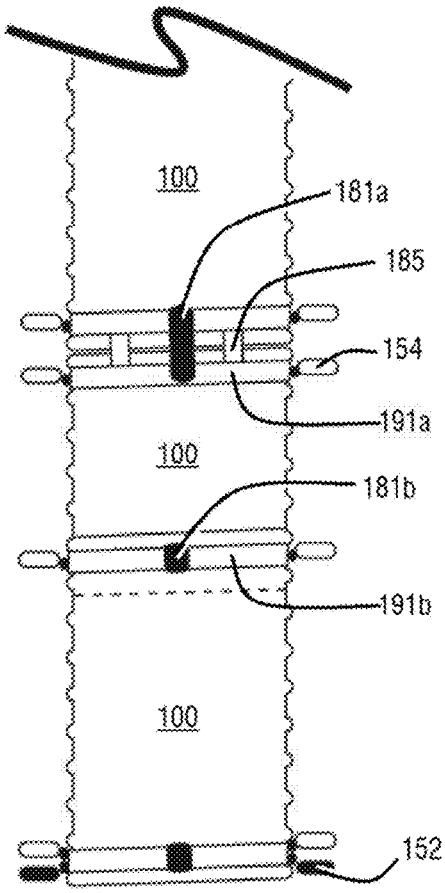
FIG. 20a
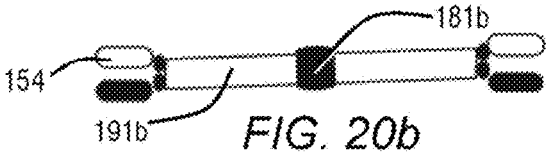
FIG. 20b
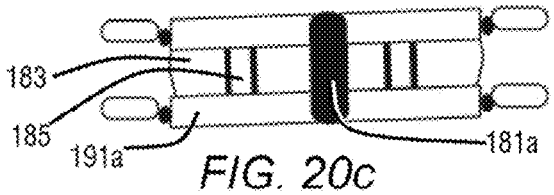
FIG. 20c
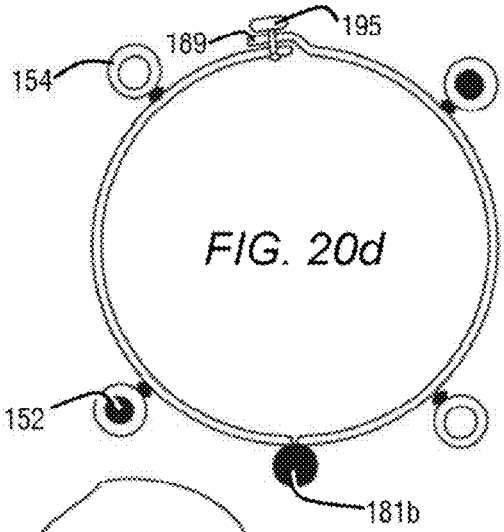
FIG. 20d
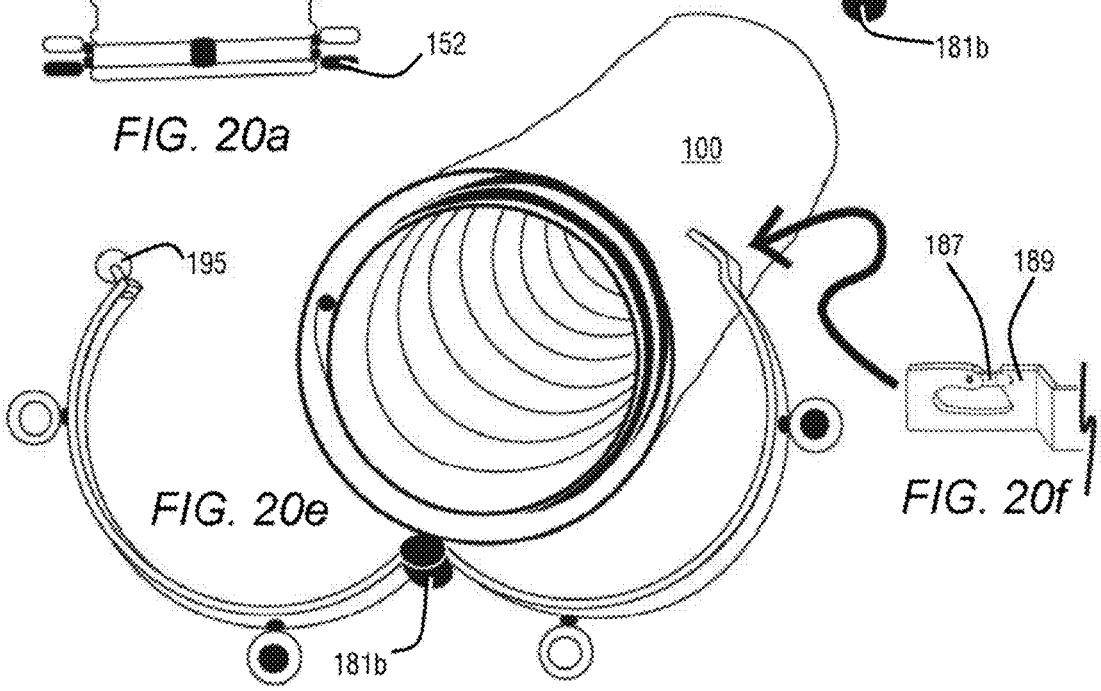
FIG. 20e
FIG. 20f 308
338
340
301a
310
301b 917
301a
301b 312
302a
314
302b 918
302a
302b 316
304

318
305

602
606
600
604

602
919
920
606

600
604

602

302
606
600
604

326
322
324
316
342
306

322
328
324
306

326
338
922
340
330
336
306

922
306

604
600

334
332
330

306a
924
600a
306b 622
618
624
608a
601
306

622
626
628
616
626
614
612
306
616

624
306
604
608b
601

306a
604
600a
620
622
306b
624
618

676
632
654a
654b
650a
656
942
642

654
654a
654b 161
638
652
160
654a
654b
650a
652
161
638
134

652
650a
650
650b

FLUID COLLECTION RESERVOIR AND ANTI-SPILL MECHANISM

CROSS REFERENCES TO RELATED APPLICATIONS

This application is a continuation of U.S. application Ser. No. 14/479,271, entitled "SYSTEM AND METHOD FOR TRACKING SENSORS, MARKERS, AND FLUID FLOWS," filed on Sep. 6, 2014, which itself was a continuation from Ser. No. 13/161,492, entitled "SYSTEM AND METHOD FOR CHANNELING FLUIDS UNDERWATER TO THE SURFACE," filed on Jun. 15, 2011, which claimed benefit and priority to U.S. Provisional Application Ser. No. 61/355,133, filed Jun. 15, 2010, entitled "SYSTEM AND METHOD FOR CHANNELING FLUIDS UNDERWATER TO THE SURFACE," the disclosures of all of which are specifically and expressly incorporated by reference herein in their entireties as if fully set forth herein.

BACKGROUND

Field of the Invention

The field of the present inventions relates to channeling fluids underwater to the surface; more specifically, channeling an oil leak through a controlled channel or riser from an underwater pipe leak to a containment reservoir at a sea surface, with an automated method and system for the same.

SUMMARY OF THE INVENTION

All U.S. patents listed below and throughout are herein entirely incorporated by reference. Further, referenced throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," "in another embodiment," and similar language throughout this specification may, but do not necessarily, all refer to the same embodiment. Many modifications and variations will be apparent to the practitioner skilled in the art.

Also referenced throughout this specification are the terms and/or phrases such as "for example," "for instance," "say," "the like," "etc.," or similar language which generally means that the language, description, and explanation utilized in association is merely to demonstrate an element, feature, item, list of items, purpose, way, means, method, and/or the like for what has been described in association, but depending on the usage and situation, it may not be meant to be exhaustive representation or demonstration, or meant to limit the invention to that particular precise formation.

Further, referenced throughout this specification are also the terms and/or phrases such as "unit," "section," "part," "portion," "element," "entity," "component," "article," or similar language which generally means that a described term and/or phrase in connection thereof constitutes a separate distinct "article", "feature," "structure," "characteristic," "trait," or similar of an embodiment of the present invention. In some embodiments, terms such as "unit," "section," "part," "portion," "element," "entity," "component," "article," or similar language may be interchangeable.

Furthermore, referenced throughout this specification are also the terms and/or phrases such as "units," "sections," "portions," "elements," "entities," "components," "articles," "traits," "characteristics," "group(s)," "selection(s)," composite(s)," "compilation," or similar language which generally means that a described term and/or phrase in connection and/or the combination thereof constitutes also a separate distinct "article", "feature," "structure," "characteristic," "trait," or similar of an embodiment of the present invention.

On Apr. 20, 2010, the company BP® (once named British Petroleum) had an oil drilling rig by the name of the Deepwater Horizon that suffered a major explosion from escaping methane gas in the Gulf of Mexico. Subsequently, the fail-safe mechanism referred to as the Blow Out Preventer (hereinafter "BOP") failed to shut off the oil flow from the well pipe and thus created one of the worst oil spills in history. Since the Apr. 20, 2010 incident, BP® attempted many methods to try and stop the leak and/or collect the oil from wellhead pipe and prevent it from escaping into the ocean/sea. Eventually BP® along with the US government and others, put together a "Response Team" (referred to throughout as the "Response Team" or the "Gulf of Mexico Response Team").

Most early attempts to capture the oil at the mouth of the oil wellhead pipe opening were met with complete failure and/or faced a number of problems. One of the first attempts, May 7, 2010, was to place an ~125 ton, ~four story, container dome dubbed the "top hat" over the leak to channel the oil into the top of the steel canopy top hat and in turn, channel the oil from an attached pipe at the top of the canopy, referred to as a riser, up to ships at the sea surface. However, fluids and gas leaking from the wellhead pipe formed methane hydrate crystals when the gas met the cold water at ~5000 feet below the sea surface and thus blocked the canopy opening at the top of the top hat dome, thus prevented the oil from entering the riser. This clog and lower density pressure under the canopy also caused the container dome to become buoyant. The Response Team decided to scrap this effort.

On May 14, 2010, the Response Team tried another method whereby a robotic underwater vehicle inserted a four (4) inch wide riser into a twenty-one (21) inch wide opening where the wellhead pipe had burst and where the oil was leaking out. Some oil that was previously escaping was collected by the drillship at the sea surface, but not enough to be considered effective.

Next the Response Team tried a method to kill the well referred to as a "top kill" where heavy drilling fluid is pumped into the wellhead pipe to try and overcome the upward pressure of the oil. If successful, the upward pressure needed to be reduced sufficiently to then pour cement into the wellhead pipe and permanently close the well. However, this was not achieved. Consequently, the Response Team also tried to clog the rupture oil well with "junk" dubbed a "junk shot". However, this also failed.

Next the Response Team decided to cut off the damaged riser pipe from the top of the failed BOP to hopefully leave and create a relatively clean cutoff pipe rim where they could then attach a Lower Marine Riser Package (hereinafter "LMRP") Cap Containment System. However, during the cutting of the damaged riser pipe with a special saw with a diamond blade, the diamond blade became stuck and the Response Team had to resort to using a less precise set of shears, thus leaving a relatively ragged surface on the rim of the pipe cut opening. The LMRP Cap Containment System captured some oil, but much appeared to still be leaking.

The methods attempted by the Response Team in May and June of 2010 to capture the oil, gas, and the like; appeared to still be allowing the majority of the escaping fluids to flow into the sea. According to University of Houston Professor Satish Nagarajiah, who speaking on CNN on or around Jun. 15, 2010, said that he estimates that half of the oil and natural gas at that time was still leaking into the sea under the system deployed by the Response Team. On Jun. 15, 2010, CNN's Wolf Blitzer said that even with the Response Team's riser in place that leakage could be as high as 45,000 barrels of oil and natural gas per day.

Eventually the Response Team was able to shut off the leak by drilling what is known in the industry as a relief well. The relief well was drilled back to the original borehole to stop the flow of oil. Unfortunately, these relief wells can take several months to drill at this depth and do not always hit the relatively tiny target of the existing borehole. Further, the oil leak caused other subsequent problems, such as contaminated booms on the sea surface that have been breached by the oil and the Response Team and others have sprayed dispersants that many are concerned will cause and/or lead to other environmental problems and potential health issues.

According to an online article from May 10, 2011, which appeared on the website http://seekingalpha.com: BP® reached an agreement with the US Department of Justice to pay a civil penalty of $25 million to settle its federal civil suit against it for two previous oil spills that took place in Alaska back in 2006. The penalty, according to the website article, was calculated at $4,900 per barrel for the 5,078 barrels of crude oil that spilled in the Alaskan North Slope. The article states that the fine will be paid as $20.05 million to the Oil Spill Liability Trust Fund established under the Clean Water Act, and the remaining $4.95 million to the U.S. Treasury. Also part of the settlement, BP® has agreed to spend an additional $60 million to improve safety. The company will also have an independent contractor monitor and report its operations.

The Seeking Alpha May 10, 2011 article said that in latest earnings release by BP®, the company had pegged the estimated costs from the Gulf of Mexico oil spill at around $41.3 billion. However, this could become much larger if BP® faces a similar per barrel penalty of $4,900 for the Gulf of Mexico oil spill. The article estimates that more than 5 million barrels of oil spilled into the Gulf of Mexico accident which would signify a potential penalty of nearly $25 billion. This is in addition to the $20 billion BP® already set aside in its trust fund to settle all claims and liabilities related to the accident, meaning the actual costs to BP® could surpass $50 billion. http://seekingalpha.com/article/269097-bp-s-alaskan-oil-spill-settlement-and-its-repercussions The short and long term ramifications of the BP® Gulf of Mexico oil spill in 2010 on the economy and environment are quite substantial. Further, the federal government temporarily halted deep sea drilling following the accident to determine what safety measure should be and need to be in place for the future. Most of the methods attempted by the Response Team to capture the oil during the spill appeared to apply too much attention and emphasis to connecting a relatively small diameter riser to the relatively small opening of the oil wellhead pipe. Further, there were a number of subsequent issues that then caused these connection and capturing attempts to fail, including the lack of being able to easily connect the relatively small diameter riser, due to the massive pressure from the oil, gas, and the like; the cold temperatures; the underwater currents; the substantial distance to the surface where they needed to employ underwater robotic submarines to perform the work; and the like.

What's currently needed is a way to deploy a system relatively faster with more effective and efficient methods to capture the oil, even if temporary, and/or until the relief well can be successfully drilled to permanently stop the flow of oil into the water. The system and methods described in following embodiments are projected to greatly help contain a similar spill relatively quickly, inexpensively, while also being able to minimize dispersant usage, and provides a better method of collecting the oil spilled at the sea surface, whereby the oil (and the like) can be still utilized.

In an embodiment of this invention, escaping oil, gas, and the like can be better channeled to the sea surface where it can be contained into reservoirs and pumped into drillships. In an embodiment, the system and methods actual can benefit from the massive pressure and relatively lower density of the oil, gas, and the like when compared to the density of sea water. The massive pressure and relatively lower density from the escaping oil, gas, and the like, allows these fluids to flow through a relatively unrestricted channel up to the sea surface under the fluid's own pressure which is seeking a density equilibrium with it's surrounding environment, thus channeling and controlling the fluids within an overall transport system, thus minimizing many other complications that the Response Team encountered such as with the riser connection leaks at the wellhead pipe opening, the forming of the methane hydrate crystals, and trying to control the massive pressure at the wellhead pipe opening at such great depths. In an embodiment, the system and methods utilized are relatively: easier to deploy; faster to deploy; easier to quickly change out sections, branches, parts, and/or entirely; less expensive; easier to repair; more flexible around obstacles and conditions; more compartmentalized for separating fluids, more tolerant to inclement weather and sea conditions; and consequently relatively more cost efficient, simpler to deploy, and more effective.

BRIEF DESCRIPTION OF THE FIGURES

A better understanding of this invention will be had by referring to the embodiments in the accompanying drawings in which:

FIG. 16*a* depicts an enlarged frontal view of a locking means embodiment for the overlapping-twist connection and similar connections, where the structural coil 102 has a series of outer teeth 402.

FIG. 16*b* depicts an enlarged frontal view of another locking means embodiment for the overlapping-twist connection, where the structural coil 102 also has a series of the outer teeth, but where these particular teeth are a series of retracting teeth 404.

FIG. 16*c* depicts a frontal view of another locking means embodiment for the inserted-twist connection and similar connections, where the structural coil is intended for interlocking the structural coil 102 where each RIS 100 unit would have a series of both outer teeth 406 and a series of inner teeth 408 (depicted by the dotted line area).

FIG. 18*a* is a perspective view of a RIS embodiment where the RIS 100 is say laying flat before deployment and depicts a special inner, referred to as an Inner RIS 112 membrane, and special outer membrane, referred to as an Outer RIS 108 membrane, where the Inserted Materials 170 can be added in between.

FIG. 20*a* depicts a frontal view of an embodiment of another connector means (e.g. joint connector means) referred to as a Hinged Clamp Strap 191 (hereinafter "HCS").

FIG. 20*b* is a frontal view depicting the HCS 191*b* for typically clamping together two FCS 100 units that also interlocked.

FIG. 20*c* is a frontal view of the HCS 191*a* depicting the ability to bridge together two FCS 100 units that do not necessarily interlock otherwise.

FIG. 20*d* is a top or bottom view of an embodiment depicting the HCS 191 with two symmetrically placed Loops 154 and two symmetrically places End Stops 152.

FIG. 20*e* is a perspective view of an embodiment of the HCS 191 in an open position along the hinge 181*b* before wrapping in around the RIS 100 unit.

FIG. 20*f* is a cutaway and truncated perspective view of the HCS overlap 189 section, where a HCS catch 187 can be employed to catch the HCS catch bar 195, similar to a metal leash clip Style C with a swivel for a secure lock on a dog leash.

FIG. 33*a* is perspective view of another embodiment of repairing the Leaking Pipe 636, with two halves that come together to create a Complete Pipe Fix Unit 656.

FIG. 33*b* is perspective view of embodiment of the other half of the Complete Pipe Fix Unit 656.

FIG. 33*c* is a perspective view of an embodiment of the Complete Pipe Fix Unit 656, after connecting the PFTH-A 650 and the PFTH-B 654 units via say adhesives, welds 652, collars, belts, and/or the like.

FIG. 33*d* is a perspective view of an embodiment of the Complete Pipe Fix Unit 656, where the PFTH-A 650 and the PFTH-B 654 units are connected by a Pipe Fix Hinge 642 along the bottom and where a Pipe Fix Top Seam can be closed with a range of methods, including an overlap with a gasket, adhesives, welds 652, collars, belts, and/or the like.

FIG. 38 is a cross section frontal view of an embodiment of the truncated STACCO 99 that is similar to FIG. 1 to depict the pathway of the HOS 200 and the Fluid Product 160.

Figure 39A:
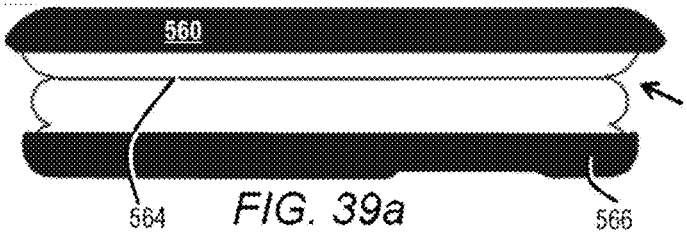

FIG. 39*a* is a frontal view of an embodiment of the CR 599. The CR 599 has a Canopy 560 and a Sealed Reservoir bottom 566.

Figure 39B:
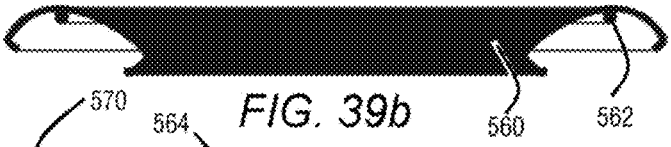

FIG. 39*b* is a frontal view of an embodiment of one of four sections of the Canopy 560. The Canopy 560 four sections are connected to a Canopy Hinge Mechanism 562 that allows the Canopy 560 four sections to rotate independently along the Canopy Hinge Mechanism 562.

Figure 39C:
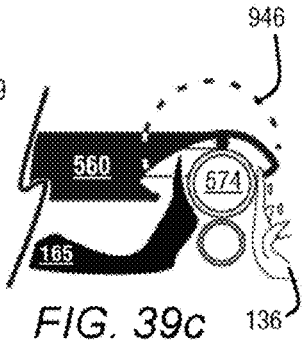

FIG. 39*c* is a truncated cross section view from the back (or opposite side of FIG. 39*d* view) of an embodiment with a dotted line 946 depicts a potential rotation arc for the Canopy 560.

Figure 39D:
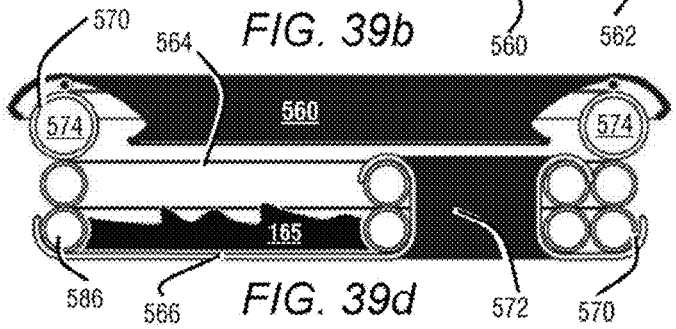

FIG. 39*d* is a cross section view from the front of an embodiment of the CR 599 where the cross section has been cut through the center of a Reservoir Opening 572 for the HOS 200.

Figure 39E:
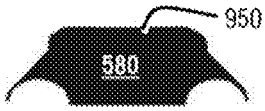

FIG. 39*e* is a frontal view of an embodiment of a RIS-E Lip 580 that forms the top of the RIS-E 141 and the top of a RIS-E Lip 580 creates a RIS-E rim depicted by a line 950.

Figure 39F:
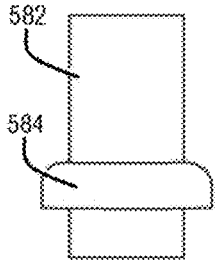

FIG. 39*f* is a frontal view of an embodiment of a RIS-E Stem 582 which is overlapped by a RIS-E Collar 584.

Figure 39H:
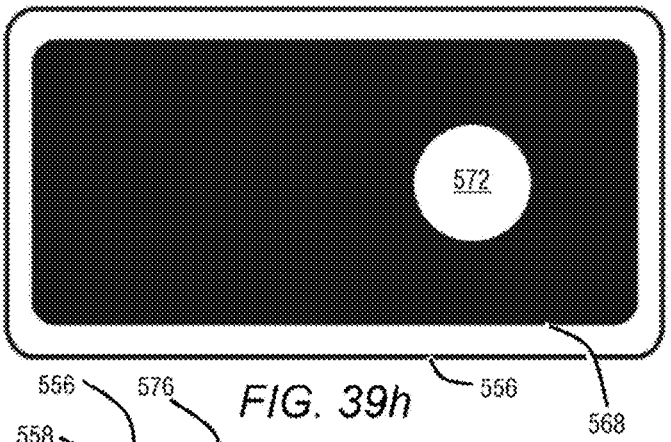
Figure 39G:
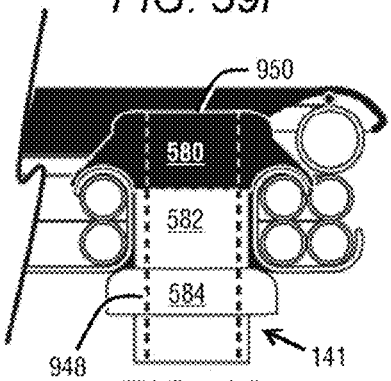

FIG. 39*g* is a truncated cross section view from the front of an embodiment of the CR 599 where the cross section has been cut through the center of the Reservoir Opening 572 with the RIS-E 141 connected to the end of the HOS 200.

FIG. 39*h* is a bottom view of an embodiment of the CR 599 that depicts the Reservoir Sealed Bottom 566

Figure 39I:
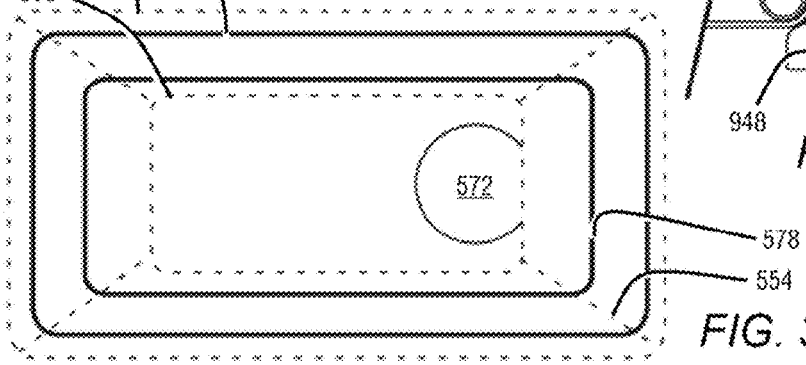

FIG. 39*i* is a top view of an embodiment of the CR 599 that depicts the Canopy with a dotted line and the Reservoir Tube Rim 574 perimeter with a full line.

Figure 1:
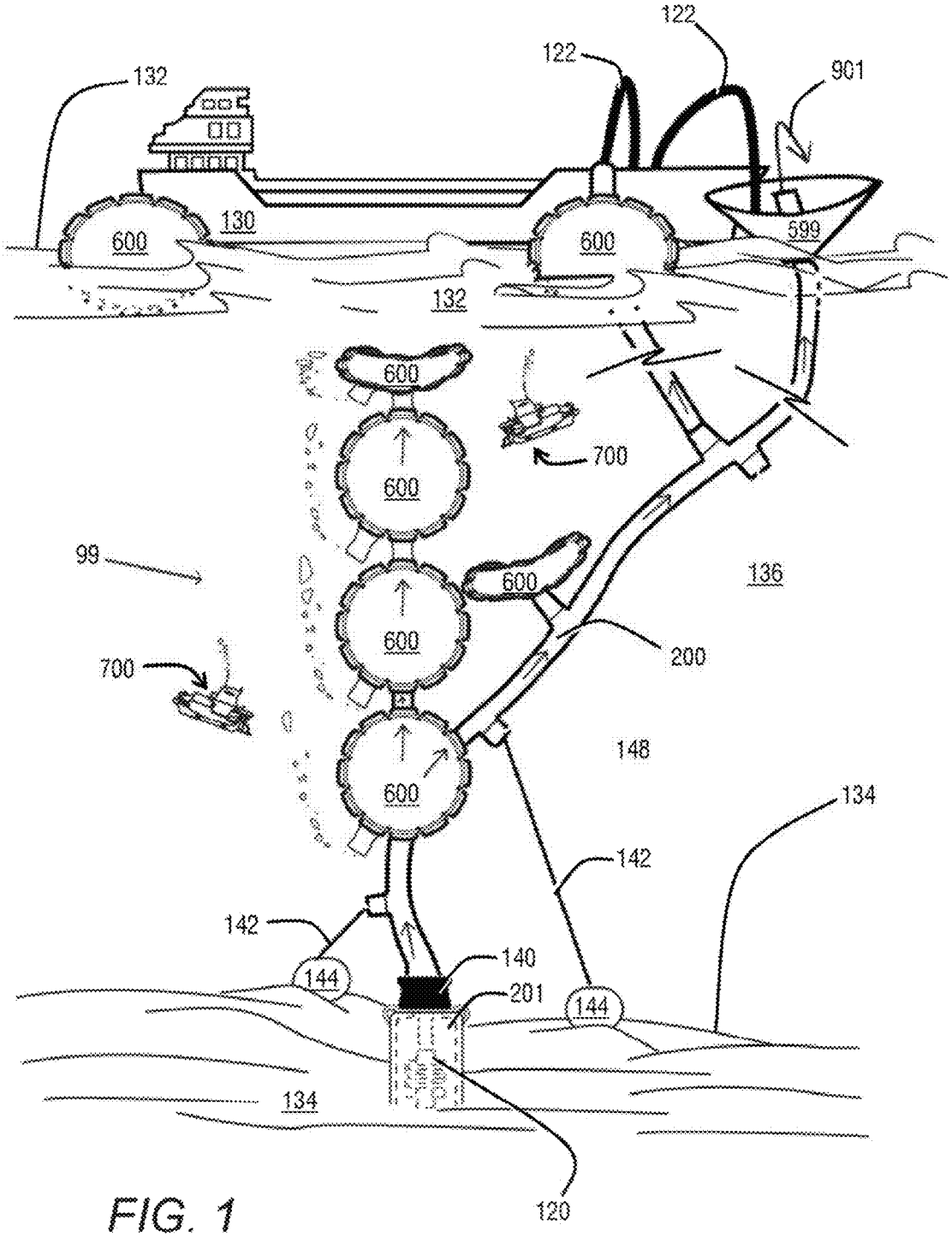
FIG. 1 depicts a frontal view of an embodiment of a "System for Transporting and Collecting Captured Oil" (and the like) 99 (hereinafter "STACCO" 99).
Figure 40:
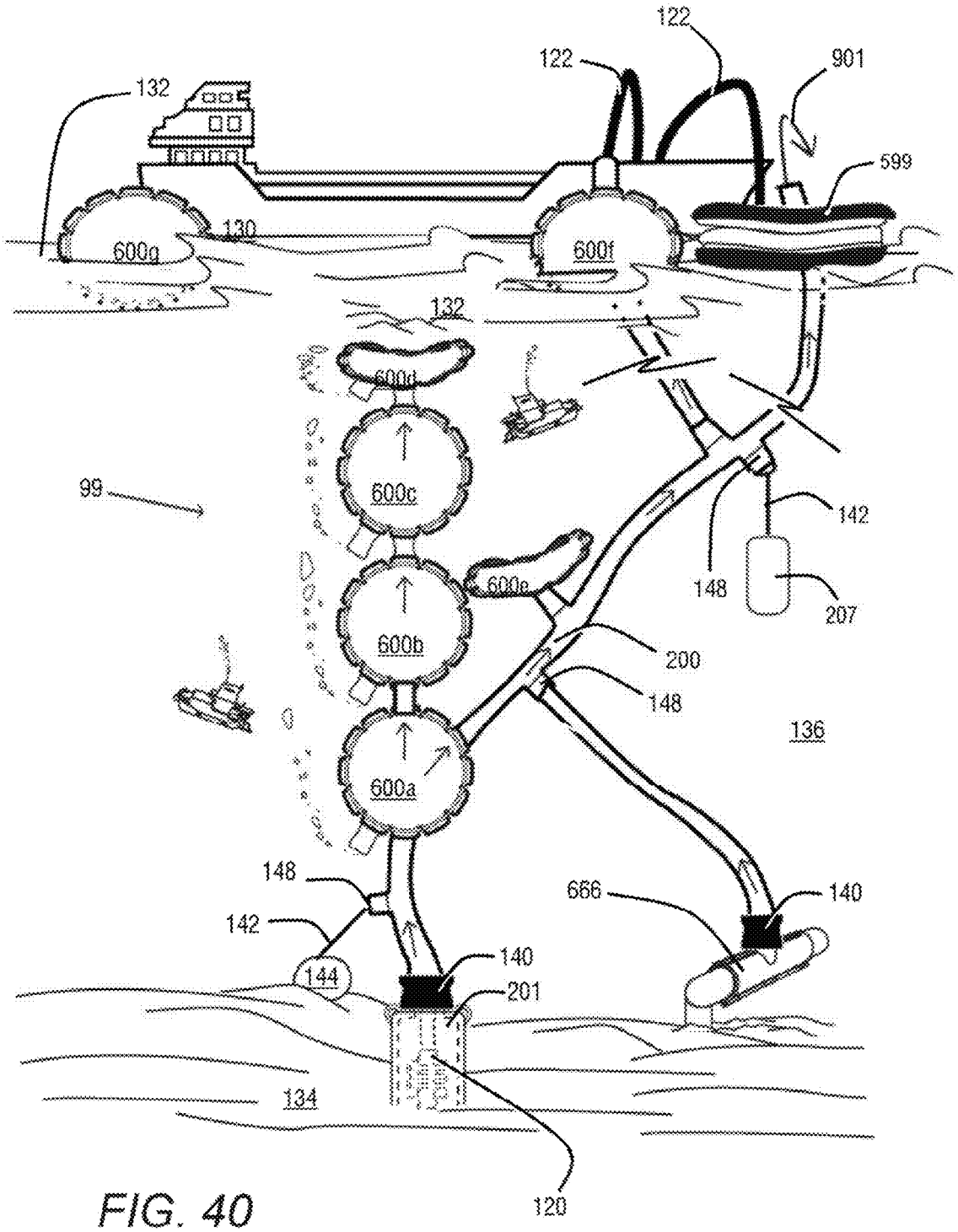

FIG. 40 is a frontal view of an embodiment of the STACCO 99 truncated that is similar to the depiction described in FIG. 1 and where there are a number of the CB 600 connected along the HOS 200.

Figure 41:
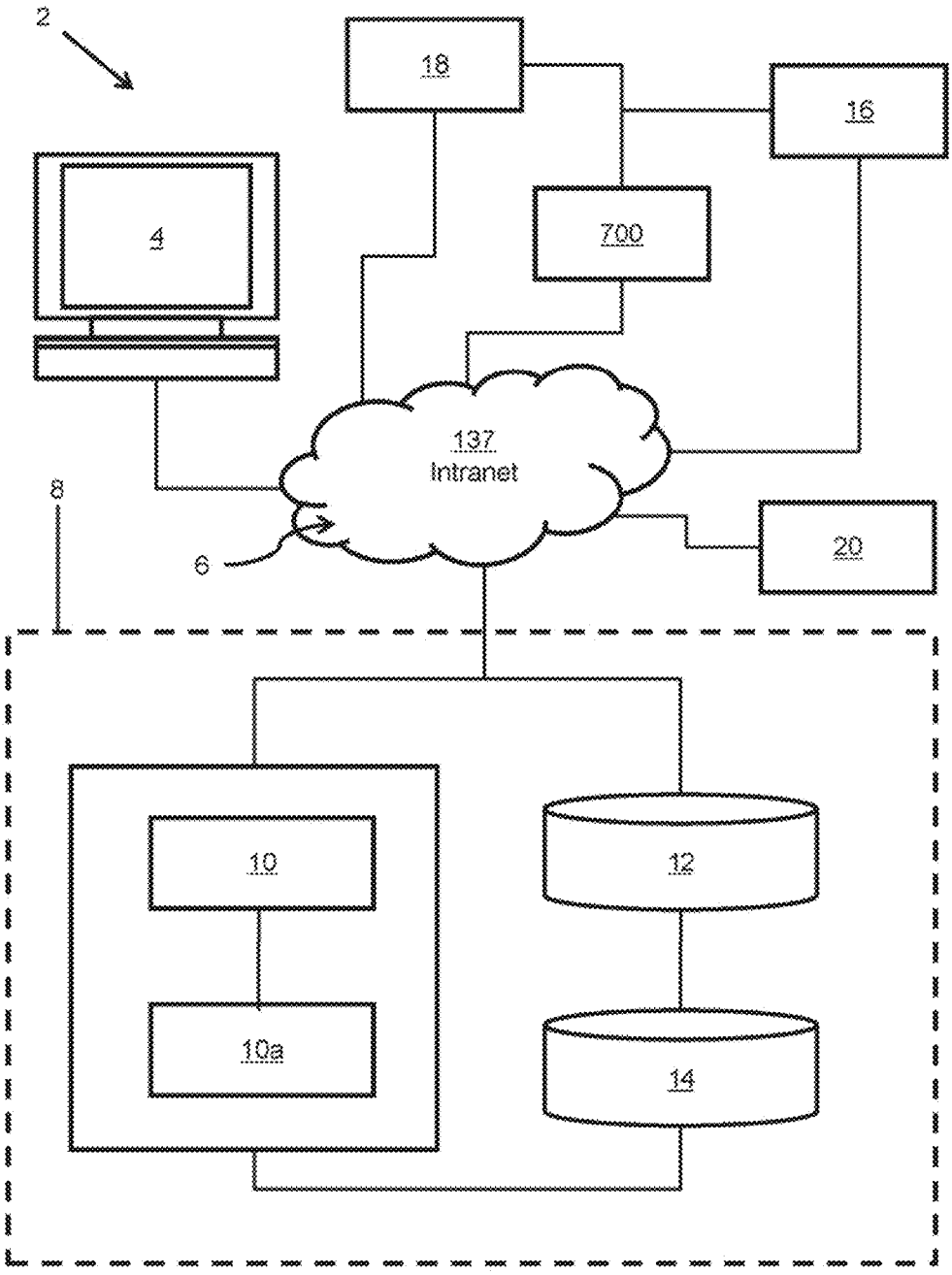

FIG. 41 of the accompanying drawings illustrates a general overview of an information exchange, tracking and retrieval client-server network 2 (sometimes simply referred to as the "client-server network 2) in which the embodiment may be implemented, including a variety of components that communicate over a private network 6, preferably a private Intranet 137 per one embodiment, but could also be a public Internet in another embodiment, and/or a combination.

Figure 42:
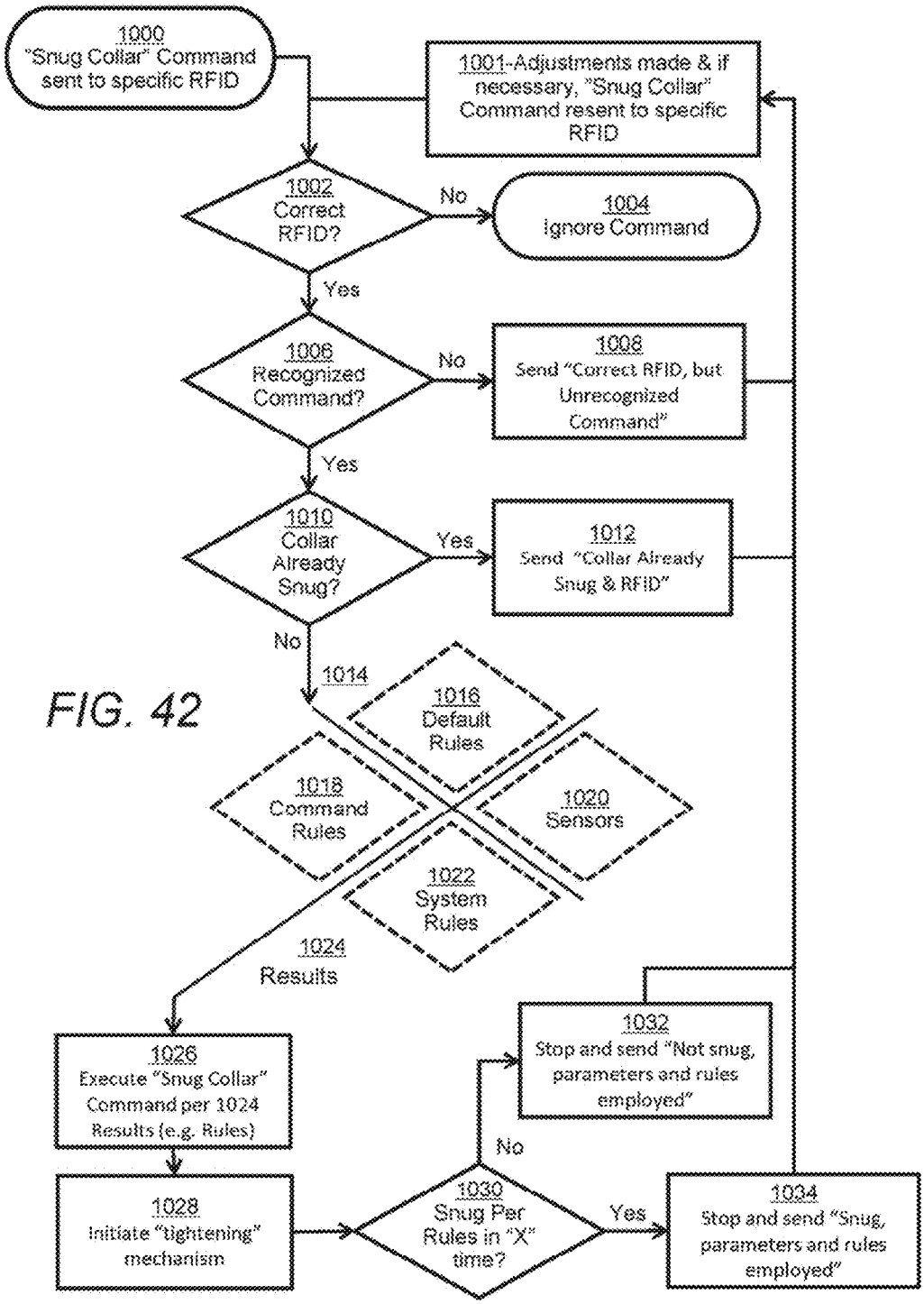

FIG. 42 is a flow chart depicting an embodiment of performing an automated method of tighten a collar around a particular RIS 100 unit or similar with a unique RFID and a mechanized collar.

DETAILED DESCRIPTION OF THE INVENTION

Referring first to a FIG. 1 depicts a frontal view of an embodiment of a "System for Transporting and Collecting Captured Oil" (and the like) 99 (hereinafter "STACCO" 99 and sometimes may also be referred to as an "Overall Transport And Channeling System" or OTACS 99). This embodiment creates a system and a method to channel, transport and capture a Fluid Product(s) 160 (e.g. oil, gas, and the like) leaving/escaping from, say a leak or an opening in a wellhead pipe 120 opening 162 or similar, typically at or near a seabed 134 to a sea surface 132 upward through a hose, generally in a sea water 136 and into a collection area. The collection area can be inside a Collection Balloon 600 (hereinafter "CB" 600) or another collection area for temporarily pooling the Fluid Products 160 collected, referred to as a Collection Reservoir 599 (hereinafter "CR" 599) in this embodiment, typically at the sea surface 132.

The CR 599 at the sea surface 132 is typically a designated area for collecting the Fluid Product 160 for immediate or eventual capture. The Fluid Products 160 that flow through the STACCO 99 enters the CR 599 through a sea surface hose opening of the STACCO 99. An arrow 901 depicts an instance of the pathway and direction by which the Fluid Products leave the sea surface hose opening of the STACCO 99 and enter the into the CR 599. Further, the Fluid Products 160 collected at the sea surface 132 could in turn, be pumped into a drillship 130, or similar, say a ferry tanker, a barge, an off-shore platform, an on-land collection area, and/or the like utilizing a Fluid Product Collection System 168 (not shown) with, say a collection hose 122 with, say a vacuuming system, and/or the like. Where one end of the collection hose 122 is located within the Fluid Product Collection System 168, say located onboard the drillship 130 and other end of the collection hose 122 can be placed within the CR 599 area in a manner that allows for it to ideally collect the Fluid Product 160.

The drillship 130 could also collect the Fluid Product 160 by either pumping the Fluid Product 160 through the collection hose 122 from the CB 600 that is either at, near, or below the sea surface 132. In some embodiments the collection of Fluid Products 160 from both the CB 600 and the CR 599 are collectively referred to as a CB/CR 600/599. Further, the drillship 130 could utilized a wench or a crane-like system (not shown) to lift a particular CB 600 from the sea surface 132 directly into the drillship 130 where it can be transported and/or drained out. Some embodiments of the CB 600s can be relatively cleaned out and reused. Some embodiments of the CB 600 allow an inner lining or an inner membrane of the CB 600 to be swapped out or replaced.

Figure 2:
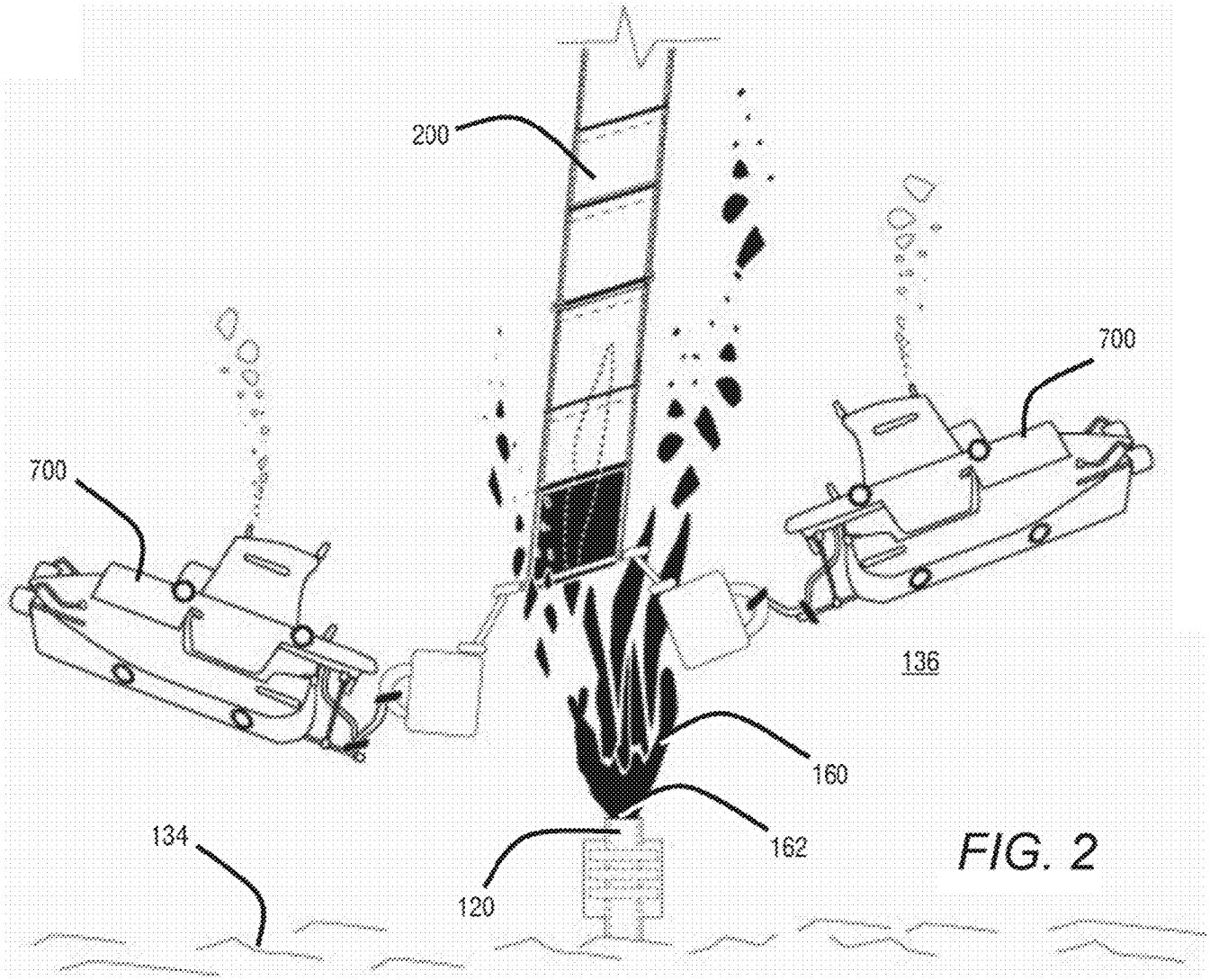
FIG. 2 is a frontal view depicting of an embodiment of the deployment of the bottom end of the STACCO 99 at the seabed by a pair of robotic submarines 700.

FIG. 2 is a frontal view depicting of an embodiment of the deployment of the bottom end of the STACCO 99 at the seabed by a pair of robotic submarines 700. One key to the STACCO 99 is to not necessarily try and connect a relatively small traditional riser with a relatively tight connection at the wellhead pipe 120 opening 162 relatively immediately, as can be the case in the industry. Such traditional industry attempts typically create enormous challenges, where sufficient planning can delay any deployment for extended periods of days, and additional delays when such attempts are unsuccessful, especially when such attempts create additional problems.

Traditional systems typically try to relatively tightly and completely connect the riser/channel at the actual wellhead pipe 120 opening 162 when there is, say an oil leak; but where the escaping oil (also more generally referred throughout as an escaping Fluid Product 161) is coming out with tremendous pressures. In some cases, at significant water depths, where this greatly increases the relative difficulty to make a proper connection and/or the ability to promptly capture the escaping Fluid Products 161. Further, trying to then force all of the escaping Fluid Product 161 through a relatively small transport channel or relatively small diameter riser at that depth can be relatively unforgiving and can actually cause delays in implementing, and other problems, such as, the forming of methane hydrate crystals that can clog up the relatively small diameter riser.

Whereas, the STACCO 99 in this invention and embodiment, instead creates a new riser with a relatively larger inside-diameter, such that an inside-diameter size is at least as large, or preferably much larger than the outside diameter size of the wellhead pipe 120 opening 162. Further this larger inside-diameter size of the riser in this embodiment would generally be large enough to slowly lower and initially capture the majority of the Fluid Product 160 that was otherwise escaping (escaping Fluid Products 161) into the seawater without causing insurmountable pressure that can otherwise come from trying to connect a riser with a relatively small inner diameter riser/hose too quickly during an oil leak. The relatively larger inside-diameter riser in this embodiment is actually a transport duct (eg. an oil hose) that can be constructed of a number of units, sections, elements, parts, and components, and herein referred to as a Hose Overall System 200 (hereinafter "HOS" 200, and may sometimes also referred to as an Overall Flexible Riser or OFR 200, or Overall System Riser 200, or an Overall RIS 200).

In this embodiment the HOS 200 generally refers to all the of units, sections, elements, parts, and components that make up the transportation duct and storage elements, other than say a disconnected units, sections, elements, parts, and components from the body of the HOS 200. In some embodiments there can be more than one HOS 200 deployed simultaneously, but once each separate HOS become connected to the other by a direct connection, the two become one HOS 200 (explained more ahead).

In this embodiment the HOS 200 could be submerged, maneuvered, and placed over the wellhead pipe 120 opening 162, presumably near the seabed 134 with the other top end of the HOS 200, say at or near the sea surface 132 with an inner diameter left open or relatively unblocked, other than for, say a sea water 136. In this FIG. 2 depiction, the HOS 200 has been truncated at the top, but could be pre-constructed aboard, say the drillship 130 and long enough to run all the way to the sea surface 132. Further and unlike traditional industry risers, this capturing of the Fluid Product 160 and its pressure can be engaged relatively slowly, so as not to damage the HOS 200 as it is lowered over the wellhead pipe 120. In an embodiment, the HOS 200 or a portion of the HOS 200 can be assembled with several interconnected smaller hose portions, sections, or individual hose units. Each individual hose unit of the HOS 200 is generally referred to as a Riser Individual Section 100 (hereinafter "RIS") 100.

Figure 3A:
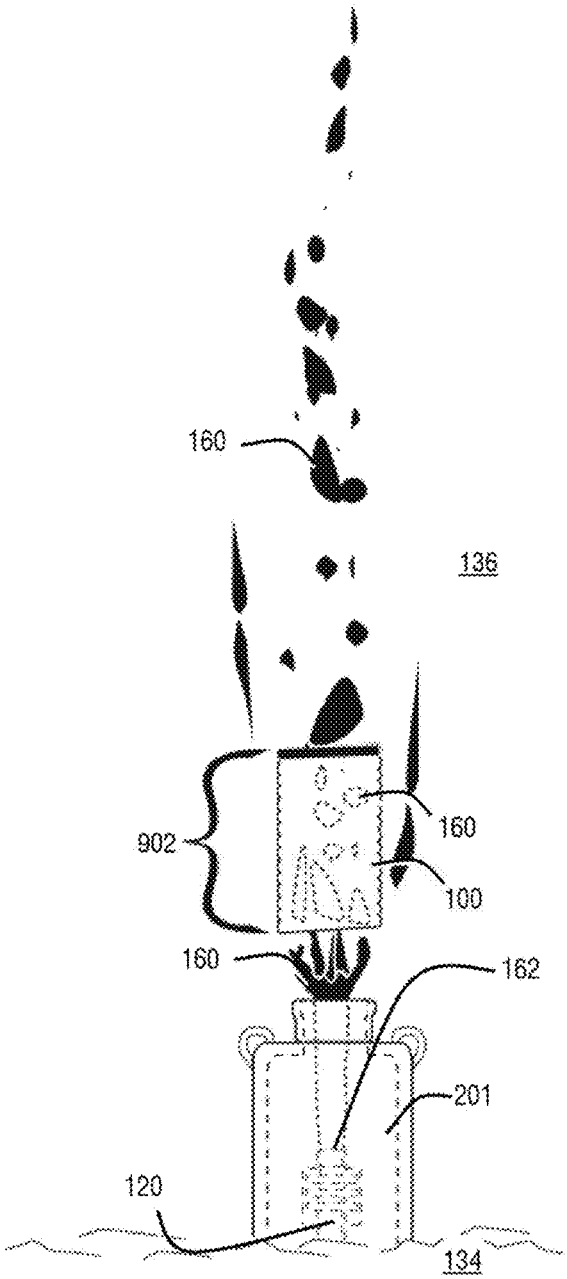
FIG. 3*a* depicts a frontal view of an embodiment of the RIS 100 in a relatively fully compressed state referred to as a relatively compressed-state height-wise and is depicted with a bracket 902 where the RIS 100 has been strategically positioned over a leaking wellhead pipe 120.

FIG. 3*a* depicts a frontal view of an embodiment of the RIS 100 in a relatively fully compressed state referred to as a relatively compressed-state height-wise and is depicted with a bracket 902 where the RIS 100 has been strategically positioned over a leaking wellhead pipe 120. In this illustration, the leaking wellhead pipe 120 is depicted by a dotted line as it is presented engulfed by a Special Top Hat 201 embodiment that will be explained in more detail later.

There can be a variety of RIS 100 unit types, sizes, diameters, materials, construction methods, shapes, uses, connection types, purposes, and the like. Some embodiments of the RIS 100 units allow each unit to be in the relatively compressed-state height-wise during storage and/or during deployment. The relatively compressed-state height-wise allows the RIS 100 units to be stored, say upon the drillship 130 in a manner that relatively conserves space and helps protect the RIS 100 units from, say damage, and the like. In addition, the RIS 100 could be deployed in the relatively compressed-state height-wise where the Fluid Products 160 are allowed to freely flow through the unit when strategically positioned. The eventual connection of a subsequent RIS 100 unit, say from above starts the process of building the HOS 200. In some embodiments, a single RIS 100 unit could be long enough to make up the entire HOS 200, but generally the HOS 200 has a plurality of the RIS units and other components.

In FIG. 3*a* only a single RIS 100 unit is depicted, but the same expansion properties and deployment methods would apply to the HOS 200. For instances, a series of RIS 100 units collectively within the HOS 200 can be in a collective relatively compressed-state height-wise during deployment, and where the Fluid Product 160 can thus be allowed to flow through a relatively short channel when compared to a relatively uncompressed-state height-wise. Then after the Fluid Product 160 is deemed to be flowing through the HOS 200 under the collective relatively compressed-state height-wise, the HOS 200 can then be expanded, generally towards the sea surface 132 to help minimize potential damage that may otherwise have occurred (more ahead).

Figure 3B:
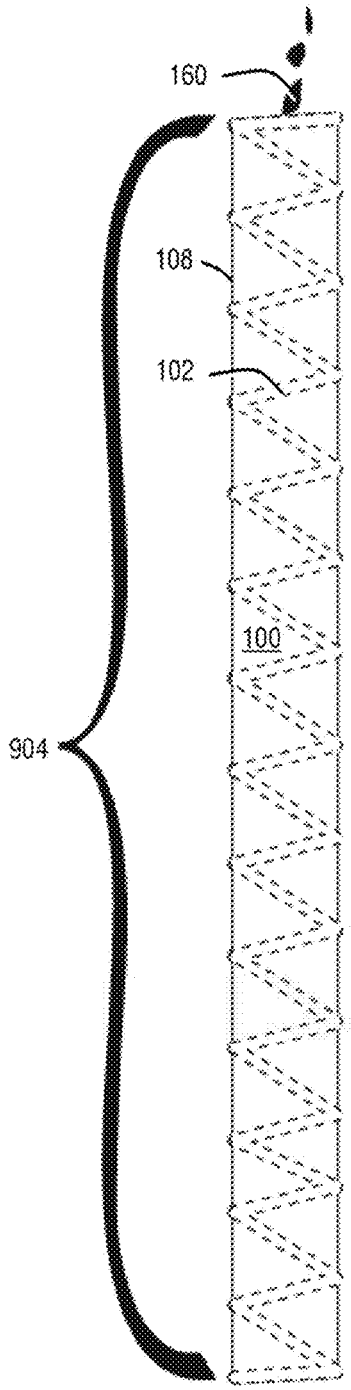
FIG. 3*b* depicts a frontal view of an embodiment of the RIS 100 and an inner structural coil 102 with an outer membrane 108 that has been stretched over to create a relatively tight form-fit over the top of the structural coil 102 for creating an embodiment of the transport channel for the Fluid Products 160 (e.g. oil, gas, and the like).

FIG. 3*b* depicts a frontal view of an embodiment of the RIS 100 and an inner structural coil 102 with an outer membrane 108 that has been stretched over to create a relatively tight form-fit over the top of the structural coil 102 for creating an embodiment of the transport channel for the Fluid Products 160 (e.g. oil, gas, and the like). In this embodiment, the relatively tight form-fit of the outer membrane 108 over the top of the structural coil 102 should ideally not impede the relative flexibility of the RIS 100 unit in all directions, say similar to a children's Slinky® toy.

The RIS 100 has an inner structural element referred to as the inner structural coil 102 (sometimes referred to as the coil, the RIS coil, the inner structural coil, the RIS inner structural coil, or the like depending on the embodiment) depicted inside the outer membrane 108 with the dotted lines that allow for the vertical height expansion, but also has flexibility to be, say curved, turned, and/or twisted as needed. The inner structural coil 102 could be made of a variety of materials that allow it to be compressed like an accordion/spring into, say the relatively compressed-state height-wise and flexible enough to ideally allow for changes in, say a sea current and/or changes to an interior pressure from, say the Fluid Products 160 and/or sea water 136 without causing the RIS 100 and/or the collection of the RIS 100 units now comprises the HOS 200 to become damaged.

Further, the structural coil 102 may be made of a variety of densities and/or materials depending on such things as what depth that a particular RIS 100 section/unit is going to be deployed below the sea surface 132, the type of Fluid Products 160 that that particular RIS 100 unit will be channeling, what range in temperatures the surrounding and interior water will likely cover (e.g. from a worse case top end to a worse case a low end), a likely temperature means in the surrounding and interior water and/or Fluid Products 160, and the like. In addition, what is the purpose and/or function of each RIS 100 unit, e.g. what's the specific RIS 100 unit going to surrounded/encompassed by (e.g. covering other items such as an inner riser, STP, and/or the like), temperatures it will likely encounter, pressures it will likely encounter, what will the specific RIS 100 connecting to from above and connecting to from below; and the like.

In an embodiment, such flexibility could help allow the lower bottom/last end unit of the HOS 200 to better fit around the wellhead pipe 120 opening 162, and/or even fit around a BOP 121, and if necessary, and designed large enough or expand out large enough (more ahead). In addition, the HOS 200 could be designed and/or assembled to work in conjunction with other smaller risers that are traditionally used in the industry, where a larger HOS 200 could be constructed to fit around the outside (FIG. 5*c*) and help collect any of the escaping Fluid Products 161. Consequently, there can be a variety of the RIS 100 units, types, conditional uses, sizes, shapes, and methods of assembly, where each RIS 100 unit/type is connected and/or linked together as needed.

In the embodiment in FIG. 3*b* the RIS 100 unit has been expanded to the relatively uncompressed-state height-wise depicted with a bracket 904 due partially to an expansion capability of the inner structural coil 102. The outer membrane 108 would be generally made of flexible materials that ideally can withstand the Fluid Products 160 pressure and still allow each of the RIS 100 and the HOS 200 to be flexible, compressible, stretchable/expandable, and relatively damage resistant, so as not to deteriorate from contact with petroleum based products and the like, yet strong enough to handle extreme pressures and extreme temperatures.

In an embodiment, a construction method (not necessarily the materials) allows for material folds in the outer membrane 108, say at each gap along the structural coil 102 to help with the vertical expansion capability in the relatively uncompressed-state height-wise. The construction methods with material folds that allow for the relatively uncompressed-state height-wise could be similar to, say a relatively uncompressed-state height-wise of a flexible dryer duct vent that is traditionally used on a household dryer appliance with its vertical expansion and accordion-like capabilities that give it the relatively uncompressed-state height-wise. Where, for instances, a relatively compressed-state height-wise dryer duct may measure just four and half (4.5) inches when it's in or near a fully compressed state, but when it's in the relatively uncompressed-state height-wise at or near a fully expanded state, the same unit could now measure more than eight (8) feet, thus creating an expansion ratio of more than twenty-one-to-one (21:1).

That same amount of expansion ratio between the fully compressed state to the fully expanded state is not illustrated in FIG. 3*b*. Further, that amount of relative expansion is not necessarily critical to the overall success and/or functionality of the STACCO 99, each the HOS 200, and/or each RIS 100. However, some expansion does lend itself to, say saving space aboard the drillship 130 and has other benefits, where some benefits will be obvious to someone skilled in the art, and some other benefits shall be explained.

For example, in an embodiment a particular RIS 100 unit or section that is fully compressed may consume less than 3 feet in length, but can be fully expanded/stretched out to a distance of, say, 50 feet. This compression and expansion makes these particular RIS 100 units more transportable aboard the drillship 130, and in some cases the fully compressed state may be beneficial in certain conditional deployments and/or during the actual channeling of the Fluid Product 160 to, say add relative strength in certain areas/sections. Further, in some embodiments of the particular RIS 100 units, the fully compressed state is generally stronger than the fully expanded state due in part to the fully compressed state of the structural coil which thickens the RIS 100 wall when compared to the Outer member 108 alone in area between the structural coils 102 in the relatively uncompressed-state height-wise.

The depictions in FIGS. 3*a* and 3*b* are on a single RIS 100 unit, but there could be a plurality of RIS 100 units interconnected initially, where the collected units could remain in the relatively compressed-state height-wise until some level of conditions were met before expanding the RIS units (now the HOS 200), for say a measurable distance pre-assembled to provide, say an adequate precautionary measure. Further, the RIS 100 units could be deployed and set into place either one RIS 100 unit at a time or by either deploying a group of RIS 100 units in the fully compressed state, or a deploying a group of RIS 100 units in the fully expanded state, or somewhere in between, and/or per unit, section, or the like.

In some embodiments and instances, ideally, the STACCO 99 is deploy without trying to surround too many other items, such as existing risers that may be in use, protruding damaged sections, or previously attempted risers and/or the like. Ideally, some of these items can be moved, removed and/or cut away, if possible, so that there is less obtrusions and so that there can be a relatively better percentage of the Fluid Product 160 being captured and/or a relatively better opportunity to established a better seal below/behind the wellhead pipe 120 opening 162 (or similar) at or near the seabed 134. However, a benefit of the HOS 200 is its ability to be flexible around obstacles that traditional risers cannot. In some instances, ideally, the HOS 200 would be allowed to fully engulf the wellhead pipe 120 opening 162 with overlap sufficient to collect the majority, and ideally, eventually all of the escaping Fluid Product 161, until some other, say permanent means, such as the drilling of an industry standard relief well, when and if necessary.

Figure 4A:
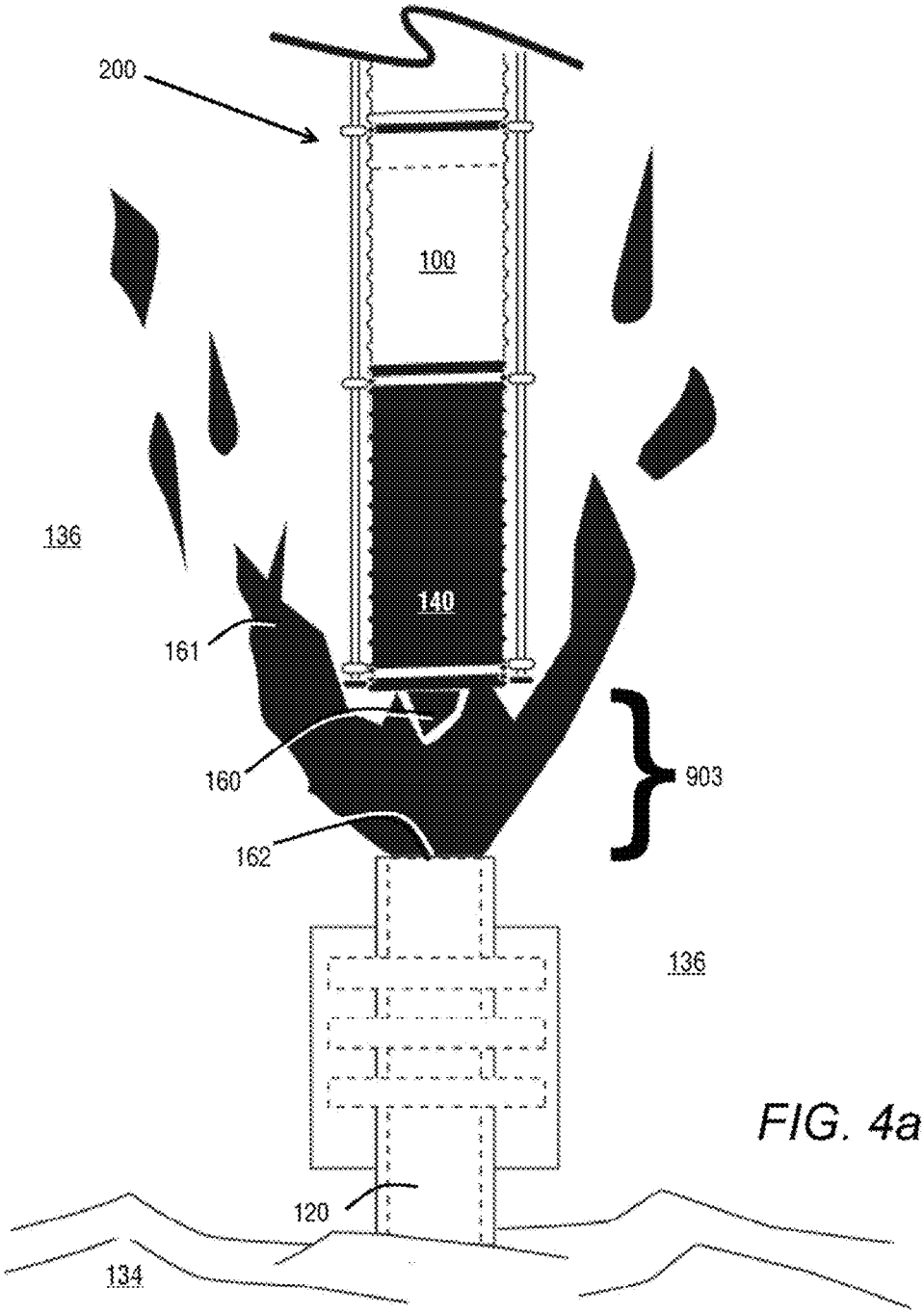
FIG. 4*a* depicts a frontal view an embodiment of an instance during the lowering of the HOS 200 over the wellhead pipe 120 opening 162 near the seabed 134, but still at a "measurable safe distance" away as depicted by a bracket 903.

FIG. 4*a* depicts a frontal view an embodiment of an instance during the lowering of the HOS 200 over the wellhead pipe 120 opening 162 near the seabed 134, but still at a "measurable safe distance" away as depicted by a bracket 903. There are special embodiments of the RIS 100 units for each end of the HOS 200. An initial RIS unit referred to as an Initial RIS unit 140 (hereinafter "I-RIS" 140) is generally the lowest and the initial RIS 100 unit (or in some embodiments, one of a series of initial units) on the HOS 200 to first come in contact with the Fluid Products 160 and is typically the lowest in the series or in the chain of connections (other than, say the top hat and the like) at the bottom near the sea bed 134. There is also another special embodiment of the RIS 100 end unit at the opposite (e.g. top end) of the HOS 200 referred to as a RIS-End 141 (hereinafter "RIS-E" 141) which is generally the last RIS 100 unit where the Fluid Product contacts before exiting the HOS 200 (not depicted in FIG. 4*a*) at or near the sea surface 132. The RIS-E 141 is also typically the last RIS 100 unit at the top of the HOS 200 (other than, say the CR 599 or a CB 600) and above the sea surface 132. In some embodiments of the HOS 200 there can be more than one I-RIS 140 and/or more than one RIS-E 141 connected to the same HOS 200.

In an embodiment of the HOS 200, both the I-RIS 140 and the RIS-E 141 are typically made of heavier reinforced materials. In some embodiments the I-RIS 140 and the RIS-E 141 are made of a heavy gauge rubber or rubber-like material that can withstand the relatively harsh conditions, relatively resistant to the Fluid Products 160, and yet are relatively flexible.

According to a U.S. Pat. No. 7,858,674 granted Dec. 28, 2010, to Haas et al, the term "rubber" is intended to cover any standard rubber which must be vulcanized to provide a dimensionally stable rubber article. The term "dimensionally stable" is intended to encompass a vulcanized rubber article that is structurally able to be handled without disintegrating into smaller portions. Thus, the article must exhibit some degree of structural integrity and, being a rubber, a certain degree of flexural modulus.

According to Haas et al U.S. Pat. No. 7,858,674 (and herein entirely incorporated by reference), the specific types of rubber listed herein below, have been utilized previously within the rubber industry for a variety of applications and are generally well known and taught throughout the prior art. The rubber component or components of the [Haas et al] inventive rubber formulation for the cured article is preferably (herein, generally, for this embodiment) selected from the group consisting of nitrile rubber [such as acrylonitrile-butadiene rubber (NBR)], ethylene propylene diene monomer (EPDM) rubber, hydrogenated NBR, carboxylated NBR, and mixtures thereof.

Per Haas et al, it is important to consider the desired physical properties of the rubber article(s) when selecting the polymer and the curing system. For example, high molecular weight EPDM polymers tend to exhibit higher green strength and tensile strength and lower compression set compared to lower molecular weight polymers. In peroxide cured elastomers, it is often more desirable to use these high molecular weight polymers as peroxide composites exhibit poorer 'hot tear' strength at elevated temperatures compared to sulfur cured composites.

Referring back to the I-RIS 140 and the RIS-E 141, in some embodiments the I-RIS 140 and the RIS-E 141 may have only a partial structural coil 102 where the structural coil does not extend the full length of the RIS unit. In some embodiments, the I-RIS 140 and the RIS-E 141, could have no inner structural coil 102, but instead the I-RIS 140 and the RIS-E 141 could be performed with the heavy gauge rubber or rubber-like material, where each could still have a relatively range of expansion from the fully compressed state to the fully expanded state, say similar to a rubber bellow article of the rubber components listed above.

A critical instance to the relative future success of the STACCO 99 system happens during the deployment, more specifically during the lowering and attaching of the I-RIS 140 to the wellhead pipe 120 opening 162 at the bottom of the sea 134. Similar to other underwater riser deployment and attachment methods and precautions that have been employed in the oil drilling industry, the I-RIS 140 could be done by the underwater robotic submarines 700, and the like. Depending on the conditions, such as the wellhead pipe 120 damage, depth and pressure of the escaping Fluid Product 161; in some instances, the deployment would need to be performed slowly, cautiously, and measurably from above.

Where in some instances, ideally the HOS 200 would gradually begin to capture only a small portion of the pressure and the Fluid Product 160 from a "measurable safe distance" 903 from the wellhead pipe 120 opening 162, but not overly close, as to cause measurably too much pressure, too quickly that may lead to damage or the like. The "measurable safe distance" 903 could be derived from a collection of such data, as historical data, tests/trials, and could incorporate data from a number of traditional measuring instruments in real-time or near real-time during deployment that are typically used with the industry to, say gauge the pressure of the Fluid Product 160 escaping at the wellhead pipe 120 opening 162, and to also gauge the amount of pressure once the Fluid Product 160 is being collected. Further, the "measurable safe distance" data components could also incorporate the overall effects of the real-time or near real-time pressures on a specific I-RIS 140, a specific RIS 100, and the HOS 200, where in addition to traditional industry equipment and gauges, there could also be a sensor(s) 18 embedded within the I-RIS 140 (not shown in FIG. 4*a*) that can collect such data as pressures, flow rates, stresses, relative unit movements, physical unit movements, temperatures, and the like.

In an embodiment, there is a benefit to a relatively minimal amount of the Fluid Product 160 allowed to flow into the HOS 200 initially that would in turn help extend the HOS 200 towards the sea surface, and ideally, remove most, if not all, of the restrictive kinks, and/or as many areas of resistance along the HOS 200, as possible. Thus allowing the pressure from the Fluid Product 160 escaping the wellhead pipe 120 opening 162 to help slowly and partially fill the I-RIS 140 from the measurable safe distance 903.

This limited pressure and the relatively minimal amount of the Fluid Products 160 allowed to help straighten portions of the RIS 100 and the rest of the HOS 200 to the sea surface 132, also helps prevent the potential damaging of the HOS 200, the RIS 100 units, and the RIS 100 connections; similar to, say removing the kinks in a garden hose. Further, the HOS 200 deployment strategy that allows the Fluid Products 160 to flow through relatively unrestricted and begin to come out the far end (typically the RIS-E 141), is similar in concept to turning up the water pressure in that same garden hose to clean it out before connecting, say a hose spray nozzle at the far/opposite end that would instead restrict the flow.

Figure 4B:
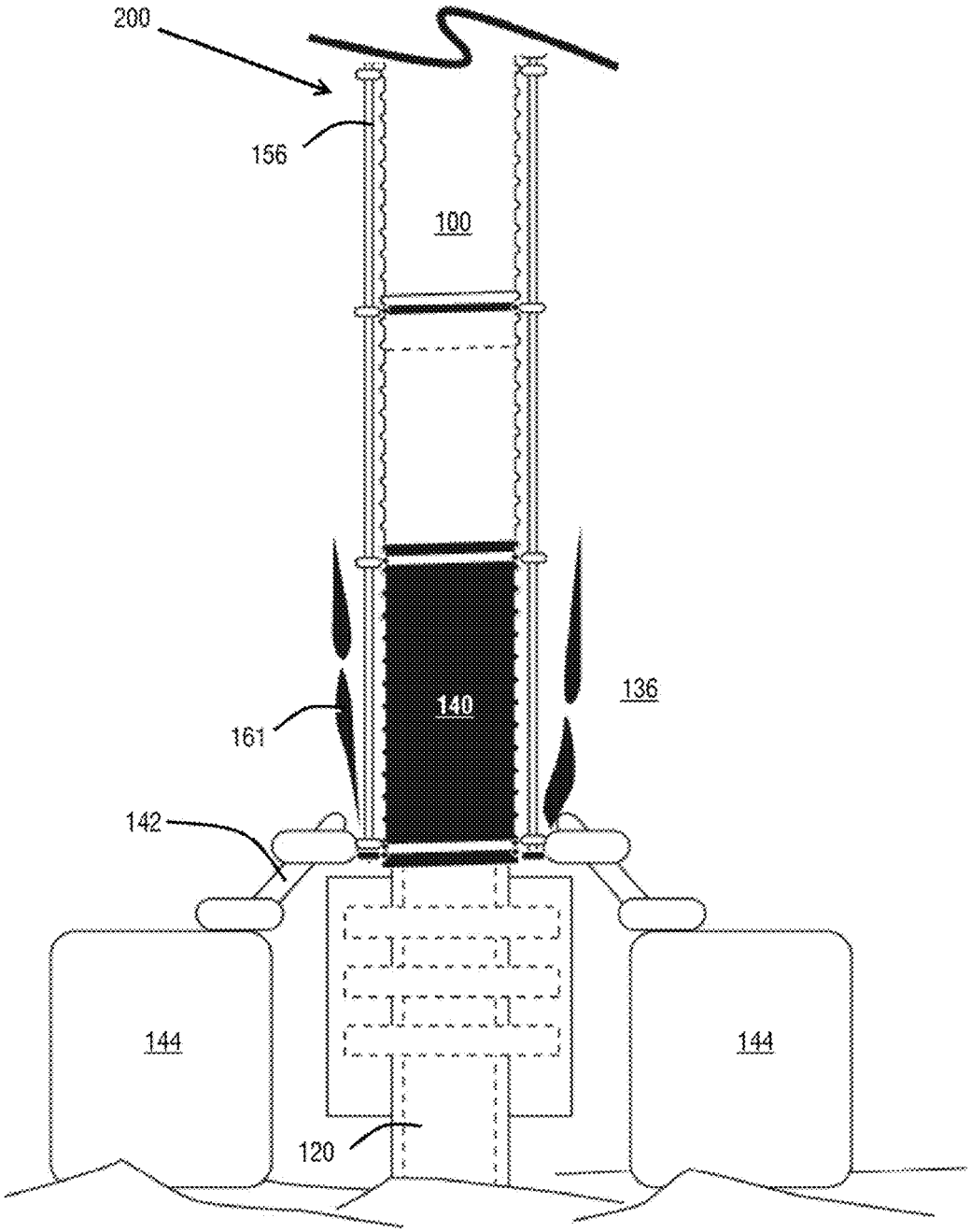
FIG. 4*b* depicts a frontal view of an embodiment of an instance of the HOS 200 and the I-RIS 140 that has been lowered completely or near completely over the wellhead pipe 120 opening 162.

FIG. 4*b* depicts a frontal view of an embodiment of an instance of the HOS 200 and the I-RIS 140 that has been lowered completely or near completely over the wellhead pipe 120 opening 162. In some instances, this would be done once the Fluid Product 160 is found to be relatively and measurably safely entering the I-RIS 140 and traveling to the sea surface 132 through the HOS 200, where the I-RIS 140 could then be lowered into place gradually in measurably increments determined to be safe and ideally without damaging the HOS 200.

As mentioned, an early deployment goal in some embodiments is to get the Fluid Products 160 channeling up to the sea surface 132 through the HOS 200, and less about trying to control any and all the RIS 100 units (and connections) from leaking and/or less about trying to capture all of the escaping Fluid Products 161 at the wellhead pipe 120 opening 162. Consequently, some Fluid Products 160 may need to be allowed to escape at the oil wellhead pipe 120 opening 162 initially, escaping Fluid Products 160 are sometimes referred to as an "escaping Fluid Product 161.

In a temporary deployment embodiment, where Fluid Products 160 may still be partially escaping Fluid Products 161, this still represents a substantially better scenario than allowing all the Fluid Product 160 to escape over time due to planning delays to try and reach perfection. On or around Jun. 13, 2010, for example, it appeared that the Gulf of Mexico Response Team tried to employ a riser that required a relatively tight fit to a rough wellhead pipe opening at the bottom of the sea. Further, it appeared that the Response Team's fears of trying to connect too quickly and potentially damage their system, caused numerous time delays, additional costs, and significant additional pollution, especially when compared to the amount of oil that was allowed to flow into the sea during the overall BP® Gulf of Mexico 2010 oil spill. (According to Newsweek, on Jun. 16, 2010, a team—bolstered by the personal involvement of Nobel Prize-winning Energy Secretary Steven Chu—used pressure readings and high-resolution video to make an estimate of 60,000 barrels a day that were escaping into the sea. See: http://www.newsweek.com/2010/06/16/a-history-of-incorrect-oil-spill-estimates.html).

In some embodiments there could be a means for constricting a collar and/or connection mechanism to and/or on the I-RIS 140 unit below the wellhead pipe 120 opening for a stronger fit/connection (more ahead). In addition, some embodiments of the I-RIS 140 would have both the outer membrane 108 and an inner membrane 112, thus creating a double membrane where hardening elements and/or fluids, such as cement could be infused into a cavity 110 between the double membrane walls forming a hardened seal at the bottom end of the I-RIS 140 unit, say below the wellhead pipe 120 opening 162 (the Cavity 110 is depicted later in a FIG. 18*a*).

FIG. 4*b* also depicts a tethering system attached to the HOS 200 at the I-RIS 140 whereby utilizing a plurality of tethers 142, the tethering system is connected to the anchoring system 144. The tethers 142 can be constructed of wide range of materials, such as steel cables, ropes, metal bars, chains, poured concrete with rebar, some combination, and the like. The tethers 142 should be strong enough to withstand the tension between the connected anchoring system 144 and the HOS 200 and in some embodiments, the tethers system could incorporate hydraulic arms that are attached to the anchoring system 144.

The anchoring system 144 ideally contains sufficient weight to counter any buoyancy in the HOS 200. The anchoring system 144 can be created from a wide range of materials, such as metals, concrete, some combination, and the like. The anchoring system 144 size and shape is not critical and it can be attached further up the height of the HOS 200 to help avoid any interference at the wellhead pipe 120 opening 162 and/or if the RIS Collar 180 is required near the bottom. Further, the anchoring system 144 and/or a component of the anchoring system (say an individual weight or anchor) does not have to rest on the seabed 134, where in some embodiments depicted ahead, components of the anchoring system hang along the HOS 200 and do not touch the seabed 134.

In some embodiments of the I-RIS 140 there is a flexible form-fitting skirt (not shown in FIG. 4*b*) that can be pulled down over the wellhead pipe 120 similar to a skirt to help prevent leakage. In another embodiment, similar to a RIS Collar 180 shown later in a FIG. 17*b*. While the flexible form-fitting skirt and/or the RIS collar 180 would likely cause additional pressure to build inside the HOS 200, a benefit of the HOS 200 and the STACCO 99 when compared to other systems and deployment methods, is that the pressure at the bottom of the HOS 200 is generally pushed through the HOS 200 to a relatively unrestricted and/or uncapped large opening at the sea surface 132; opposed to a relatively small riser and/or equipment that appeared to not be properly vented to withstand the enormous pressure in some of the early riser deployment attempts during the BP® Gulf of Mexico 2010 spill. Further, a series of branches 148 explained in FIG. 25*a-d* ahead could allow for additional and separate channels to flow to the sea surface 132, thus further reducing the pressure and improving the cleanup capturing quantities.

Figure 5A:
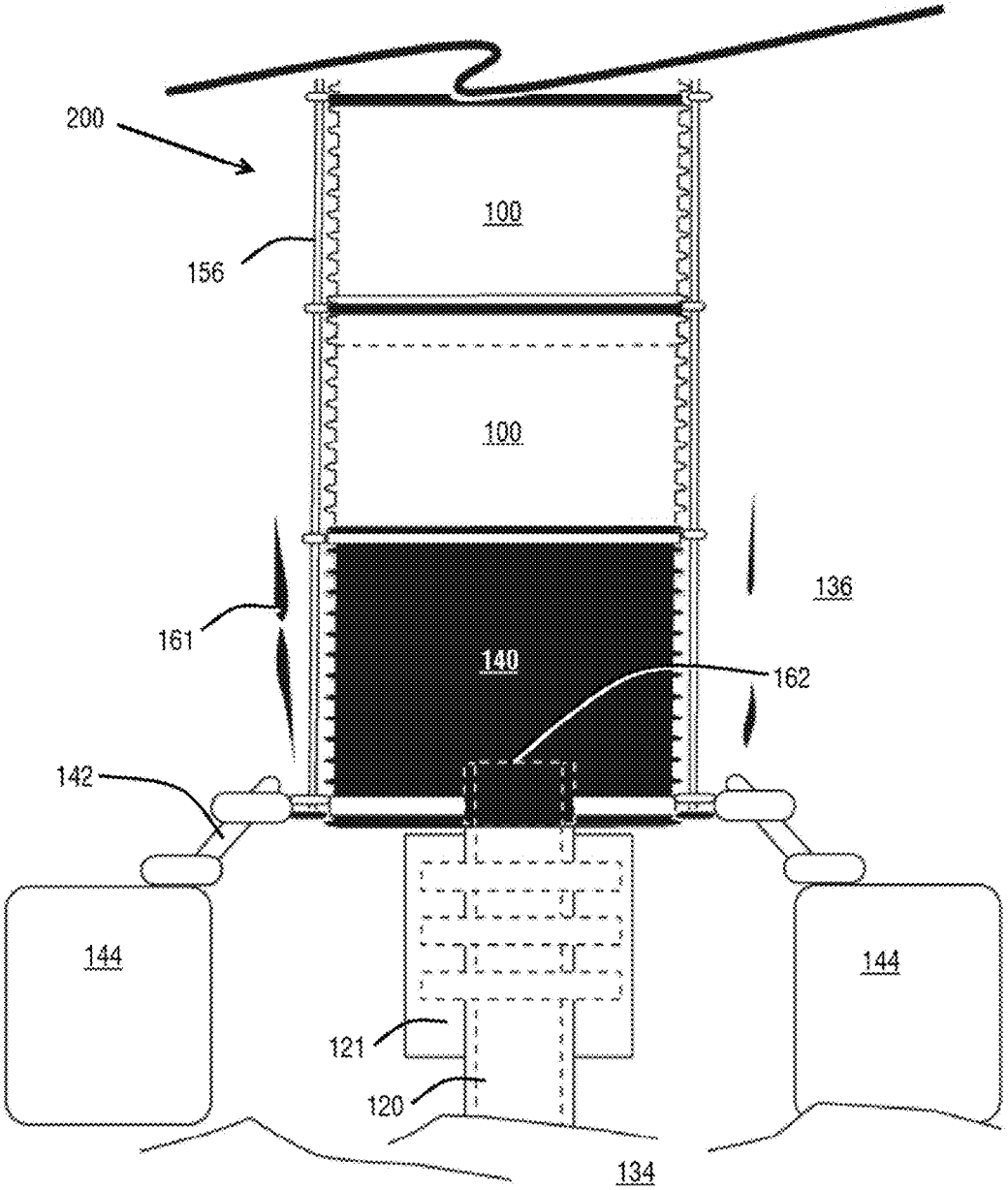
FIG. 5*a* depicts a frontal view an embodiment of an instance during the deployment of the lowering of the HOS 200 over the wellhead pipe 120 opening 162 near the seabed 134, but where the HOS 200 has a much larger diameter than the HOS 200 depicted in FIG. 4*a*.

FIG. 5*a* depicts a frontal view an embodiment of an instance during the deployment of the lowering of the HOS 200 over the wellhead pipe 120 opening 162 near the seabed 134, but where the HOS 200 has a much larger diameter than the HOS 200 depicted in FIG. 4*a*. Here the goal is more about surrounding the leak and less about creating a tight connection or fit at the wellhead pipe 120 opening 162. Here again the I-RIS 140, could be deployed and lowered with traditionally used underwater robotic submarines 700, divers (if not too deep), and the like; and would still need to be deployed relatively slowly, carefully, and measurably from above.

Figure 5B:
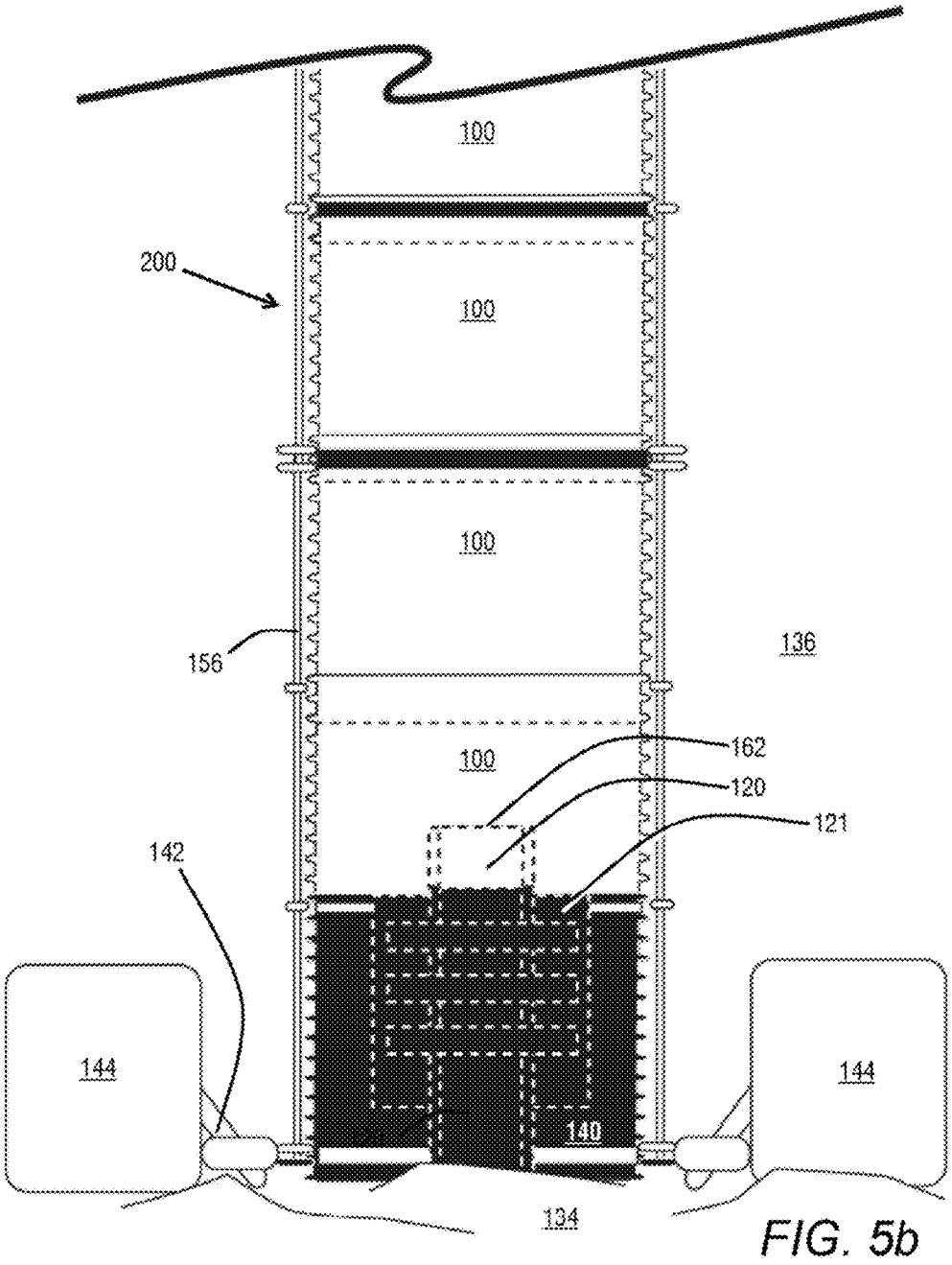
FIG. 5*b* depicts a frontal view of an embodiment of an instance of the HOS 200 and the I-RIS 140 that has been lowered completely over the wellhead pipe 120 opening 162 and a Blow Out Preventer 121 (hereinafter "BOP" 121).

FIG. 5*b* depicts a frontal view of an embodiment of an instance of the HOS 200 and the I-RIS 140 that has been lowered completely over the wellhead pipe 120 opening 162 and a Blow Out Preventer 121 (hereinafter "BOP" 121). Once the Fluid Product 160 is found to be relatively safely entering the I-RIS 140 and traveling to the sea surface 132 through the HOS 200, where the I-RIS 140 could then be lowered into place gradually in measurably increments determined to be safe and ideally without damaging the HOS 200.

In this embodiment the tethers 142 of the tether system 142 could have a means for lowering the HOS 200 that is attached to the anchoring system 144, by say the hydraulic arms that can rotate up/down, downward in this particular depiction. The hydraulic arms could allow for adjustments as needed over time, and ideally, where the control can be performed remotely. In this embodiment, the tether system would be motorized and with, say wireless transceiver with underwater communication capabilities (e.g. Very Low Frequency (VLF Band) to Low Frequency (LF) signals typically used in submarine type transmitters and communications), but could instead be connected via a power wire and a series of control wires that would run from the drillship 130 (e.g. a PC in a control room and power supply onboard the drillship 130) down the entire length of the HOS 200 to the tethering system 142 and anchoring system 144 to the hydraulic arms for power and control capabilities.

Figure 5C:
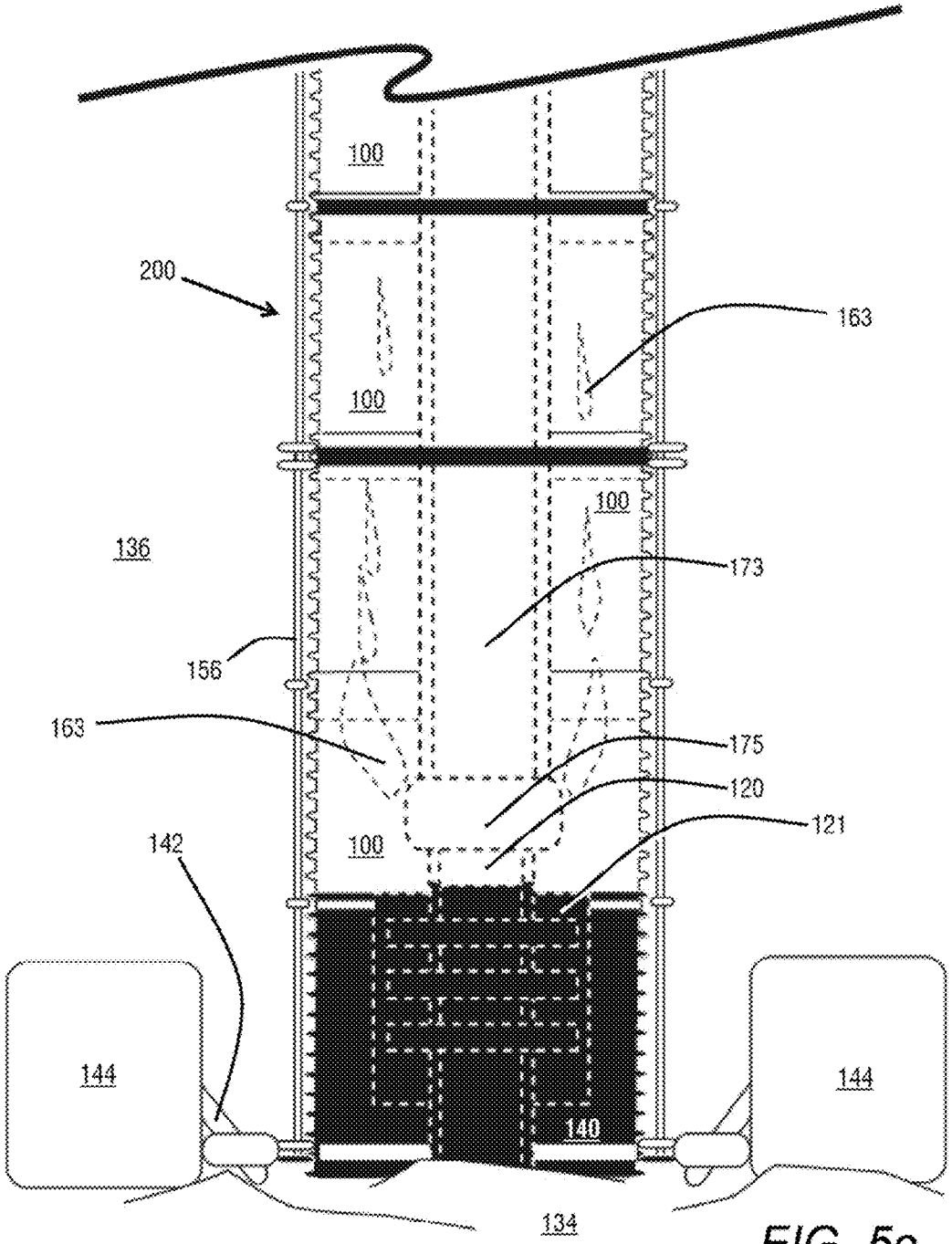
FIG. 5*c* depicts a frontal view of an overlapping deployment embodiment of the HOS 200 and the I-RIS 140 that has been lowered completely over the wellhead pipe 120 opening 162, the BOP 121 and an existing riser 173.

FIG. 5*c* depicts a frontal view of an overlapping deployment embodiment of the HOS 200 and the I-RIS 140 that has been lowered completely over the wellhead pipe 120 opening 162, the BOP 121 and an existing riser 173. The overlapping deployment is an embodiment where the STACCO 99 could be employed to work in conjunction and/or combination by overlapping and/or fitting the HOS 200 around the outside of the existing riser 173, say a particular industry style riser which was or could have been utilized by the Gulf of Mexico Response Team during the collection efforts back in May and June of 2010.

The overlapping deployment further captures Fluid Products 160 that otherwise would have escaped, herein referred to as an "inner riser escaping Fluid Products" 163, where the STACCO 99 is utilized similarly to the previous deployment and capturing descriptions provided above, to then channel the "inner riser escaping Fluid Product" 163 to the sea surface 132, and where again the "inner riser escaping Fluid Products 163" could then be temporarily pooled in the CB/CR 600/599 and pumped into the awaiting drillship(s) 130.

Some deployment embodiments, the HOS 200 can be built entirely above the sea surface 132 and lowered in one long section and/or a section at a time, downward. The HOS 200 would fill with the sea water 132, but the top could be kept in control above the sea surface 132. While in other deployment embodiments, the entire HOS 200, including the top could instead be allowed to sink and fill will with the sea water 136.

Figure 6B:
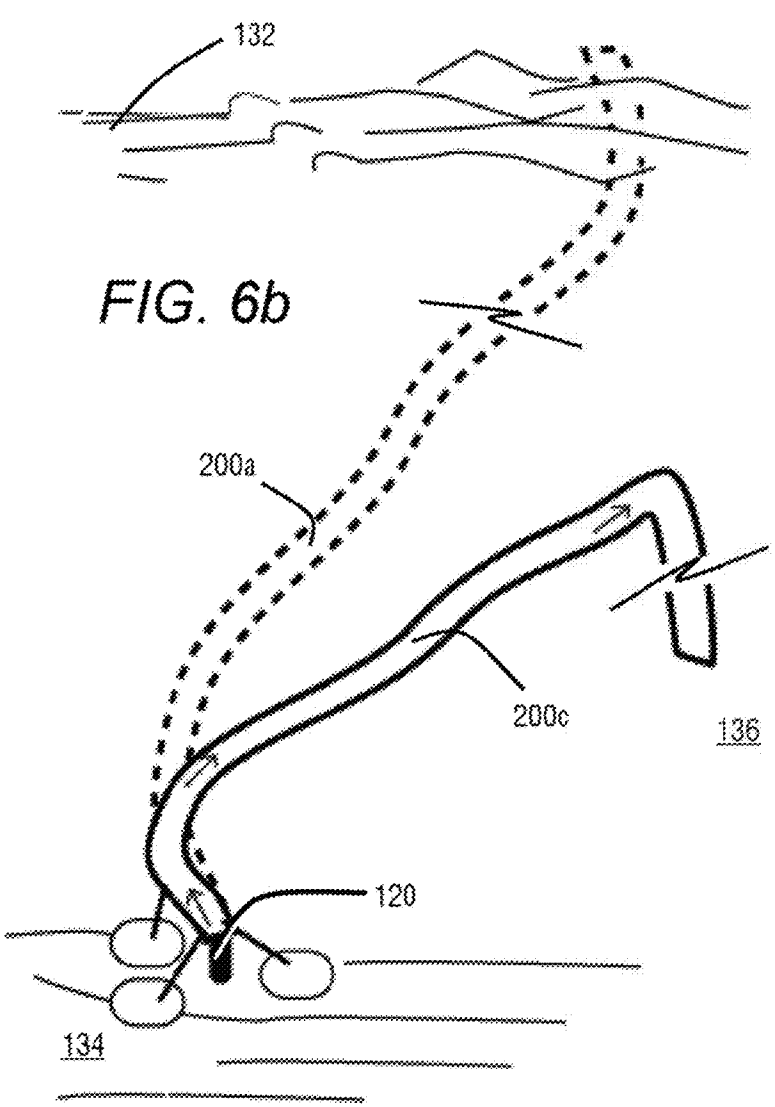
FIG. 6*b* depicts another truncated frontal view of a simple progression of instances, from the same deployment embodiment in FIG. 6*a* for the HOS 200 on its' pathway from the relatively limp posture 200*b* instance through, say a less limp posture 200*c* instance, onto the eventual relatively erect posture 200*a* instance.
Figure 6A:
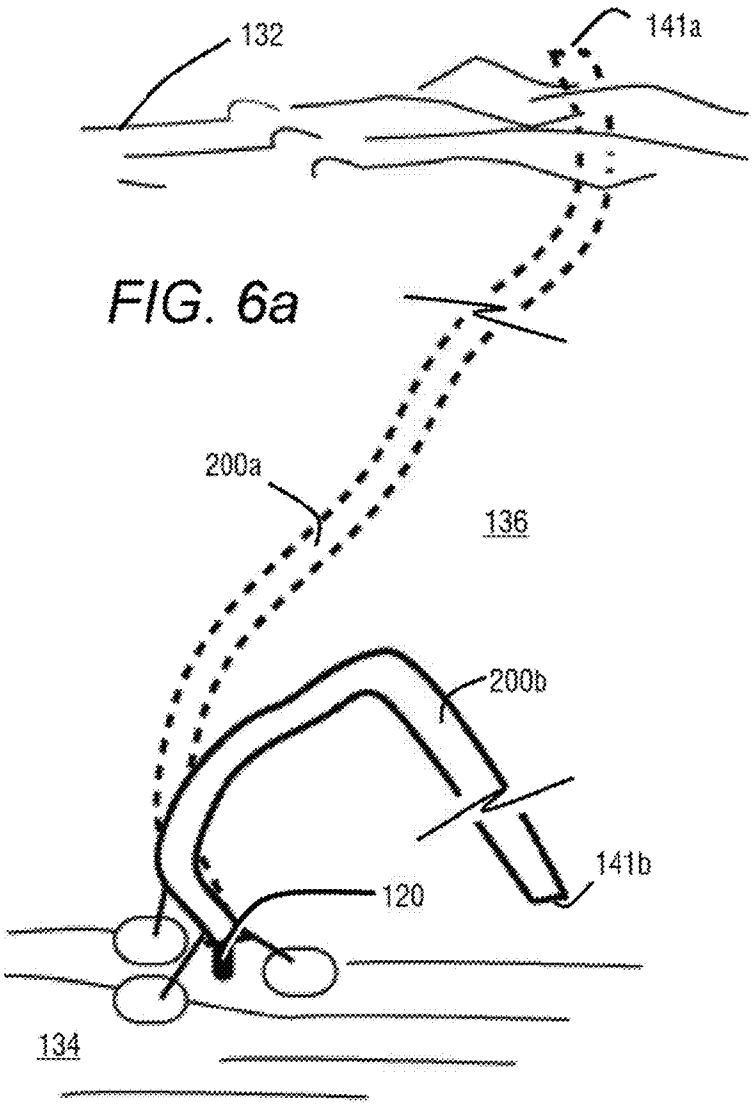
FIG. 6*a* depicts a truncated frontal view of a deployment embodiment of the STACCO 99 where the HOS 200 is forced from a relatively limp 200*b* posture with A STACCO End 141*b* (depicted near the seabed 134) is eventually forced upward to a relatively erect 200*a* posture (depicted by dotted-line) and where A STACCO End 141*a* (e.g. the RIS-E 141) of the HOS 200 opposite the wellhead pipe 120 opening 162 is now raised above the sea surface 132.

FIG. 6*a* depicts a truncated frontal view of a deployment embodiment of the STACCO 99 where the HOS 200 is forced from a relatively limp 200*b* posture with A STACCO End 141*b* (depicted near the seabed 134) is eventually forced upward to a relatively erect 200*a* posture (depicted by dotted-line) and where A STACCO End 141*a* (e.g. the RIS-E 141) of the HOS 200 opposite the wellhead pipe 120 opening 162 is now raised above the sea surface 132. This transition from the relatively limp posture 200*b* to relatively erect posture 200*a* can be caused in part by the pressure coming from the Fluid Product 160 out of the wellhead pipe 120 opening 162 which can also help force the HOS 200 to become relatively kink-free and/or less constricted for the flow of Fluid Products 160.

FIG. 6*b* depicts another truncated frontal view of a simple progression of instances, from the same deployment embodiment in FIG. 6*a* for the HOS 200 on its' pathway from the relatively limp posture 200*b* instance through, say a less limp posture 200*c* instance, onto the eventual relatively erect posture 200*a* instance. The nature pressure and tendency from the Fluid Products 160 to want to make their way from beneath the earth to the sea surface 132 helps straighten out the flexible hose/channel and for the eventual better flow of the Fluid Product 160 to the CR 599 at the sea surface 132.

When the Fluid Product 160 is, say a petroleum-based product such as oil, oil has a density that is much less per cubic meter than either sea water or fresh water. For example, sea water has a density around 1015 Kg/cubic meters and where a particular oil product may have a density of 800 kg/cubic meters, meaning the particular oil product is less dense and would naturally seek the sea surface 132 when unobstructed. In fact, even if partially unobstructed, the relatively less dense Fluid Product 160 will generally rush and force-its-way to the sea surface 132. Consequently, the HOS 200 in this deployment embodiment needs to be constructed of materials and in such a manner that will allow for this type of rapid pressure forced through the HOS 200.

Figure 6C:
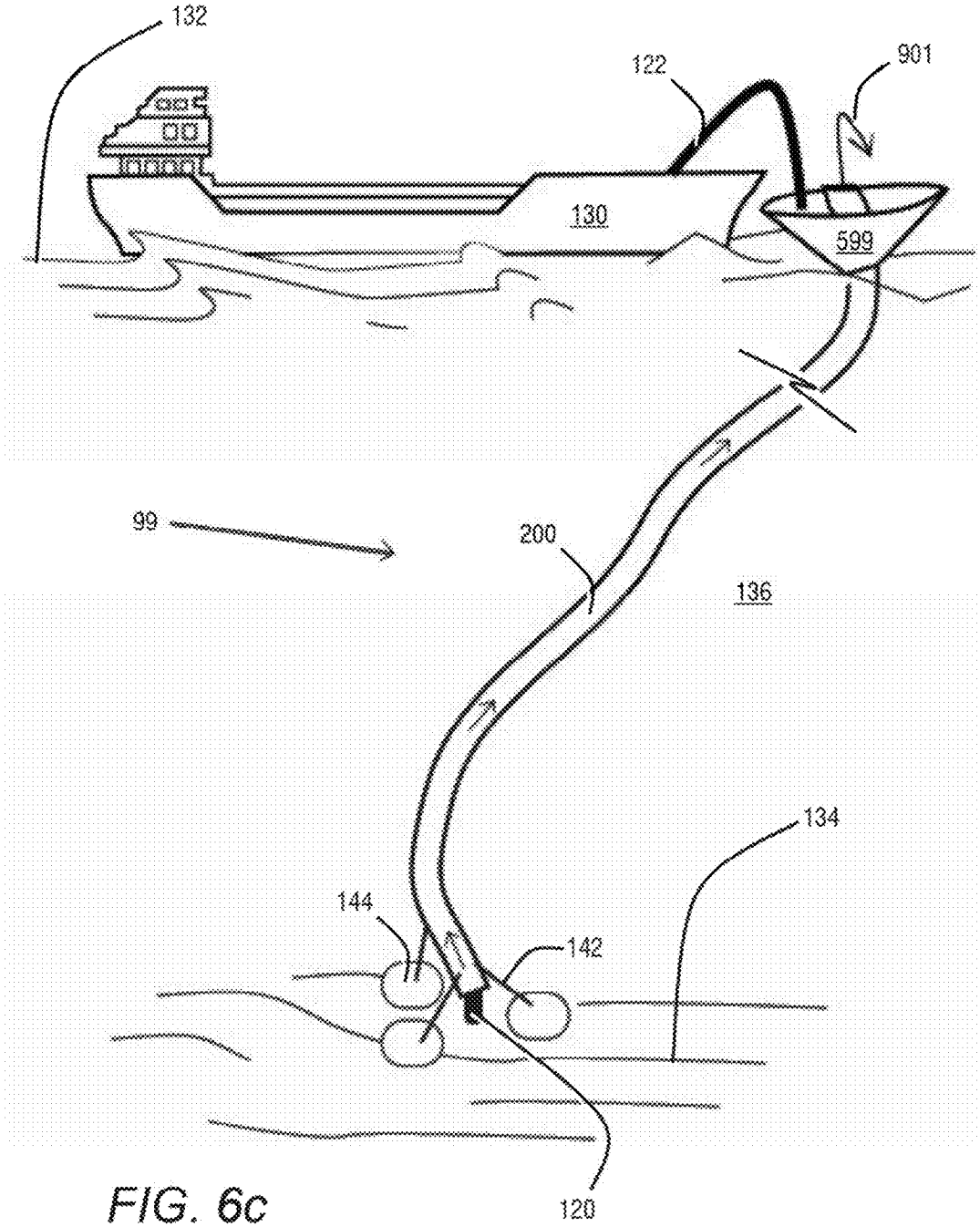
FIG. 6*c* depicts a truncated frontal view of an embodiment of the STACCO 99 from the seabed 134 to the sea surface 132.

FIG. 6*c* depicts a truncated frontal view of an embodiment of the STACCO 99 from the seabed 134 to the sea surface 132. This embodiment creates a system and a method to channel and transport the Fluid Product(s) 160 (e.g. oil, gas, and the like) leaving the wellhead pipe 120 opening 162 to travel upward through the HOS 200 and into the CR 599, typically at the sea surface 132. The actual wellhead pipe 120 "opening" 162 is hidden under/by the HOS 200 in this depiction here in FIG. 6*c*. The opening 162 may simply be the cut opening at the upper end of the wellhead pipe 120 or an opening from a hole/leak on or along the wellhead pipe 120 (more ahead).

In this embodiment, the HOS 200 is typically deployed from the drillship 130 at the sea surface 132 to the seabed 134 (or wherever the wellhead pipe 120 opening 162 is located). In this embodiment, during the initial descent of the HOS 200 to the seabed 134, sea waters 136 would naturally come inside the HOS 200, but ideally there would be little to nothing else besides the sea water 136 inside the HOS 200 to restrict and/or impede the flow of the Fluid Products 160 from the wellhead pipe opening to the opposite end of the HOS 200 at the sea's surface 132.

The HOS 200 could be properly calculated and prepared so that it is measurably constructed long enough, where one end of the HOS 200 remains at the sea surface 132, while the other end reaches the wellhead pipe 120 opening 162 where the Fluid Products 160 will-be/are being forced through the HOS 200 hose. In this embodiment, the Fluid Products 160 should then exit the HOS 200 above the sea surface 132 and overflow-to or return (depicted by an arrow 901) back to the CR 599 outside the HOS 200 hose.

Figure 37:
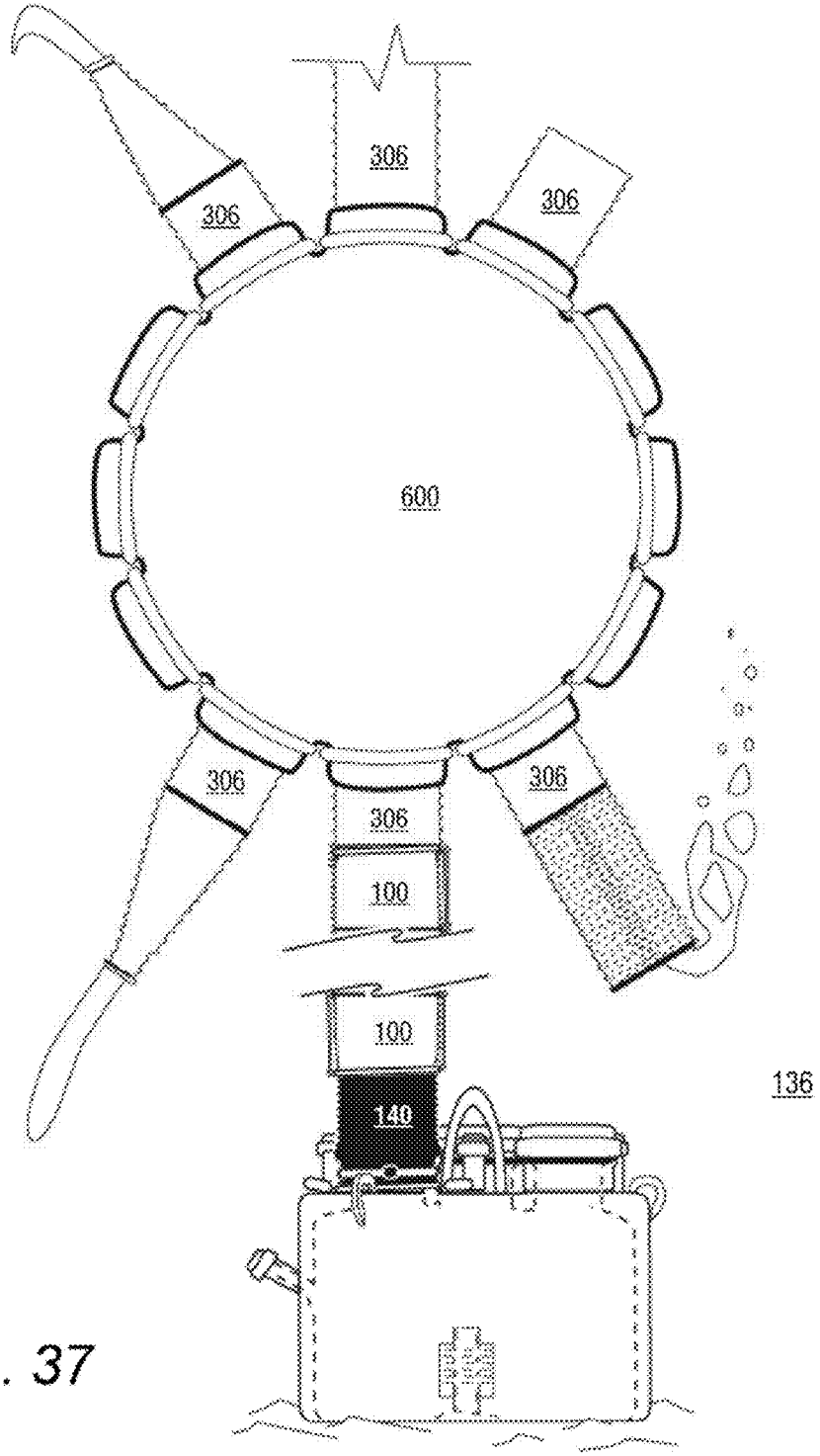
FIG. 37 depicts a frontal truncated view of an embodiment of after attaching the HOS 200 over the STH 203 near the seabed 134.
Figure 38:
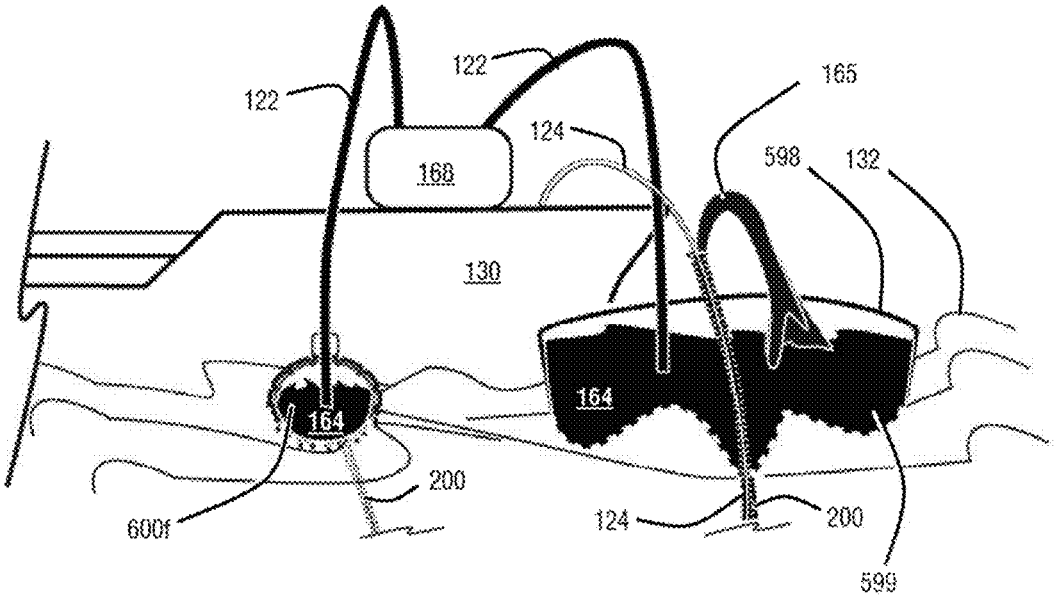
Figure 38:
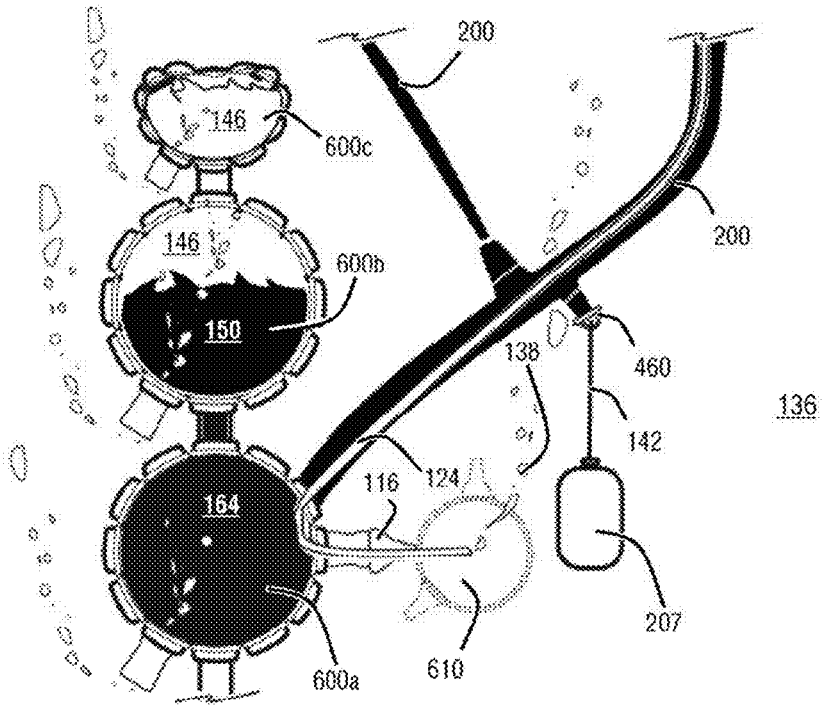

The CR 599 (as depicted in FIGS. 1*a* and 6*c*) ideally pools the Fluid Products 160 and helps prevent the Fluid Products 160 from freely entering the sea waters 136 itself (more details on the CR 599 ahead in FIGS. 38-40). The CR 599 pools the Fluid Products 160 that come through the HOS 200 hose which are then pumped and/or vacuumed by the drillship(s) 130 and/or the like. There are other embodiments for collecting the Fluid Products near or below the sea surface (explained more ahead in FIGS. 26-29 and 36-38).

Initially some of the Fluid Product 160 may continue to escape into the sea in this embodiment, but the ability to deploy the STACCO 99 quicker and sooner means that any of the Fluid Products 160 that does get captured may have otherwise been allowed to simply escape into the open sea. Further, over time the STACCO 99 can be monitored and adjusted through a number of means to improve and increase the amount of the Fluid Products 160 being captured by the STACCO 99.

Note that for Figures that show the full STACCO 99 system or a frontal view from the seabed 134 to the sea surface 132, items depicted therein may be not be to scale, but are meant to illustrate the components and relative location. For example, the distance from the seabed 134 to the sea surface 132 would obviously be substantially longer/taller that is depicted in say FIGS. 1, 6*a*-*c*, later in FIGS. 38, 39, and the like, thus the truncations. In addition, the scale of items at the sea surface 132 within these figures may not correspond is size and scale to items that are depicted below the sea surface 132.

Figure 7:
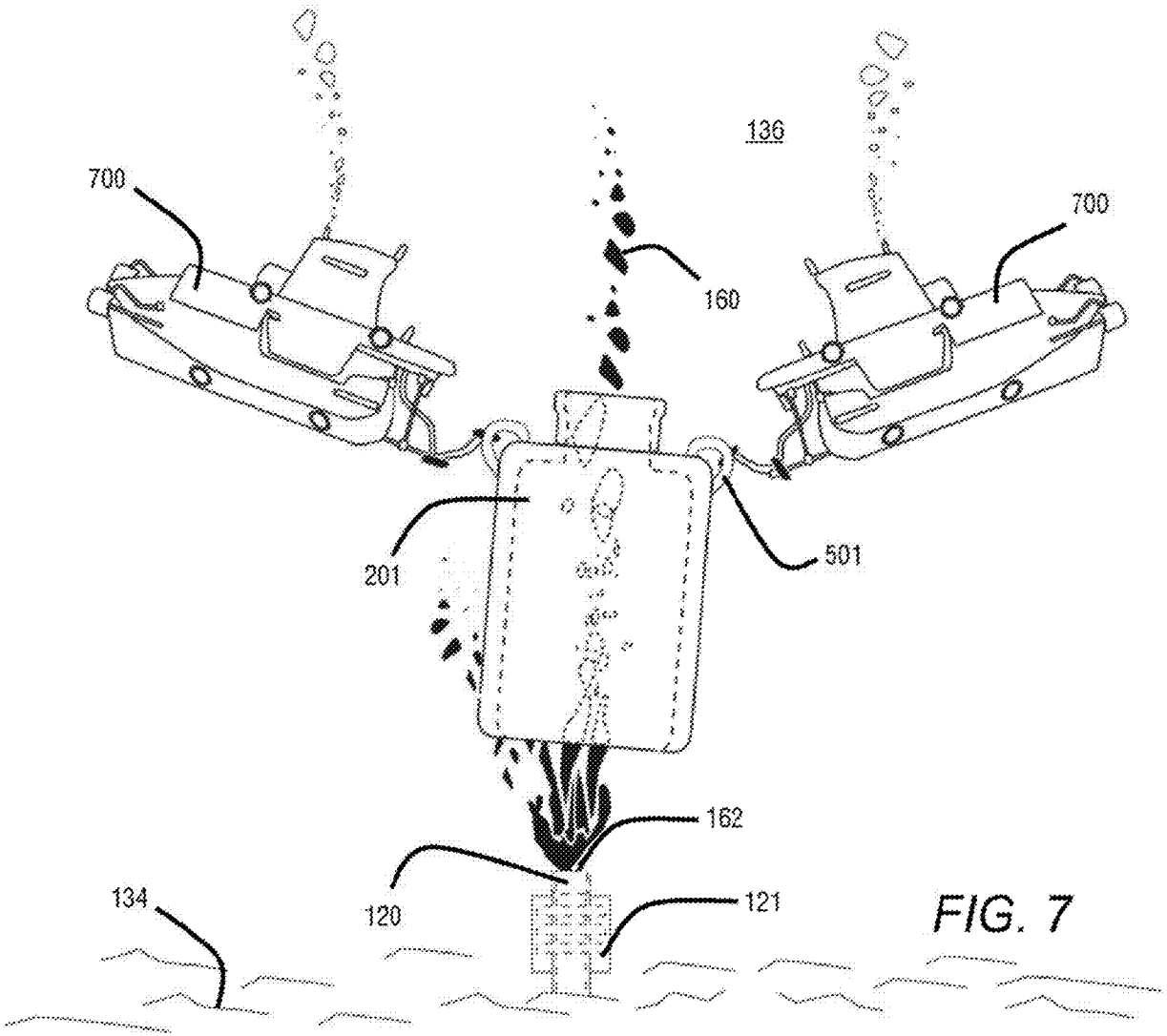
FIG. 7 is a frontal view depicting an embodiment of the deployment of a special unit referred to as a "Special Top Hat" 201 (Hereinafter "STH" 201) that can be placed over the wellhead pipe 120 opening 162 and the BOP 121 at or near the seabed 134 by a pair of the robotic submarines 700.

FIG. 7 is a frontal view depicting an embodiment of the deployment of a special unit referred to as a "Special Top Hat" 201 (Hereinafter "STH" 201) that can be placed over the wellhead pipe 120 opening 162 and the BOP 121 at or near the seabed 134 by a pair of the robotic submarines 700.

In this embodiment the STH 201 would be submerged from, say the drillship 130 at the sea surface 132, maneuvered, and placed over the wellhead pipe 120 opening 162, presumably near the seabed 134. The STH 201 can be made of heavy steel and could incorporate concrete around rebar support materials, with a plurality of preformed handles 501 to temporarily connect and better maneuver over the wellhead pipe 120 opening 162, say, via the robotic submarines 700.

Figure 8:
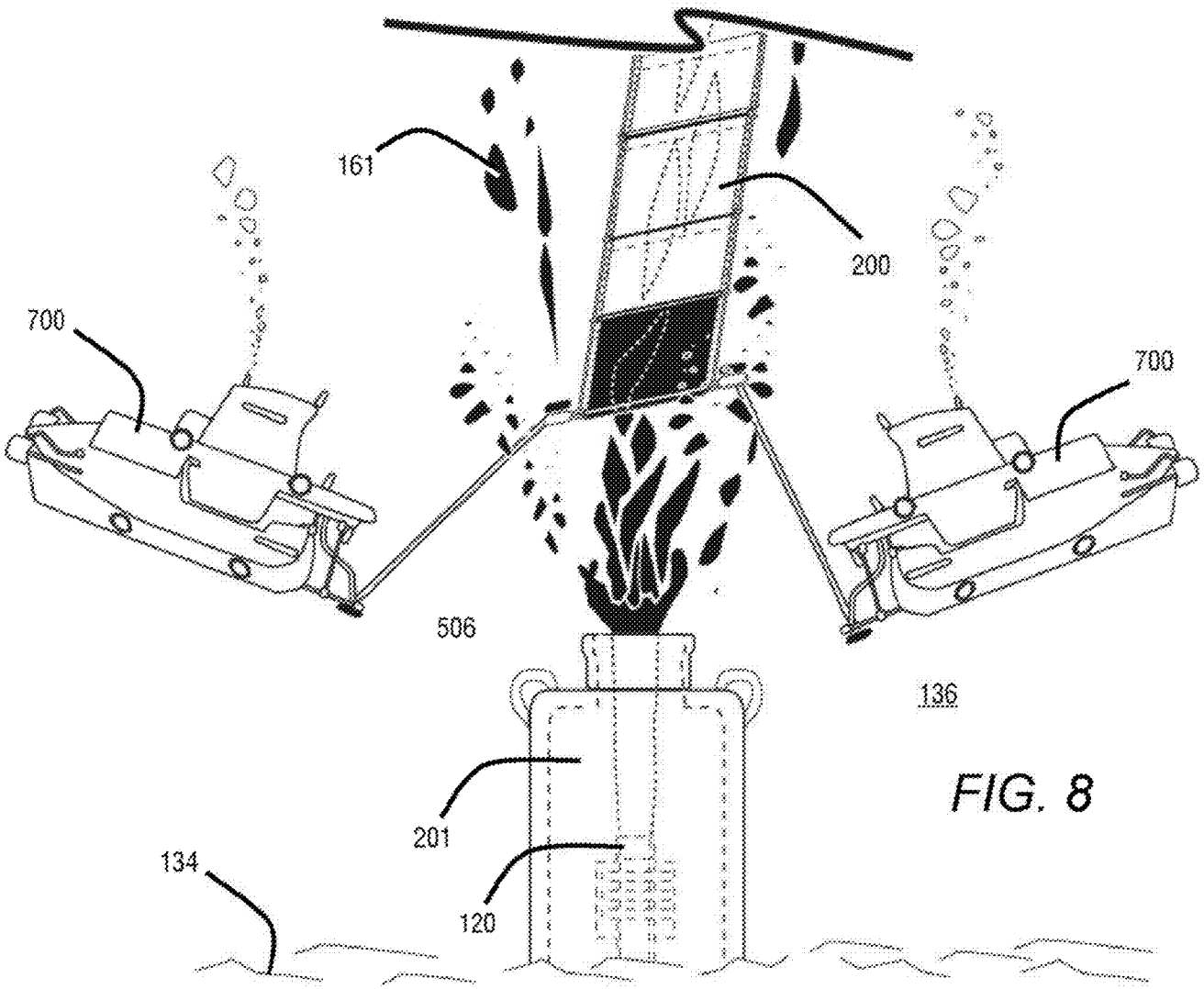
FIG. 8 depicts a frontal view of a deployment instance during a subsequent lowering of the HOS 200 over the STH 201 near the seabed 134 by the pair of robotic submarines 700 before attaching to the STH 201.

FIG. 8 depicts a frontal view of a deployment instance during a subsequent lowering of the HOS 200 over the STH 201 near the seabed 134 by the pair of robotic submarines 700 before attaching to the STH 201. In this embodiment, the STH 201 would have an open bottom that sits on the seabed 134 and would ideally be constructed heavy enough to sink into the sand and create a chamber that will allow the STACCO 99 to relatively limit the escaping Fluid Products 161 once the HOS 200 is mounted on top. In other embodiments, the STH 201 would be constructed and/or deployed in a manner to allow for an uneven seabed 134 and/or other potential obstacles (not shown).

Some embodiments of the STACCO 99 include the STH 201 and the CR 599, but neither are absolutely required. Further, when the STH 201 and the CR 599 are connected to the HOS 200 there are separate components, and not a component of the HOS 200 which is a separate entity. On the other hand, when the CB 600 is connected to the HOS 200, it is a component of the HOS 200, unless it becomes detached. In addition, a single STACCO 99 deployment embodiment can have a plurality of STH 201s, a plurality of CR 599s, a plurality of CB 600s, and a plurality of HOS 200s that may or may not be all interconnected.

Figure 9A:
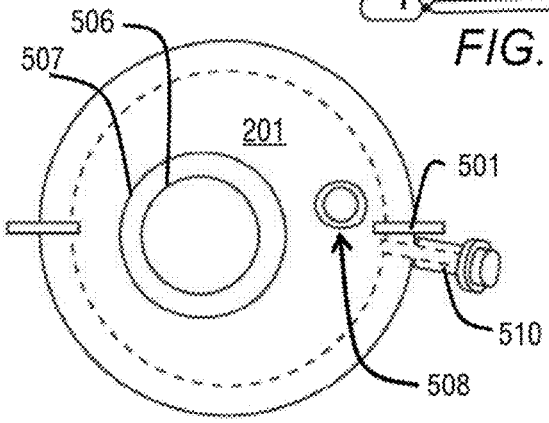
FIG. 9*a* depicts a top view of an embodiment of the STH 201.

FIG. 9*a* depicts a top view of an embodiment of the STH 201. A key to constructing the STH 201 in this embodiment is to not make a top STH opening 506 too small where the STH 201 thus becomes buoyant, as happen with the Gulf of Mexico Response Team's June 2010 efforts; where the relatively constricted opening at the top of the Response Team's Top Hat caused methane hydrate crystals to form and thus caused a clog. The Response Team's Top Hat clog not only prevented the flow of Fluid Products, but it caused the Response Team's Top Hat to become buoyant. Whereas in this embodiment of the invention, the STH 201 would have a relatively significant-sized opening for the top STH opening 506 (typically with an inside diameter relatively larger than opening of the wellhead pipe 120 opening 162 being covered/engulfed). The STH 201 has a rim with a STH lip 507 that ideally is specially developed and constructed to be best-suited for accepting a range of potential connections methods to the HOS 200 (e.g. via the I-RIS 140 and a collar explained ahead).

Figure 9B:
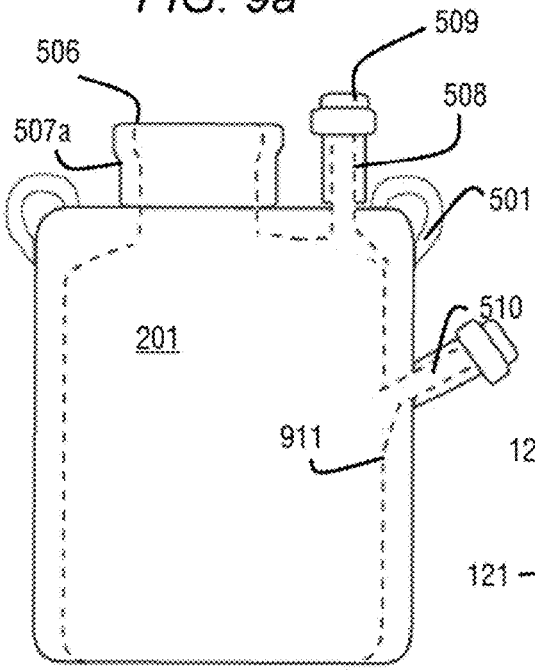
FIG. 9*b* depicts a frontal view of an embodiment of the STH 201 that also helps depict the hollow interior cavity with a dotted line 911.

FIG. 9*b* depicts a frontal view of an embodiment of the STH 201 that also helps depict the hollow interior cavity with a dotted line 911. The preformed handles 501 allow the STH 201 to be connected and/or tethered to, say the robotic submarines 700 and maneuvered as needed. A STH side vent 510 and a STH top vent 508 each with a vent cap 509 can be used for a variety of functions and there can be a plurality of each.

For instance the STH top vent 508 could instead be uncapped during the connection of the I-RIS 140 to help reduce the pressure and allow some of the pressure to escape through the STH top vent 508. In addition, the STH top vent 508 could be fitted with a hose and a filtration system for filtering and/or venting out selected items, say air and/or sea water 136. Further, a vacuum could be fitted to the STH top vent 508 to improve the seal, pressures, and/or other conditions inside the STH 201. In addition, the vacuum attached to the STH top vent 508 could be used to remove potential clogging items, such as sediments, seaweed, methane hydrate crystals, tar, and the like.

The STH side vent 510 could be used for the same functions as the STH top vent (s) 508, and/or could be connected to a system that pumps in/out the STH 201 and/or works in combination with the STH top vent 508 to circulate, say sea water through the STH 201 via a pump system. In addition, the STH top vent 508 could be setup for releasing pressure, while the STH side vent 510 could be setup for increasing pressure via the pump system (more ahead).

Figure 10A:
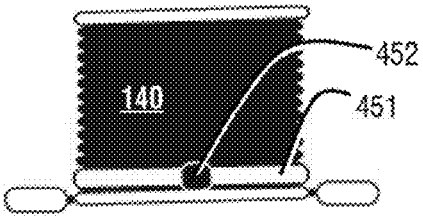
FIG. 10*a* depicts a frontal view of an embodiment of the I-RIS 140 in the fully compressed state.

FIG. 10*a* depicts a frontal view of an embodiment of the I-RIS 140 in the fully compressed state. This fully compressed state allows the I-RIS 140 units to be stored, say upon the drillship in a manner that conserves space and helps protect the I-RIS 140 unit from damage, and the like. An I-RIS Collar 451 along with a I-RIS Collar Lock 452 are for tightening the I-RIS Collar 451 and it's connection around say the wellhead pipe 120 or the top of the STH 201 (e.g. depending on the deployment embodiment).

Figure 10B:
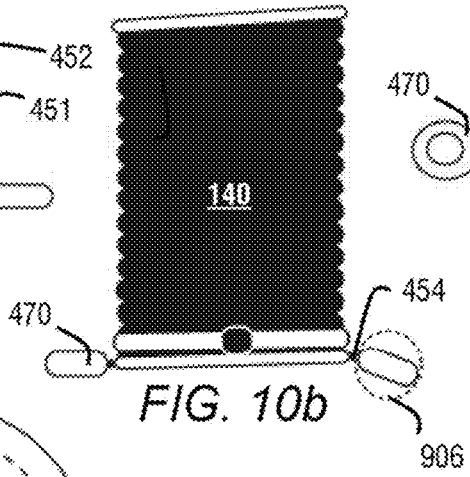
FIG. 10*b* depicts a frontal view of the same I-RIS 140 embodiment, but in a relatively uncompressed state.

FIG. 10*b* depicts a frontal view of the same I-RIS 140 embodiment, but in a relatively uncompressed state. A I-RIS Loop 470 is typically connected to the I-RIS 140 via a I-RIS hinge 454 allowing the I-RIS Loop 470 to rotate (along the dotted line depicted 906). The I-RIS Loop 470 ideally has an extra strength connection to the I-RIS hinge 454 that is sufficient for deploying a relatively large and long series of RIS 100 units in the HOS 200 that will naturally encounter resistance in the seawater 136. In an embodiment, the I-RIS hinge 454 could be a ball and socket type joint with a relative wide range of rotation capabilities and in multiple directions. In another embodiment, the I-RIS hinge 454 could intentionally have limited rotation, thus causing the connected I-RIS Loop 470 to protrude outward in manner that is easier to connect with underwater.

Figure 10C:
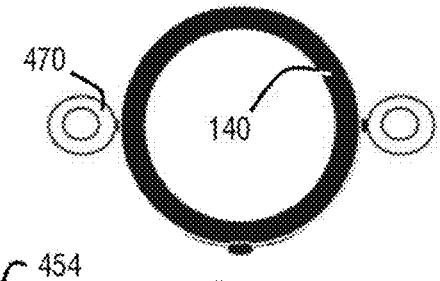
FIG. 10*c* is a top or bottom view of the same I-RIS 140 embodiment depicting the pair of I-RIS Loops 470 from above.

FIG. 10*c* is a top or bottom view of the same I-RIS 140 embodiment depicting the pair of I-RIS Loops 470 from above. The I-RIS 140 is typically constructed of much stronger materials than a typical RIS 100 unit and can be coated with, say the heavy rubber or rubber-like materials that are flexible and relatively more resistant to damage from the high pressure of the Fluid Product 160 closer to the wellhead 120 opening 162. Further, the inner structural coil could be greatly enforced as well. In addition, there could be a series of the I-RIS 140 connected together as in an I-RIS-1, an I-RIS-2, and so on, since theses I-RIS 140 units are typically stronger and the first RIS units to come in contact with the enormous pressures at or near wellhead pipe 120 opening 162. In some embodiment, the I-RIS 140 may not have the inner structural coil 102.

Figure 10D:
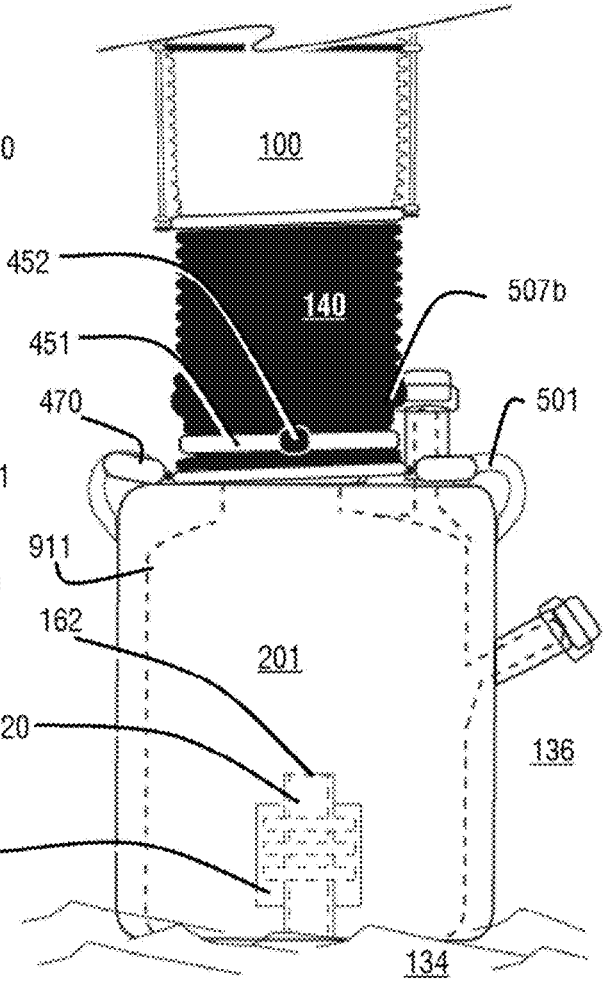
FIG. 10*d* depicts a frontal view of an embodiment of the STH 201 with the hollow interior cavity denoted with the dotted line 911, and also includes a dotted line depiction of the wellhead pipe 120, the wellhead pipe opening 162, the BOP 121, and a truncated section of the HOS 200 with the RIS 100 unit interconnected with the I-RIS 140 on the end of the HOS 200 and the I-RIS 140 connected to the STH 201.

FIG. 10*d* depicts a frontal view of an embodiment of the STH 201 with the hollow interior cavity denoted with the dotted line 911, and also includes a dotted line depiction of the wellhead pipe 120, the wellhead pipe opening 162, the BOP 121, and a truncated section of the HOS 200 with the RIS 100 unit interconnected with the I-RIS 140 on the end of the HOS 200 and the I-RIS 140 connected to the STH 201. The I-RIS 140 has a visible bulge depicted by a 507*b* where the I-RIS 140 is relatively able to form fit around the STH lip 507*a* underneath (as from FIG. 9*b*). The I-RIS Collar 451 has been tightened and secured with the I-RIS Collar Lock 452.

In some deployment embodiments, the HOS 200 could be fitted with a plurality of I-RISs 140 where each is, say designed with different attachment methods and/or mechanism and each could be arranged consecutively as a series at the end, say prioritized by the methods and/or mechanisms considered, say mostly like to perform best to least likely or vice versa. If a particular RIS 140, say an I-RIS-1 that is first attempted, happens to either fail to attach well, perform as planned, and/or fails or becomes damaged due to some other purposes, that particular I-RIS-1 could be disconnected or cut away from the remaining HOS 200. On the other hand, that I-RIS-1 could remain attached while another type of the I-RIS in the series, say an I-RIS-2 was attached and attempted. This preparation of a collection of subsequent I-RISs 140 in the series could either be done in at the sea surface 132 beforehand, in parallel with entirely different HOSs 200; and/or wherever ideal, to minimize delays in subsequent efforts following a failed attachment method.

In some embodiments, ideally, the removal of a particular I-RIS 140 could be done while still maintaining some relative flow of the Fluid Products 160 up through the HOS 200, assuming it is possibly to either leave a previously failed I-RIS 140 unit within the series; or compress the previously failed I-RIS 140 sufficiently to remove it, or cut the previously failed I-RIS out or away, and/or to bring in another subsequent I-RIS-2, in waiting from below the wellhead pipe 120 opening 162. For instance, the I-RIS-2 could have been placed in that position in advance of the failed I-RIS 140. This plurality of subsequent and parallel methods; and mechanism is something that appeared to not be considered or a least not successfully executed during the Gulf of Mexico Response Team's 2010 chain of failed attempts. In some embodiment, there can be a plurality of I-RIS 140 employed simultaneously with a particular STH with multiple openings explained ahead in FIGS. 30 and 31.

A benefit of the relatively lightweight and flexible material and construction of the HOS 200 when compared to the rigid and heavy riser pipes currently employed in the industry is that the HOS 200 material would also be far easier to cutaway than compared to the expensive special saws and saw blades required to cut other riser materials at that sea depth. During the BP® Gulf of Mexico 2010 spill, there was a significant amount of time delay as a special saw and saw blade needed to be employed to try and make a relatively clean cut of the damaged wellhead pipe end/opening. This cutting effort needed to be done by robotic submarines, caused delays, and ran into a series of problems, where the blade got stuck and damaged.

Once a particular I-RIS 140 has been secured around the STH 201, there can be a number of methods to tighten and secured the connection with the I-RIS Collar Lock 452 and the I-RIS Collar 451. The I-RIS Collar Lock 452 can be tightened with tools and/or via a robotic sub arm 702 attached and controllable through the robotic submarine 700, and/or designed to be relatively tool-free, where say some amount of torque applied and/or tension applied to, say the I-RIS Collar 451 would engage and/or disengage the I-RIS Collar Lock 452

In an embodiment of the I-RIS Collar Lock 452, the I-RIS Collar Lock 452 has an embedded mechanism, power, and a VLF-ID 14 and/or a RFID 16 where each has a particular LVP, and a RF signal and/or similar that can be sent to each uniquely Identified I-RIS Collar Lock via, say a unique ID that incorporates a GUID (Global Unique Identifier) as the unique ID or a portion of the unique ID. Further, where the particular RF signal for the uniquely ID'd I-RIS Collar Lock triggers a means for constricting or relaxing the tension on the I-RIS Collar 451. The means for constricting or relaxing the tension could be accomplished with, say a threaded mechanism. In some embodiments, the threaded mechanism could be flexible, allowing it to constrict or relax the tension while relatively bent.

The power source for turning the mechanism could be stored locally within the Collar Lock 452 and/or remotely. In an embodiment, the power could come from a range of means, and/or a combination of means, such as batteries, rechargeable batteries, say from power collected from sea currents, rechargeable batteries from solar power collected at the sea surface and/or some other power source that are, say than transmitted as low power back to the I-RIS Collar Lock and the like, along an embedded conduit and/or wire within the STACCO 99 and/or HOS 200. The power, replacement batteries, and power charges could also be supplied by the robotic submarine 700.

In addition, the I-RIS Collar 451 and/or I-RIS Collar Lock could have the sensors 18 that gauge data on a number of conditions, such as the pressure on the I-RIS Collar 451, the flow of Fluid Products inside the I-RIS 140, and/or the pressure on the inside and/or the outside of the I-RIS 140. These sensors 18 could be set to work in conjunction with outside collected communication signals (e.g. VLF band), in lieu of outside communication signals, and/or to override communication signals. Further, these sensors 18 could be setup to be reprogrammed remotely. Furthermore, the sensors 18 could be setup to work in tandem with a range of other sensors 18 and I-RIS Collar Locks 452 with sensors 18. These capabilities would allow the connection(s) to self regulate each independent connection and connection strength.

In addition, each separate and independent part along the STACCO 99 and the HOS 200 could have similar unique ID, mechanism, power supply, and sensors 18. Further, there could also be a means of floatation attached (not shown) to each separate part where if any particular part became a loose part from the STACCO 99 for any reason, it would ideally float to the sea surface 132. In some embodiments, the means of floatation may be triggered by the sensor 18 that recognizes the particular parts disconnection, say from a significant historical change in location. Further, where the attached means of floatation has a canister with a compressed air capability that now fills and creates a floating balloon-like element where the loose part rises to the sea surface 132. The loose part now floating on the sea surface 132 could emit a beacon distress signal for collection. Further, with the loose part's unique ID, there is a way to know exactly where the loose part originally came from along the STACCO 99 and/or along the HOS 200.

Further there could be an embodiment with a computer-implemented system and method to collect data and/or monitor all the parts and loose parts with either the RFID 16, a VLF-ID 14 (which functionally work similarly to the RFID 16, but at a different frequency), some combination; and/or similar; in real-time for being in a proper location, where a present location is relative to an earlier location (a historic comparison), the pressure inside and/or outside the HOS 200 at that particular location. The location as measured by either an absolute x, y, and z coordinate based upon preset origin; a relative x, y, and z coordinate based upon a previous coordinate; a GPS coordinate system along measurable sea depths; a marine-like coordinate system say with Bathymetic Mapping coordinates; some combination; and/or the like.

In locations where the parts may be relatively too far away, say too deep in the sea, for real-time and/or near real-time communications, the data for each part could store data over time on the part itself and send that data when a communication connection link is made later. In some embodiments, the data may be transferred to a transceiver at a data receiving station aboard, say the drillship 130 up through a connection created by a communication wire along the STACCO 99 or the HOS 200 itself. In addition, some data could be transferred, collected, and/or communicated via the robotic submarines 700.

The computer-implemented system and methods may be implemented by a combination of hardware, software, and/or firmware, in various applications or may include a computer. The computer may be configured by a computer readable medium or program code to provide functionality. The program instructions may be those designed for the purposes of the present embodiment.

FIG. 41 of the accompanying drawings illustrates a general overview of an information exchange, tracking and retrieval client-server network 2 (sometimes simply referred to as the "client-server network 2) in which the embodiment may be implemented, including a variety of components that communicate over a private network 6, preferably a private Intranet 137 per one embodiment, but could also be a public Internet in another embodiment, and/or a combination. The information exchange, tracking and retrieval client-server network 2 includes a client system 4 and a tracking and search system 8.

The client system 4, using Uniform Resource Locators (URL), accesses web servers through, in one embodiment, over a local area network (LAN), wireless area network (WAN), WiMax network, Cellular network, Bluetooth network, NearField Radio (NFR) network, Very Low Frequency (VLF) network, or an internet service provider (ISP). The client system 4 in one embodiment may include a desktop computer, a personal digital assistant or cell phone, or generally, any device that includes a graphical user interface (GUI) and/or a voice response unit (VRU) and can access a network. The client system 4 typically includes one or more processors, memories and input/output devices. Typically the client 4 also includes a mouse, touch screen, keyboard, or other technological improvements therein, to effectuate a selection by the user 20.

The tracking and search system 8 includes one or more search engines 10, a computer 10*a*, including a processing system, one or more content servers 12 and one or more profile servers 14. Generally, servers may include a central processing unit (CPU), a main memory, a read-only memory (ROM), a storage device and a communication interface all coupled together via a bus. The search engine 10, including a program, processes a search query entered by a user 20, and communicates with the content server 12 or the profile server 14, to retrieve content. The content server 12 stores content associated with the system 8, and the profile servers 14 store profiles generated by data collected from such things as the VLF-IDs 14 (which functionally work similarly to the RFID 16, but at a different frequency), the RFID 16, a sensor 18, a user 20 and the like; both acting as information providers for the client-server network 2, accessed by the computer 10*a*, when the system implements a process or the user 20 submits a query into the search engine 10. The VLF-IDs 14, the RFIDs 16 and the Sensor 18 may be connected via a wireless means and/or may have data that is collected via another means, say be the robotic submarine 700 and retransmitted.

Servers include databases, which may be implemented in a single storage device or in a plurality of storage devices located in a single location or distributed across multiple locations. The databases are accessible to the servers and clients, within the client-server network 2. The information stored in the databases may be stored in one or more formats that are applicable to one or more software applications that are used by the clients and servers.

FIG. 42 is a flow chart depicting an embodiment of performing an automated method of tighten a collar around a particular RIS 100 unit or similar with a unique RFID and a mechanized collar. This method assumes that there is at least one RIS 100 unit with a collar with either an active RFID and/or an RFID that can be woken by the proper signal. Further, each reference through the specification to the RFID 16, can be replaced with the VLF-ID 14, or a combination of VLF-ID 14 and RFID 16. This includes any required communications with the RFID 16 via the RF band, where the VLF-ID 14 via the VLF band are also interchangeable with the RF references.

In addition and in this embodiment, the collar typically would have an automatic tighten/loosen mechanism, a means for tighten/loosening, say via a threading mechanism that can be engaged in either a tightening or loosening direction. The automatic tighten/loosen mechanism is triggered by an executed via a command triggered by a computer. Furthermore, the collar could employ a variety of rules and sensors for monitor rules and conditions, such as current pressures, temperatures, tensions, and the like; where this data can be stored and/or transmitted continually, upon request, and the like.

Starting with a "'Sung Collar' command sent to a specific RFID" 1000 and advancing to a query 1002 that asks if "Correct RFID?" where each RFID has a unique ID. If the answer to query 1002 is "yes" where the typically underwater RIS 100 with a particular collar has a matching RFID, then the method advances to a query 1006 which asks if it is a "Recognized Command?" If the answer to query 1002 had instead been "no" then the particular collar does not have a matching RFID, and thus a 1004 terminator or an "Ignore Command" executed.

If the answer to the query 1006 is "no", the method advances to a step 1008 with a "Send 'Correct RFID', but Unrecognized Command'" where the method then sends this message back to a step 1001 where an "Adjustments made, if necessary, 'Snug Collar' Command resent to specific RFID". Here the system examines the incoming data to determine what, if any adjustments can be made to the previously sent command and any rule adjustments necessary to fulfill the Snug Collar Command. If so, the adjustments are made by the system logic, and the "Snug Collar Command" is reattempted by sending it back out, where an active or a reawakened RFIDs in the query 1002 look at the updated command. These reattempts are tracked and can have iteration, timer and/or conditional limits.

If the answer to the query 1006 is instead "yes", the method advances to a query 1010 which asks "Collar Already Snug?" where the particular collar with the matching RFID checks it's parameters and rules to gauge whether the collar is already snug. Here the collar contains an embedded computer with data and rules for how tight is "snug" and sensors to determine if the collar is currently "snug". If the answer to the query 1010 is "yes" then the method advances to a step 1012 with a "Send 'Collar Already Snug & RFID'" where this information gets sent back to the step 1001 where again the "Adjustments made, if necessary, 'Snug Collar' Command resent to specific RFID".

Here again the system examines the incoming data to determine the "Snug" settings match a range of known settings, say for other "Snug Collars at that depth historically, from testing, currently and the like. Then if any adjustments can or need to be made to the previously sent command and rules to fulfill the proper Snug amount. If so, the adjustments are made by the system logic, and the "Snug Collar Command" is reattempted by sending it back out, where the active or reawaken RFIDs in the query 1002 look at the updated command. These reattempts are tracked and can have iteration, timer and/or conditional limits.

If the answer to the query 1010 is instead "no" where the collar is not already snug, then the method advances to a section 1014 where a series of queries are incorporated to produce a Result 1024. In section 1014, the method searches for any sent settings/rules, exiting settings/rules and/or other conditions related to the "Snug Collar Command" starting with a "Default Rules" 1016, a "Command Rules" 1018, a "Sensors" 1020, and a "System Rules" 1022.

The "Default Rules 1017 is for looking up and incorporating any default settings and/or rules. For instance, some default setting may override "Command Rules" while others may only be in lieu of missing "Command Rules" and/or as needed. The "Command Rules" is for looking at the sent command and incorporating any required settings and/or rules. The "Command Rules" is for looking at the sent command and incorporating any required settings and/or rules. The "Sensors" is for looking up and incorporating any sensor data settings and/or rules. For instance, some sensor data for temperature may change and/or override a particular "Command Rules" and/or modify a particular "Default Rule" while others may only be in lieu of a particular missing "Command Rule", a particular "Default Rule" and/or as needed.

The "System Rules 1022 is for looking up and incorporating any system settings and/or rules. For instance, some system setting may conditionally and/or always override particular "Command Rules", particular "Default Rule", a particular "Sensor" and/or modify data and/or rules, while others may only be in lieu of a particular missing rule or data; and/or as needed. These collective defaults, rules, command, sensor data and conditions, produce the 1024 Result that gets passed to a step 1026.

The Step 1026 then performs an "Execute 'Snug Collar' Command per 1024 Results (e.g. Rules)" where that command passes to a step 1028 with an "Initiate 'tightening" mechanism" is executed. This would typically cause the threading mechanism to rotate in the tighten direction while a number of sensors would monitor the progress and the time duration. A query 1030 asks if "Snug Per Rules in "X" time?" where the method would monitor the duration and the progress of the tighten per the sensors and the rules. "X" time can be a default duration, a duration sent by the command, and/or a duration sent by the system.

If answer to the query 1030 is "no" then the method passes to a step 1032 which executes a "Stop and send 'Not snug, parameters, and rules employed'" where the method then sends this message back to the step 1001 where an "Adjustments made, if necessary, 'Snug Collar' Command resent to specific RFID". Here the system examines the incoming data to determine what, if any adjustments can be made to the previously sent command and any rule adjustments necessary to fulfill the Snug Collar Command. If so, the adjustments are made by the system logic, and the "Snug Collar Command" is reattempted by sending it back out, where the active or the reawokened RFIDs in the query 1002 look at the updated command. These reattempts are tracked and can have iteration, timer and/or conditional limits.

If answer to the query 1030 is instead "yes" then the method passes to a step 1034 which executes a "Stop and send 'Snug, parameters, and rules employed'" where the method then sends this message back to the step 1001 where an "Adjustments made, if necessary, 'Snug Collar' Command resent to specific RFID". Here the system examines the incoming data to determine what, if any adjustments may be needed to the previously sent command and any rule adjustments necessary to fulfill the proper amount of Snug. For instance, if the data that comes back from step 1034 explicitly states or implicitly implies that the collar is not properly snug, than adjustments can be made by the system logic, and the "Snug Collar Command" is reattempted by sending it back out. Again, where the active RFIDs and/or the reawokened RFIDs in the query 1002 look at the updated command. These reattempts are tracked and can have iteration, timer and/or conditional limits.

Figures 11A, 11B, 11C, 11D, 11E:
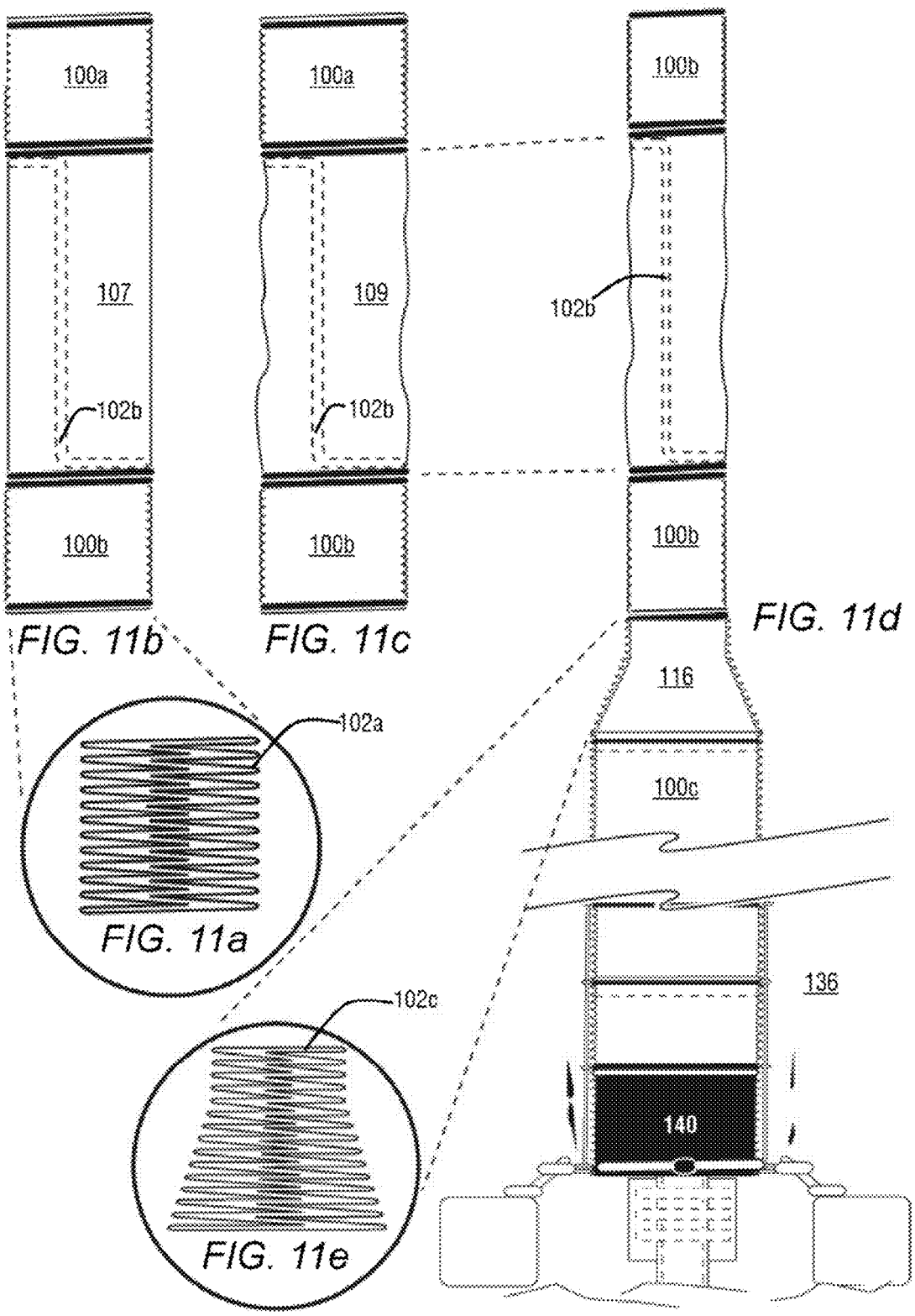
FIG. 11*a* depicts an enlarged frontal view of an embodiment of the RIS 100 unit's inner structural coil 102*a* without the outside membrane 108 (more detailed views in FIG. 18*a*-18*c* ahead).
FIG. 11*b* depicts a frontal view of an embodiment of another special embodiment of the RIS 100 unit referred to as a Relatively Rigid Section 107 that has been employed between a particular RIS 100*a* unit and a particular RIS 100*b* unit.
FIG. 11*c* depicts a frontal view of an embodiment of another special embodiment of the RIS 100 unit referred to as a Relatively Flexible Section 109 that has been employed between the RIS 100*a* unit and the RIS 100*b* unit.
FIG. 11*d* depicts a frontal view of an embodiment of two truncated portions of the HOS 200 with another special embodiment of RIS 100 unit referred to as a RIS-Transducer 116 that has been employed between the RIS 100*b* unit and the RIS 100*c* unit.
FIG. 11*e* depicts an enlarged frontal view of an embodiment of the RIS-Transducer 116 unit's inner structural coil 102*a* without the outside membrane.
Figure 18A:
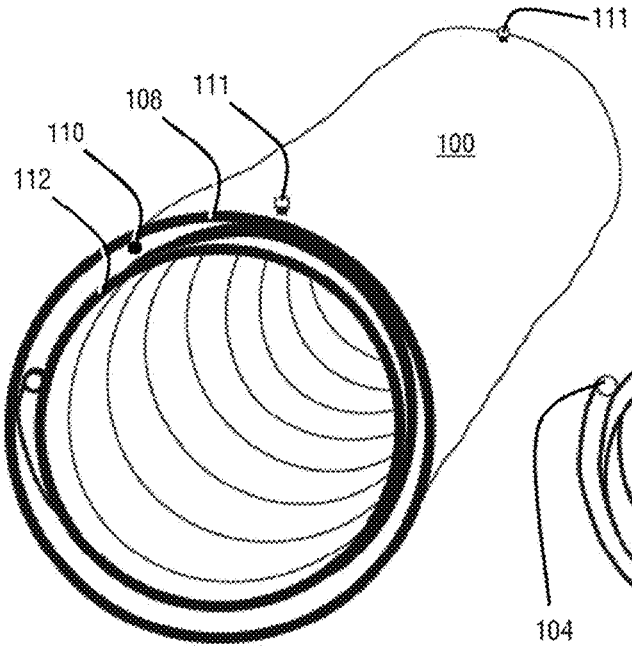
Figure 18B:
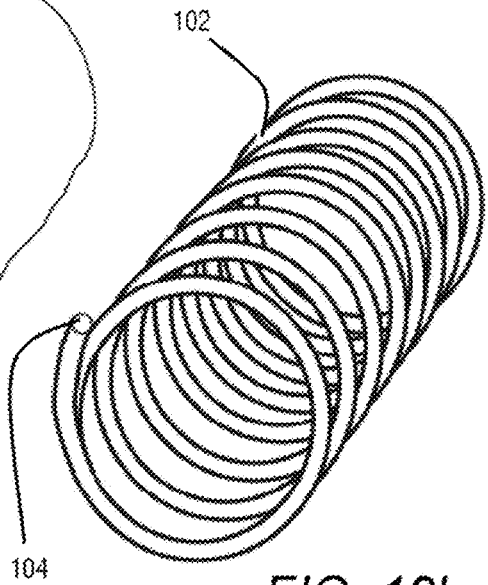
FIG. 18*b* depicts the same perspective view of an embodiment of the RIS 100 without the special inner membrane 112 or the special outer membrane 108 attached to expose the Structural Coil 102.
Figure 18C:
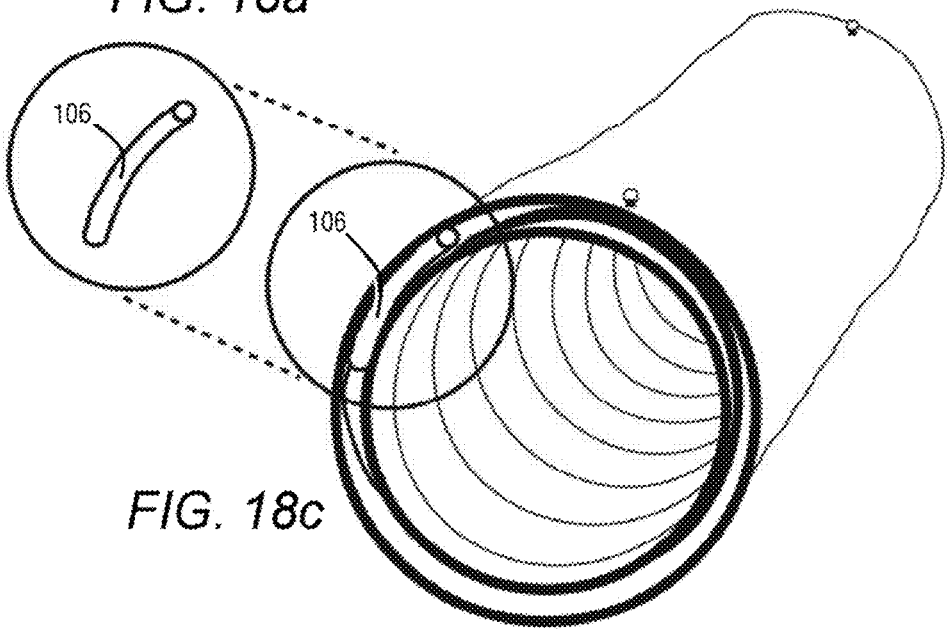
FIG. 18*c* depicts the same perspective view of an embodiment of the RIS 100 with the special inner 112 and outer membrane 108 where a coil extender 106 has been added to the Structural Coil 102.

FIG. 11*a* depicts an enlarged frontal view of an embodiment of the RIS 100 unit's inner structural coil 102*a* without the outside membrane 108 (more detailed views in FIG. 18*a*-18*c* ahead). The structural coil 102*a* inside the RIS 100 units can be a hollow tube-like material and depending on the embodiment, requirements, and conditions for deployment; the structural coil 102*a* can be made of metal, plastic, rubber, fiberglass, some combination, and/or the like.

In an embodiment, the structural coil 102 is made of steel. In another embodiment, the structural coil 102 is made of polypropylene. In another embodiment, the structural coil 102 is made of flexelene tubing. In another embodiment, the structural coil 102 is made of fiberglass. In another embodiment, the structural coil 102 is made of rubber from carbon nanotubes.

In an embodiment, a particular RIS 100 unit can have more than one type of inner structural coil 10*b* simultaneously (not shown in FIG. 11), where a series of say three can be either interwoven with the other two and/or where each is spaced apart in the traditional spiral pattern without any interweaving. Further in this embodiment with a plurality of inner structural coils 102 simultaneously, each inner structural coil 102 in the RIS 100 can be made of a different material (e.g. steel, polypropylene, and carbon nanotubes) and/or a different property (e.g. inner diameter, outer diameter, flexibility, etc.) where each can help fulfill a separate purpose (e.g. strength, heat, and flexibility) and the like. Furthermore in this embodiment with a plurality of inner structural coils 102 simultaneously, each inner structural coil 102 in the RIS 100 could perform a purpose where one inner structural coil 102 contains a communication wire, another contains a power wire, and another contains heating fluid in, say, just the lower portion.

For those structural coil 102 embodiments with the hollow tube-like properties, the structural coil 102 could allow for a range of Inserted Materials 170 to be poured, injected, pushed, and/or pumped into a RIS Coil Opening 104 (hereinafter "RIS-CO" 104; see FIG. 12). In the most embodiments, the Inserted Materials 170 generally are shielded from the Fluid Products 170 in some manner, say the coil itself, the inner membrane, or the like; and ideally do not intermix with the Fluid Products 170. In some embodiments, the Inserted Materials 170 can flow inside the structural coil 102*a* and between the interconnecting structural coils of adjacent units, potentially throughout the entire HOS 200 and/or just in specific sections as assembled and/or as needed. More details for introducing the Inserted Materials 170 (e.g. special fluids) inside the structural coil's 102 interior via the RIS-CO 104 further ahead.

FIG. 11*b* depicts a frontal view of an embodiment of another special embodiment of the RIS 100 unit referred to as a Relatively Rigid Section 107 that has been employed between a particular RIS 100*a* unit and a particular RIS 100*b* unit. In this embodiment all the RIS 100 sections can be interconnected with a means for locking and unlocking each unit at the unit's rim (more regarding connections methods throughout).

The Relatively Rigid Section(s) 107 may or may not have an inner coil 102*b*. In instances where the Relatively Rigid Section 107 does have the inner coil 102*b* inside, the inner coil 102*b* would ideally still allow any of the Inserted Materials 170 from an adjacent unit, say another RIS 100 unit, to travel down/up and inside the tubing of the inner coil 102*b* and thus continue the flow of any Inserted Materials inside the structural coil 102 throughout the HOS 200. Thus ideally creating a continual flow of the Inserted Material 170 from the RIS 100*a* unit above through Relatively Rigid Section 107 to the RIS 100*b* unit below (explained more ahead). The Relatively Rigid Section(s) 107 can be used for such benefits as to minimize the number of kinks in the HOS 200, to reduce the number of the RIS 100 units (or other special units e.g. ERIS 300 units ahead) required, and/or where the added strength may be beneficial.

Each section of the HOS 200 can be attached and entirely prebuilt before deploying into the sea water 136 or each RIS unit can be attached section by section, say as the HOS 200 is gradually lowered over the side of the drillship 130 or similar. These relatively rigid 107 sections are ideally constructed of materials that still allow for the free flow of Fluid Product 160 inside and may be used where conditions and/or sections that require more rigidity due to sea currents or sea pressures at certain depths.

FIG. 11*c* depicts a frontal view of an embodiment of another special embodiment of the RIS 100 unit referred to as a Relatively Flexible Section 109 that has been employed between the RIS 100*a* unit and the RIS 100*b* unit. In this embodiment all the sections can also be interconnected with a means for locking and unlocking each unit at each unit's rim. The Relatively Flexible Section(s) 109 may or may not have the inner structural coil 102*b* (similar to the Relatively Rigid Section 107 in FIG. 11*b*).

The Relatively Flexible Section 109 can have properties similar to say a fire hose, where the hose can be wound up on the drillship 130 and could be utilized within the HOS 200 to help cover great distances, and thus reduce the number of the RIS 100 units (or other special units e.g. ERIS 300 units ahead) required, and where the inside properties are ideally constructed and conducive for transporting the necessary pressures, temperatures, quantities, and/or a range of necessary Fluid Products 160 and the like.

In another embodiment, the inner coil of the Relatively Rigid Section(s) 107 and the Relatively Flexible Section(s) 109 can instead be run separate from the special units themselves either inside and/or on the outside. This special embodiment of separate coil could reduce the construction costs on the Relatively Rigid Section(s) 107 and the Relatively Flexible Section(s) 109. In addition, the special embodiment of separate coil could be employed to help circumvent, say a blockage along the HOS 200 and/or for to repair a section along the HOS 200.

FIG. 11*d* depicts a frontal view of an embodiment of two truncated portions of the HOS 200 with another special embodiment of RIS 100 unit referred to as a RIS-Transducer 116 that has been employed between the RIS 100*b* unit and the RIS 100*c* unit. The RIS-Transducer 116 could come in a range of sizes and a range of size conversion, and could be employed in either direction where, say the RIS 100*b* above, in FIG. 11*d*, could be flipped below and the RIS 100*c* below in could instead be flipped to above. In this embodiment all the sections can also be interconnected with a means for locking and unlocking each unit at each unit's rim and the interconnecting structural coils 102 of the adjacent units, could potentially allow for any Inserted Materials 170 to run throughout the entire HOS 200.

FIG. 11*e* depicts an enlarged frontal view of an embodiment of the RIS-Transducer 116 unit's inner structural coil 102*a* without the outside membrane. An inner structural coil 102*c* inside the RIS-Transducer 116 units is pre-constructed with the tapper properties and can also have the hollow inside allowing for a range of the Inserted Materials 170 to be poured, injected, pushed, and/or pumped into an open end and/or from an adjacent RIS 100 unit.

Figure 12A:
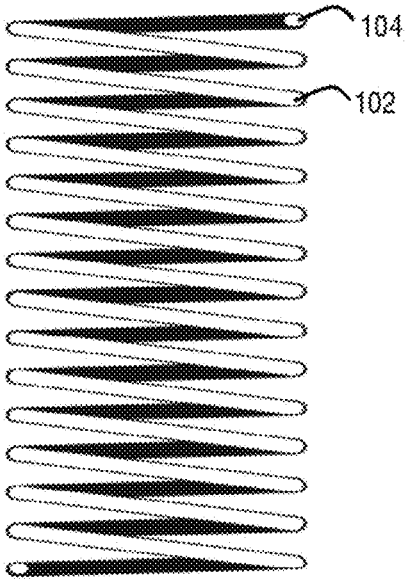
FIG. 12*a* depicts a frontal view of the structural coil 102 in an embodiment that could be utilized to support the outer membrane (in FIG. 12*b*) that creates a portion or a unit of the HOS 200.

FIG. 12*a* depicts a frontal view of the structural coil 102 in an embodiment that could be utilized to support the outer membrane (in FIG. 12*b*) that creates a portion or a unit of the HOS 200. As described earlier, each unit or section of the HOS is generally referred to the Riser Individual Section 100 ("RIS" 100). The RIS 100 structural coil 102 could be made of materials that allow it to be compressed like a spring and flexible enough allow for changes in sea current and/or interior pressures without causing the HOS 200 to become damaged.

Further, the flexibility the HOS 200 could be designed and/or assembled to fit around other smaller risers traditionally used in the industry to collect the Fluid Products 160, and/or around other HOS 200s. Consequently, there can be a variety of RIS types, conditional uses, and methods of assembly and deployment, where each RIS 100 unit type is linked together as needed. In some embodiments, the HOS 200 would ideally be allowed to engulf the wellhead pipe 120 opening 162 in deployment, while in other deployments it could either remain hovered from the "measurable safe distance" above, and/or be connected to robotic submarines 700s, or anchored from below and/or connected to, say the STH 201, but still at the "measurable safe distance".

Figure 12B:
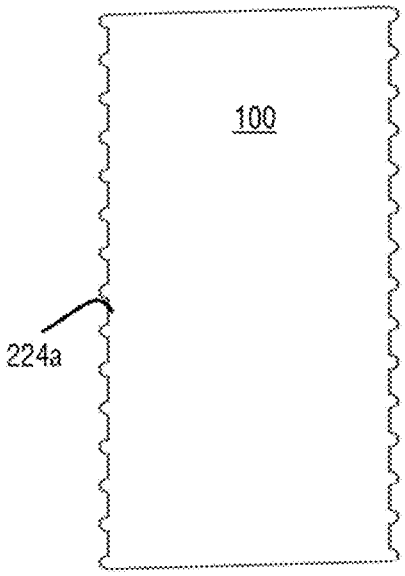
FIG. 12*b* depicts a frontal view of an embodiment of the RIS 100 structural coil 102 with an outer membrane 224*a* stretched over the top for creating the transport channel for the Fluid Products 160 (e.g. oil, gas, and the like).

FIG. 12*b* depicts a frontal view of an embodiment of the RIS 100 structural coil 102 with an outer membrane 224*a* stretched over the top for creating the transport channel for the Fluid Products 160 (e.g. oil, gas, and the like). This outer membrane 224*a* would be generally made of materials that allow each of the RISs 100 and the HOS 200 to be flexible, compressible, and relatively damage resistant, so as not to deteriorate from contact with petroleum based products, yet strong enough to handle extreme pressures and extreme temperatures.

In an embodiment the outer membrane 224*a* is typically made of rubber or a rubber-like material. In an embodiment the outer membrane 224*a* is made of a latex rubber or a latex-rubber-like material. In an embodiment the outer membrane 224*a* is made of a Neoprene rubber material. In an embodiment the outer membrane 224*a* is made of a nitrile material.

In other embodiments the outer membrane 224*a* is made of a VinyLovelatex rubber material. In an embodiment the outer membrane 224*a* is made of a Butyl material. In some embodiments, the previous list of outer membrane 224*a* materials incorporate other materials, such as oil resistant properties of polyurethane coating, nitrile coating, silicon coating, Porelle coating, and the like; and strengthening from Kevlar threads/fibers, nylon, polyester, acrylics, and the like.

In an embodiment, the structural coil 102 inside the RIS 100, would be made of material that itself was a hose-like opening or a RIS Coil Opening 104 (hereinafter "RIS-CO" 104). This configuration with an opening inside the RIS-CO 104 would benefit if each RIS 100 unit interconnected properly and adequately to allow the continual flow of the Inserted Materials 170 to be forced through the RIS-CO 104 along the entire length of the overall STACCO 200 or to a desired extent. This Inserted Materials 170 could be used to further help regulate the temperature, help increase rigidity, add weight and/or to strengthen the overall RIS 100 bottom to top.

The RIS-CO 104 could also have materials inside that lend themselves to bond to other materials as needed. For example, there could be wire strands inside the RIS-CO 104 that did not inhibit the flow of Inserted Materials 170, but could help bond to the Inserted Materials 170 material such as concrete.

The structural coil 102 may be made of a variety of densities and/or materials depending on such things as what depth that a particular RIS 100 section/unit is going to be deployed below the sea surface 132, the type of Fluid Products 160 that it will be channeling, what range in temperatures that section of sea water will likely cover, and the like. In addition, what is the purpose and/or function of each RIS 100 unit, e.g. what's the unit going to encompass, temperatures it will likely encounter, pressures it will likely encounter, what will it connect to from below and what will it connect to from above, and the like.

Further each set of parameters could have a unique ID. For instance a six alpha-numeric digit ID may represent the temperature range that a particular unit has been pre-tested for where the bottom tested temperature limit is made up of three digits, say "X05" where this represents "minus 05" degrees Fahrenheit and an upper tested temperature limit that is also made up of three digits, say "110" where this represents plus 110 degrees Fahrenheit. Another group of digits could represent a particular SKU for a particular material in the composition, size parameter (e.g. inside diameter), and the like. The combination of these alpha-numeric digits could be programmed into a RFID 16 or similar and embedded into each RIS unit and/or part. In addition, there could be color-coding of the RIS units and/or parts for what range of depth and the like the RIS unit and/or part has been tested and/or constructed.

Figure 12C:
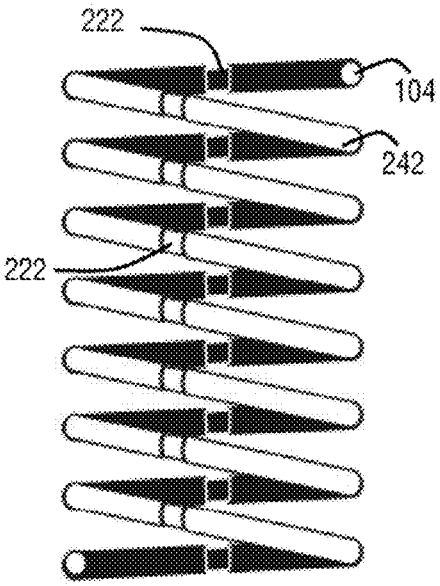
FIG. 12*c* depicts a frontal view of an embodiment of a particular type of expandable structural coil 242 whereby it can be adjusted via a telescoping means to increase this particular type of RIS 100 unit's size, in say its diameter, and is referred to as an expandable RIS 300 unit (or "ERIS" 300).

FIG. 12*c* depicts a frontal view of an embodiment of a particular type of expandable structural coil 242 whereby it can be adjusted via a telescoping means to increase this particular type of RIS 100 unit's size, in say its diameter, and is referred to as an expandable RIS 300 unit (or "ERIS" 300). The ERIS 300 units could be constructed in such a manner with materials that could allow for telescoping from a telescoping joint 222 (more ahead).

Figure 12D:
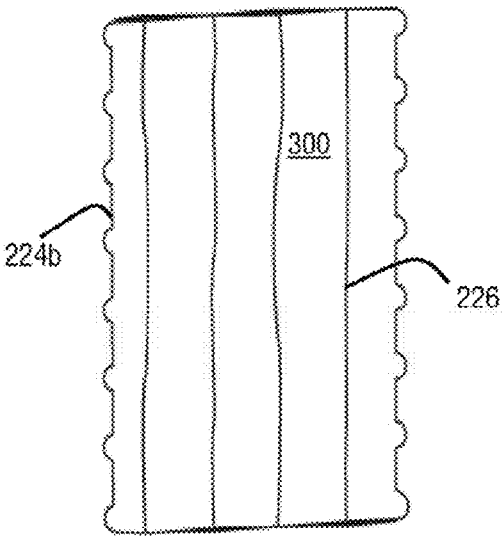
FIG. 12*d* is a frontal view of an embodiment of the ERIS 300 wherein the expandable structural coil 242 depicted in FIG. 12*c* is now covered and supported by an outer membrane 224*b* which is stretched over the top of the expandable structural coil 242 for creating the seal and channel necessary for transporting the Fluid Products 160 (e.g. oil, gas, and the like).

FIG. 12*d* is a frontal view of an embodiment of the ERIS 300 wherein the expandable structural coil 242 depicted in FIG. 12*c* is now covered and supported by an outer membrane 224*b* which is stretched over the top of the expandable structural coil 242 for creating the seal and channel necessary for transporting the Fluid Products 160 (e.g. oil, gas, and the like). This ERIS 300 unit is similar to the RIS 100 unit in FIG. 12*b*, but where this ERIS 300 unit can expand its diameter larger.

For instances, the inner expandable structural coil 242 could be made in a manner and with materials where it can telescope larger, thus creating a larger inner diameter to, say fit around another RIS 100 unit, ERIS 300 unit, and/or some other item(s), such as the wellhead pipe 120 opening. In addition, the outer member 224*b* could be designed and fabricated with a plurality of expanding pleats 226 to help the ERIS 300 unit more easily expand the diameter with less resistance/restrictions.

Figure 13A:
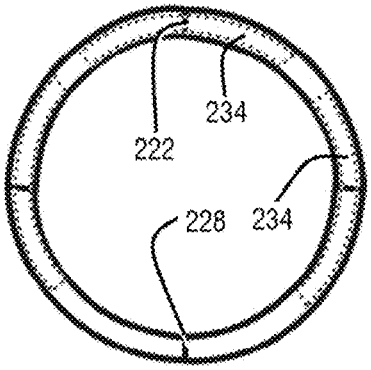
FIG. 13*a* is an embodiment depicting a cross section view from the top or bottom of ERIS 300 where the unit's diameter is still not expanded or has not yet been telescoped out larger.

FIG. 13*a* is an embodiment depicting a cross section view from the top or bottom of ERIS 300 where the unit's diameter is still not expanded or has not yet been telescoped out larger. In this FIG. 13*a*, the dotted lines indicate an ERIS bridge 234 structure that will allow the ERIS 300 unit to telescope larger via a telescoping joint 222. Not all joints have to contain the ERIS bridge 234 structure and/or allowing for telescoping, as depicted here with a non-telescoping joint 228. Both the non-telescoping joints 228 and the telescoping joints 222 can contain a hinging means and can also be relatively flexible to better allow the ERIS 300 unit to expand its diameter.

Figure 13B:
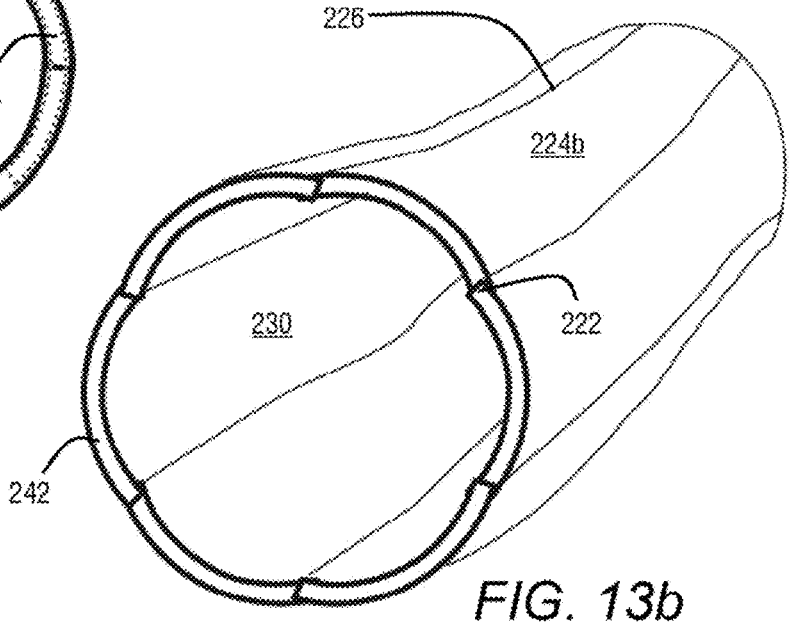
FIG. 13*b* is an embodiment depicting a perspective view of ERIS 300 whereby the unit is telescoped outward/larger.

FIG. 13*b* is an embodiment depicting a perspective view of ERIS 300 whereby the unit is telescoped outward/larger. In some embodiments, once the ERIS 300 is telescoped outward, the ERIS bridge 234 structures and the expandable structural coil 242 ideally become, in function and purpose, similar to the structural coil 102 in FIG. 11*a*/FIG. 11*b* to support the outer membrane 224*b*. In some embodiments, once the ERIS 300 is telescoped outward, the ERIS bridge 234 structures and the expandable structural coil 242 are similar to the structural coil 102 in FIG. 11*a*/FIG. 11*b* to support the outer membrane 224*b*, but with the functionality of expansion and sometimes, contraction. Meaning the unit could be expanded at one end and contracted at the other end, and/or a portion of the section in between.

In this FIG. 13*b* depiction, the ERIS 300 has the outer membrane 224*b* and there could also be an inner membrane 230 made of the same material or a different material. The inner membrane 230 could be added for strength, to make the unit easier to clean out later, and could facilitate additional benefits for trapping materials and/or fluids between the membranes, discussed both earlier and more ahead. Both the inner membrane 230 and other membrane 224*b* could be designed to be replaceable.

Figure 13C:
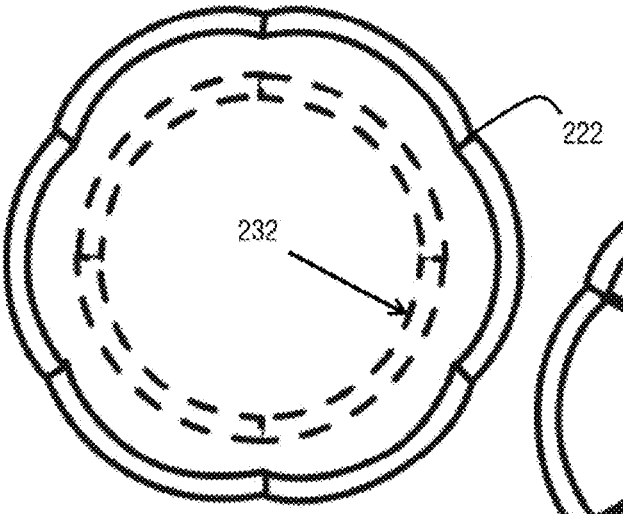
FIG. 13*c* is an embodiment depicting a top or bottom view of both the ERIS 300 in the non-telescoped mode (a shape 232) and the telescoped mode for a size relational comparison.

FIG. 13*c* is an embodiment depicting a top or bottom view of both the ERIS 300 in the non-telescoped mode (a shape 232) and the telescoped mode for a size relational comparison. The dotted outline of the shape 232 depicts the non-telescoped mode of the ERIS 300. In some instances, one end of the ERIS 300 could be in the non-telescoped mode/state while the other end could be in the telescoped mode/state. There could also be diameter restrictors place around the outside of the ERIS 300 similar to a belt/collar to help maintain a particular shape (against internal pressures and/or volumes) and/or to help restrict the size in a particular place or portion of the ERIS 300 (not shown).

Figure 13D:
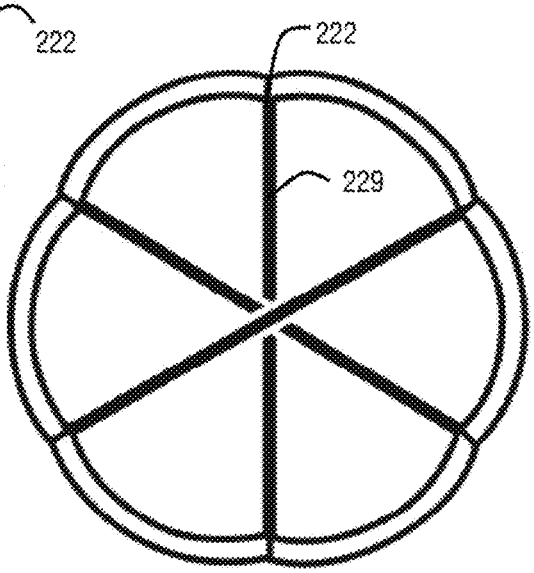
FIG. 13*d* is an embodiment depicting a top or bottom view of the ERIS 300 where an interior cross brace 229 has been added.

FIG. 13*d* is an embodiment depicting a top or bottom view of the ERIS 300 where an interior cross brace 229 has been added. The interior cross brace(s) 229 can help with rigidity where needed without adding unnecessary weight and depending on construction materials used, still allow the flow of Fluid Products 160. The interior cross brace 229 can be made of a rigid material to prevent it from getting blow out by the pressure of the Fluid Products 160, or it can be made of a material that can intentionally be blown out by the Fluid Product 160 pressure, so that it is just a temporary component to help keep the unit expanded out before utilized and/or the flow of the Fluid Products 160. In addition, the interior cross brace 299 could perform a temporary or permanent filtering function, depending on the conditions whereby the interior cross brace gets intentionally blown out.

In an embodiment, the telescoping capabilities shown in FIG. 13*a*-13*d* could employ a grabbing mechanism, whereby the grabbing mechanism employs, say a set of teeth that grab and help prevent the expanded telescoped state from reversing back in on itself to the previous non-telescoped smaller diameter 232 size (more on grabbing teeth ahead in FIG. 16*a*-16*c*). In an embodiment, the expanded/telescoped state could also be a temporary state, where there are, say either: no teeth, retracting teeth, not enough teeth, or where there is not enough teeth depth to prevent the unit from condensing back inside following a condition and/or amount of applied pressure. The condition could be after the structural coil 102 is expanded/telescoped to create the temporary state with larger interior diameter, and where that expanded/telescoped state is allowed to shrink back down in diameter at some selected conditional point in time and/or where, say a particular water depth forces the unit back to its previous size and/or where, say the unit can go back to its relaxed non-telescoped state as needed.

Figure 14A:
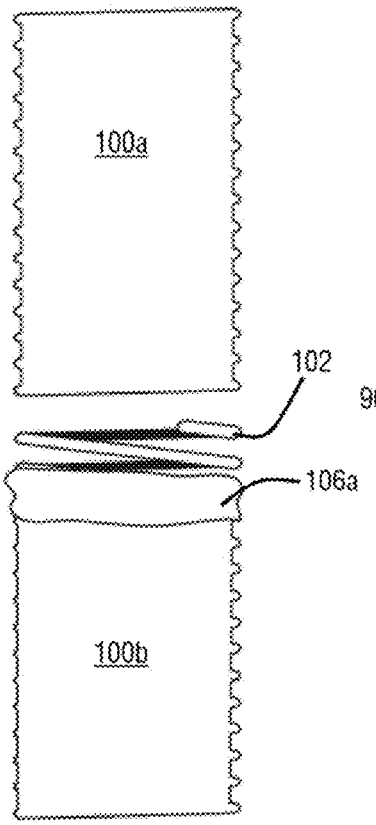
FIG. 14*a* depicts a frontal view of another embodiment of the RIS 100*a* unit and the RIS 100*b* unit prior to interconnecting them together.

FIG. 14*a* depicts a frontal view of another embodiment of the RIS 100*a* unit and the RIS 100*b* unit prior to interconnecting them together. There are variety of connection means, materials, and plurality of methods that can be employed to interconnect the RIS 100 units, and/or variety of means, materials, and plurality of methods to lock and unlock the RIS 100 sections. In addition, there can be connection methods of interconnecting the RIS 100 units that are permanent and others that are temporary. Further, some RIS 100 units of the HOS 200 can be permanent connected to its adjacent RIS 100 unit and/or the like, while other RIS 100 units and/or the like can be temporarily connected.

Figure 14B:
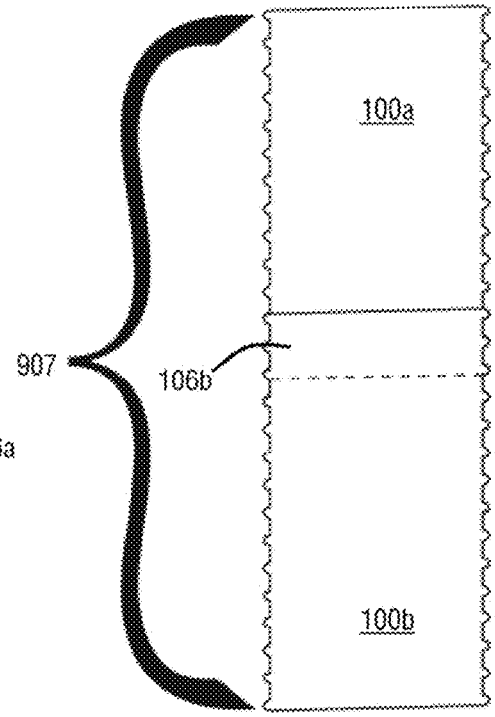
FIG. 14*b* depicts a frontal view of one embodiment where the two independent RIS 100 sections shown in FIG. 14*a* have now been interconnected by twisting a particular RIS 100*a* unit together with a particular RIS 100*b* unit to create an interlocking overlap 106*b* section and thus extend the overall length depicted by a bracket 907 and could be the start of the building of the HOS 200 (more interlocking methods and details ahead).

FIG. 14*b* depicts a frontal view of one embodiment where the two independent RIS 100 sections shown in FIG. 14*a* have now been interconnected by twisting a particular RIS 100*a* unit together with a particular RIS 100*b* unit to create an interlocking overlap 106*b* section and thus extend the overall length depicted by a bracket 907 and could be the start of the building of the HOS 200 (more interlocking methods and details ahead).

Figure 15A:
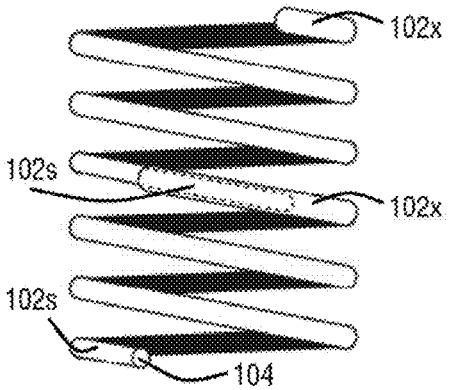
FIG. 15*a* depicts a frontal view of a connection embodiment of a inserted-twist connection between two independent sections of the RIS 100*a* and the RIS 100*b* where a portion of the structural coil 102 (same as the inner structural coil) from the top RIS 100*a* unit inserts inside a portion of the structural coil 102 of the lower RIS 100*b* unit (from FIG. 14*a* above).

FIG. 15*a* depicts a frontal view of a connection embodiment of a inserted-twist connection between two independent sections of the RIS 100*a* and the RIS 100*b* where a portion of the structural coil 102 (same as the inner structural coil) from the top RIS 100*a* unit inserts inside a portion of the structural coil 102 of the lower RIS 100*b* unit (from FIG. 14*a* above). In some embodiments, the RIS 100 units can be designed and created whereby the structural coil 102 could tapper and/or expand the diameter. For instance, the structural coil 102 could have a smaller outer diameter at the lower end 102s of the structural coil 102 verses at an upper opposite end with a larger inside 102*x* diameter thus allowing the two RIS 100 units to twist one inside the other and interlock as depicted in FIGS. 14*b* and 15*a* and create the inserted-twist connection.

In an embodiment, the inserted-twist connection can be done before the outer and/or inner membranes are added. In another embodiment, the outer and/or inner membranes have already been attached, but where the membranes as depicted in FIG. 14*a* can be rolled back to help with the inserted-twist connection.

In some embodiments, the inserted-twist connection of the structural coils 120 can help allow the Inserted Materials 170 mentioned earlier to provide an inserted material flow inside the inner structural tubing of the structural coil 102. In some embodiments, ideally inserted material flow occurs throughout the entire HOS 200 and/or just in specific sections as assembled and/or as needed.

Figure 15B:
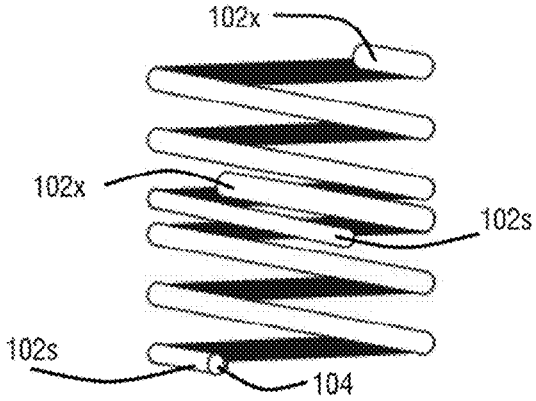
FIG. 15*b* depicts a frontal view of an another connection embodiment of an overlapping-twist connection between two independent sections of the RIS 100*a* and the RIS 100*b* where a portion of the structural coil 102 (same as the inner structural coil) from the top RIS 100*a* unit overlaps another portion of the structural coil 102 of the lower RIS 100*b* unit (from FIG. 14*a* above).

FIG. 15*b* depicts a frontal view of an another connection embodiment of an overlapping-twist connection between two independent sections of the RIS 100*a* and the RIS 100*b* where a portion of the structural coil 102 (same as the inner structural coil) from the top RIS 100*a* unit overlaps another portion of the structural coil 102 of the lower RIS 100*b* unit (from FIG. 14*a* above). In this embodiment, the membranes, or at least the outer membrane 106*a*, may also need to be temporarily flipped down as depicted in FIG. 14*a* to allow the two unit's structural coil s to be exposed and twisted together.

Further, where the outer membrane 108 can then be pulled back over the top when the two RIS 100 units are sufficiently overlapped in the overlapping-twist connection. Depending upon the embodiments, conditions, and requirements, the overlapping-twist connection of the RIS units could be and/or lend itself to be a temporary, a relatively permanent, or a permanent state.

In some embodiments, there can be an addition locking means used to help prevent the inserted-twist connection, the overlapping-twist connection, and/or a similar type of connection of the two RIS 100*a* and 100*b* units from coming apart. For instance, the locking means could be as teeth that grab, fasteners, locks, and the like (ahead).

The RIS 100 can be made in a variety of diameters. For instances, the RIS 100 could be constructed with an inside diameter of, say 25 inches, or at least larger than the typical wellhead pipe 120 opening 162. However, more likely larger, to allow the RIS 100 to sufficiently encompass, engulf or drape over the wellhead pipe 120 opening 162, where this increased size (inside diameter) helps increase the simplicity of covering the wellhead pipe 120 opening 162 to capture the escaping Fluid Product 160, but not so large as to create excessive cost, weight, and less maneuverability.

In one embodiment, the HOS 200 would be attached to the STH 201. In this embodiment, the HOS 200 riser could instead be fabricated much larger, say, with a 25 inch inside diameter of RIS 100 for this example. After the RIS 100 with the 25 inch inside diameter (hereinafter "Inner RIS-25" 125) is connected to other Inner RIS-25" 125 units and deployed as an "Inner HOS-25" 225, another RIS 100 unit with a larger size diameter, say of 35 inches, referred to as an "Outer RIS-35" 135 can be connected to other "Outer RIS-35" 135 units. Where the interconnected "Outer RIS-35" 135 units would be deployed as and referred as an "HOS-35" 235 and lowered around the Inner HOS-25 225, typically from the top down (similar to the depiction in FIG. 5*c*).

The ability to deploy and run another HOS 200 riser down around the outside is uniquely possible to this invention and embodiment because the Inner HOS-25 225 does not have to be attached to anything at the top and/or at the sea surface 132, whereas those clean-up/riser methods that are typically attempted, say by BP® and others in the industry could not accomplish this.

Even if the Inner HOS-25 225 requires and/or benefits by having any attached elements at the top for say, floating purposes, and/or for the purpose of pooling Fluid Products 160 at the sea surface 132, these attachment elements can typically be added and/or removed as needed, relatively easy when compared to current methods being employed in the industry. The benefit of running another Outer HOS-35 235 or multiple HOS 200s of larger diameters is to help prevent any potential and/or actual leakage, similar to the double hulled oil tankers for catching any leaks.

In another instance, the Outer HOS-35 235 is deployed before the Inner HOS-25 225, where the Inner HOS-25 225 is subsequently snaked through the Outer HOS-35 235 either from the bottom or the top, but generally from the top. A special probe referred to as a HOS probe 143 can be temporarily and/or permanently attached to a probing end of the Inner HOS-25 225. The HOS probe 143 can have the sensors, the gauges, the power sources, and the communication means to connect and communicate back to the drillship 130 control room where the PC and the like and located and interconnected.

The HOS probe 143 and communication means help allow the user who's interconnected via the control and PC onboard the drillship 130 to navigate the Outer HOS-35 235 to the destination of the Inner HOS-25 225. In some embodiments, the HOS probe 143 is relatively short, say only one RIS, but can be beneficial for unclogging areas, getting measurements from inside the HOS 200, and/or the like.

FIG. 16*a* depicts an enlarged frontal view of a locking means embodiment for the overlapping-twist connection and similar connections, where the structural coil 102 has a series of outer teeth 402. The outer (tooth or) teeth 402 allow the two units to overlap as they are being twisted together, but where the teeth help create a position and connection that helps prevent the units from unlocking the overlapping-twist connection. FIG. 16*b* depicts an enlarged frontal view of another locking means embodiment for the overlapping-twist connection, where the structural coil 102 also has a series of the outer teeth, but where these particular teeth are a series of retracting teeth 404. These series of retracting teeth 404 could have a release mechanism (not shown), whereby, say twisting and releasing, and/or a gravity release system to subsequently allow the RIS 100 units to be taken back apart and/or at least unlocked the overlapping-twist connection.

FIG. 16*c* depicts a frontal view of another locking means embodiment for the inserted-twist connection and similar connections, where the structural coil is intended for interlocking the structural coil 102 where each RIS 100 unit would have a series of both outer teeth 406 and a series of inner teeth 408 (depicted by the dotted line area). An arrow 914 is for depicting the insertion direction for the series of outer teeth 406 and for interconnecting it into the series of inner teeth 408, but in practice this would actually be done from above and in downward rotation, as the RIS 100 units are actually round and would thus twist/rotate while interconnecting together in the inserted-twist connection and similar connections. All of the connections could be made more or less permanent with other conditional means and/or by adding other connector means, such as screws, bolts, adhesives, glues, clamps, snaps, twist locks, belts, tension washers, tension gaskets, lubricates, coatings, grit, and the like.

Figures 17A, 17B:
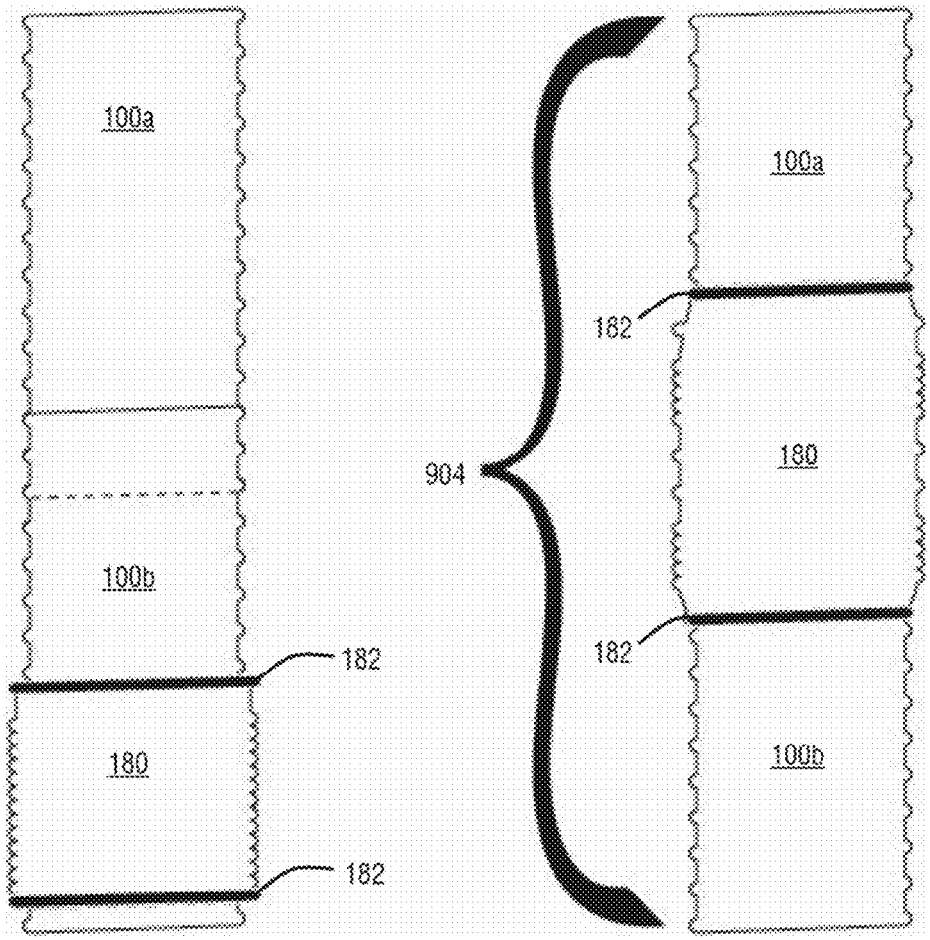
FIG. 17*a* depicts a frontal view of an instance of an embodiment of an outer RIS unit or referred to as a RIS Collar 180 that can be pre-placed over a smaller diameter RIS 100*b*.
FIG. 17*b* depicts a frontal view of another instance of the embodiment where the RIS Collar 180 has been re-position over a specific position or section of the two RIS 100 units and/or the HOS 200 (depicted by an overall bracket 904).

FIG. 17*a* depicts a frontal view of an instance of an embodiment of an outer RIS unit or referred to as a RIS Collar 180 that can be pre-placed over a smaller diameter RIS 100*b*. In FIG. 17*a* the RIS Collar 180 is in the fully compressed state or configuration. FIG. 17*b* depicts a frontal view of another instance of the embodiment where the RIS Collar 180 has been re-position over a specific position or section of the two RIS 100 units and/or the HOS 200 (depicted by an overall bracket 904). The specific position of the RIS Collar 180 over the two RIS 100 units may be for a variety of conditions, such as to strengthen an underlying joint/connection in the HOS 200 and/or to help contain a breach or a leak of the Fluid Product 160 and/or a breach or a leak of the Inserted Materials 170.

A Collar Rim 182 and constriction means allows the RIS Collar 180 to be constricted similar to a belt tightening and to provide a better form fit of the RIS Collar 180 to the outside of the HOS 200 and thus ideally help reduce any of the breaches, leaks and/or strengthen an inside joint/connection (also see branching 148 further ahead). The RIS Collar 180 can be constructed of the same materials as the RIS 100 or different materials, where say there is an adhesive and/or sealant applied to the inner membrane. The Collar Rim 182 constriction means can be employed through a variety of means and methods (e.g. via a collar type ahead in FIG. 19-22 or similar).

FIG. 18*a* is a perspective view of a RIS embodiment where the RIS 100 is say laying flat before deployment and depicts a special inner, referred to as an Inner RIS 112 membrane, and special outer membrane, referred to as an Outer RIS 108 membrane, where the Inserted Materials 170 can be added in between. Depending on the embodiment and the like, the Inserted Materials 170 can include a wide variety of materials, purposes, and/or the like; including, but limited to: fluids, such as adhesives, lubricates, sealants, harden materials, and/or the like; gases: such as helium, carbon dioxide, oxygen, nitrogen, argon, carbon monoxide, adhesives, lubricates, sealants, harden materials and the like; solids, such as a wire, a hose, a glass thread, a fiber optic thread, and the like; components, such as the probing end 143, a RFID pellet, a sensor pellet, a combination of elements, such as a RFID/Sensor pellet, a cable, a group of wires, and/or the like, and/or some combination.

The RFID pellet and the sensor pellet can each be uniquely tracked as the move throughout the HOS 200 to monitor flows and the like. The RFID pellet and the sensor pellet can also be utilized for a similar flow tracking method and system in the Structural Coil, in the Respirator System of the Lungs and/or introduced into the Fluid Products 160 at or near the I-RIS 140 where each RFID pellet, sensor pellet, and/or combination RFID/Sensor pellet can help provide flow data and the like.

In some embodiments, the RFID pellet, the sensor pellet, and/or the combination RFID/Sensor pellet could also employ nanotechnology and contain a nano-ID where uniquely assigned IDs and properties can also help determine where the Inserted Materials 170s have flowed and not flowed and over what amount for of time. The range of IDs and sensors could be active where feasible, and/or inactive and read as the pass through specially designed and created collars that are equipped with ID and sensor readers, where each unique ID and sensor is read as each passes through. In some embodiments, the range of IDs and sensors would have a unique magnetic property to help identify and remove later, if in an active ID or sensor should become damaged or die.

Referring back to the Inserted Materials 170 for the cavity area 110, the Inserted Materials 170 can be poured, injected, pushed, and/or pumped into an opening or pocket, referred to as the cavity area 110 which is depicted with a dot (from line 110), but the cavity area 110 typically runs the full length and cavity between the Inner RIS 112 membrane and the Outer RIS 108 membrane from one end rim to the other.

The Inserted Materials 170 can be poured, injected, pushed, and/or pumped into the open cavity area, referred to as the cavity area 110 which is depicted with a dot, but runs the full length and cavity between the Inner RIS 112 membrane and the Outer RIS 108 membrane. The ability to use the Inserted Materials 170 within the cavity area 110 could be employed to create a number of independent and beneficial conditions within each RIS 100 unit and/or the HOS 200.

In some cases, it may be easier to introduce the Inserted Materials 170 before deploying the HOS 200 into the sea water 136, but in some cases it may be necessary and/or easier to introduce the Inserted Materials 170 after the HOS 200 has been deployed into the sea water 136. In addition, depending on how the RIS units are constructed and interlocked with each other, this may also affect the ability and ease for introducing, spreading, and employing the Inserted Materials 170 after deployment. A value 111 creates an additional gateway for introducing, inserting, and/or injecting the Inserted Materials 170 before and/or after deployment into the sea water 136 and the value 111 could be strategically located anywhere along the RIS 100 unit, but somewhere along or near the cavity area 110 opening and potentially in a plurality of locations.

In some embodiments of the RIS 100, the Inner RIS 112 membrane and the Outer RIS 108 membrane are adhered to the structural coil 102 in an adherence manner, where the Inserted Materials 170 are allowed to flow inside the cavity area 110. In some embodiments of the RIS 100, where the Inner RIS 112 membrane and the Outer RIS 108 membrane are adhered to the structural coil 102, the Inserted Materials 170 is allowed to flow inside the cavity area 110, but is limited to an area between the two membranes.

The Inserted Materials 170 could have a range of resulting effects on the RIS 100, depending a number of factors, say including the resistance strength of the materials utilized in the Inner RIS 112 membrane and the Outer RIS 108 membrane, an adherence strength to the structural coil 102, and the amount and portion of the surfaces employed in the adherence manner to connect each membrane to the structural coil (e.g. only a measurable bead placed along the outer surface edges of the structural coil for the full height of the structural coil when adhering the Outer RIS membrane 108), For instance, one such resulting effect on the RIS 100 could be to bulge both membranes outward only in between the structural coils, where another resulting effect on the RIS 100 could be to bulge only one of the two membranes, while another resulting effect on the RIS 100 could be relatively little to any bulge on either membrane.

In addition, there be a condition during deployment of the HOS 200, where adjusting the weight or buoyancy could made relatively easier via the introduction or removal of the Inserted Materials 170 (eg. fluids, adhesives, harden materials, and/or gases: such as helium, carbon dioxide, oxygen, nitrogen, argon, carbon monoxide, and the like), where one could increase or decrease the Inserted Materials 170 and/or the like inside the membrane cavity 110 of the HOS 200. In addition, these changes in the amount of the Inserted Materials 170 and/or the like could be temporary or relatively permanent to adjust the weight, buoyancy; rigidity, strength and/or temperature as needed. Besides the Inserted Materials 170 or harden materials mentioned, one could also use gases (such as helium, carbon dioxide, oxygen, nitrogen, argon, carbon monoxide, and the like) to say increase and decrease buoyancy. All of these methods and materials can also be employed to help prevent the HOS 200 from becoming damaged, breached, leaking, and/or from being overly influenced by underwater currents.

FIG. 18*b* depicts the same perspective view of an embodiment of the RIS 100 without the special inner membrane 112 or the special outer membrane 108 attached to expose the Structural Coil 102. In addition to putting in the Inserted Materials 170 inside the cavity area 110, the Inserted Materials 170 can also be poured, injected, pushed, and/or pumped into the Structural Coil 102 from the RIS-CO 104 and pushed throughout that particular structural coil cavity for each RIS 100 unit and/or similar unit.

FIG. 18*c* depicts the same perspective view of an embodiment of the RIS 100 with the special inner 112 and outer membrane 108 where a coil extender 106 has been added to the Structural Coil 102. The coil extender 106 can be employed to help improve the connection between the interconnected RIS 100 units and can help allow the Inserted Materials 170 and like, inside the RIS-CO 104 opening and throughout the Structural Coil 102 cavity 110 to flow from one RIS unit to next RIS 100 unit and/or the like, ideally traveling throughout all interconnected RIS units and/or the like within the HOS 200. In addition, there could also be values that are similar to the value 111 on the cavity area 110, but connect to the inside of the structural coil 102 for controlling the input and pressure of the Inserted Materials 170s along each RIS 100 unit and the like.

Figure 19A:
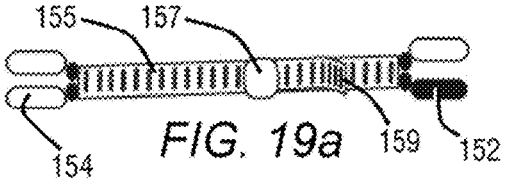
FIG. 19*a* depicts a frontal view of an embodiment of an Adjustable Connector Strap 155 (hereinafter "ACS").

FIG. 19*a* depicts a frontal view of an embodiment of an Adjustable Connector Strap 155 (hereinafter "ACS"). The ACS 155 could utilize a variety of adjustment means, in this depiction the adjustment works similar to a traditional hose clamp where the ACS 155 passes through an ACS Lock 157 and where the ACS Lock 157 could provide the adjustment means. The ACS 155 and ACS Lock 157 could be tighten before deployment into the sea water 136 with tools or could be designed to be tool-less or a relatively tool-less system where the user 20 could simply pull on an ACS End 159 to tighten.

The ACS 155 and ACS Lock 157 could be utilized, for instance, around the inserted-twist connection, the overlapping-twist connection, and/or a similar type of connection of the two RIS 100*a* and 100*b* units to help prevent the units from coming apart, breached, damaged; and/or to support/attach additional hardware, sensors, RFIDs, power sources, cables, wires, and/or the like. A Loop 154 and an End Stop 152 can be attached to the ACS 155 and are explained in more detail ahead. The ACS 155 can come in variety of shapes, sizes, diameters, and materials; such as metals and/or plastics, and can have a variety of different types of Loops 154 and a variety of different types of End Stops 152 attached. In some embodiments, the ACS Lock 157 provides the tighten means. In some embodiments, both the ACS 155 and the ACS Lock 157 could have separate tighten means, and each could also have a variety of different connection types.

Figure 19B:
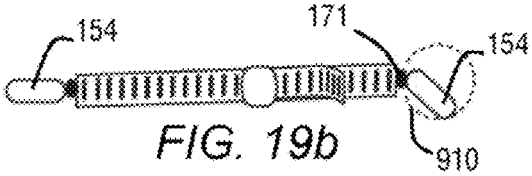
FIG. 19*b* is a frontal view of another embodiment of an ACS 155 depicting an ACS hinge 171 for the loop 154.

FIG. 19*b* is a frontal view of another embodiment of an ACS 155 depicting an ACS hinge 171 for the loop 154. The dotted line circle (demarked with a 910) depicts the ability of the Loop 154 to rotate from the ACS hinge 171. In an embodiment, the ACS hinge 171 could be a ball and socket type joint with a relative wide range of rotation capabilities and in multiple directions. In another embodiment, the ACS hinge 171 could intentionally have limited rotation, thus causing the connected Loop 154 to protrude outward in manner that is easier to connect with underwater.

The ACS 155 does not have to be balanced symmetrical with either the same part, types of parts, and/or number of parts, say of the Loops 154 and/or End Stops 152 on each side; can have a variety of different configurations of the Loops 154 and the End Stops 152. Further, the ACS 155 does not have to have either the Loop 154 or the End Stop 152 on a particular side or on any of the sides of the ACS 155.

Figure 19C:
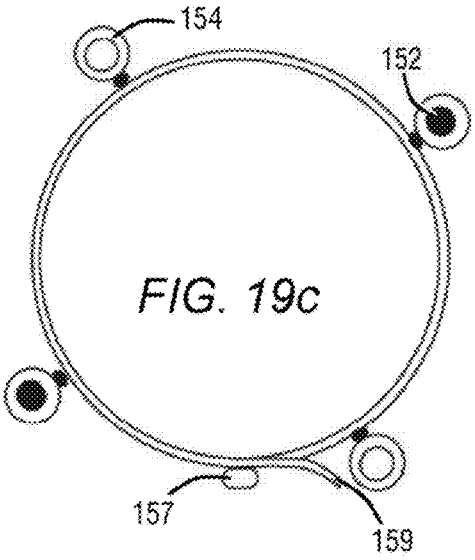
FIG. 19*c* is a top or bottom view of an embodiment depicting the ACS 155 with two symmetrically placed Loops 154 and two symmetrically places End Stops 152.

FIG. 19*c* is a top or bottom view of an embodiment depicting the ACS 155 with two symmetrically placed Loops 154 and two symmetrically places End Stops 152. The diameter of the ACS 155 can be adjusted with the ACS Lock 157. In one embodiment the ACS Lock 157 may be released with tools and in another embodiment the ACS Lock 157 may simply be released with inward pressure from, say a tool, device, and/or user on the ACS Lock 157. The ACS End 159 that extends beyond the ACS Lock 157 can be relatively shorter or much longer than depicted.

Figure 19D:
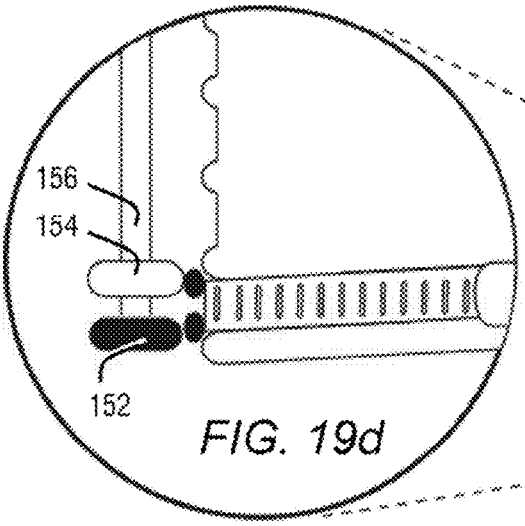
FIG. 19*d* is an enlarged frontal view from FIG. 19*e* of an embodiment depicting the Loop 154 and the End Stop 152 when attached to the RIS 100.
Figure 19E:
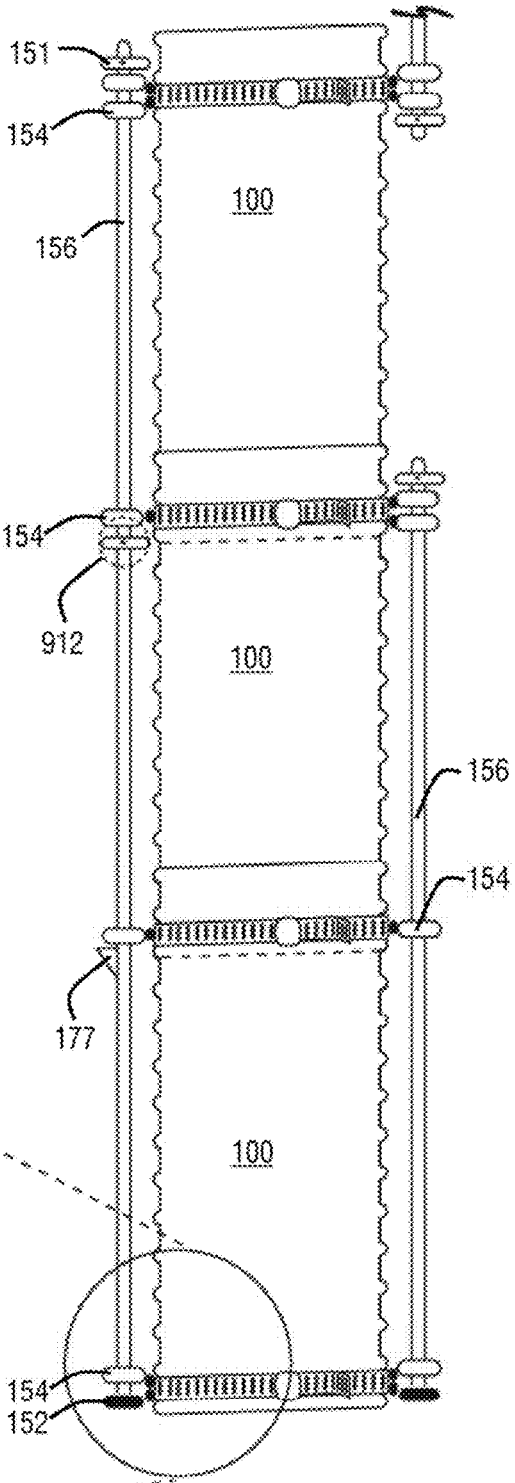
FIG. 19*e* depicts a frontal view of an embodiment where the RIS 100 units can be reinforced from the exterior using a variety of the ACS(s) 155.

FIG. 19*d* is an enlarged frontal view from FIG. 19*e* of an embodiment depicting the Loop 154 and the End Stop 152 when attached to the RIS 100. A RIS Strengthen Material(s) 156 (hereinafter "RIS-SM") has been passed through the Loop 154 and comes to a stop at the End Stop 152. The End Stop 152 may be a simple blunt surface/shape that does not allow the RIS-SM 156 to pass through it and/or it can have an additional catch means, such as a threaded nut-like property for accepting a threaded end of the RIS-SM 156 and thus relatively preventing the RIS-SM 156 movement in either direction.

FIG. 19*e* depicts a frontal view of an embodiment where the RIS 100 units can be reinforced from the exterior using a variety of the ACS(s) 155. The Loop 154 in this embodiment is attached to the ACS 155 could be pre-fabricated and/or attached later via some connection means, such as a connecting means whereby a designated end design of the Loop 154 has the ability to be inserted, turned and locked into the ACS 155 (not shown, but similar to a twist-lock ahead or similar). Further the Loop 154 could connect to the RIS 100 even without the ACS 155 and where the Loop 154 is connected directly into, onto, or around, say the structural coil 102 or the like. The Loop 154 could also be pre-attached and/or hinged (see dotted rotation path line 912) from the RIS 100 where the Loop 154 could also help in fastening the RIS 100 units together by inserting the connecting mechanism through the two interlocking RIS 100 units.

The Loops 154 allow for attaching RIS-SM 156 to the outside of the RIS 100 and/or HOS 200. The RIS-SM 156 could be a rigid pipe such as those constructed of relatively water-resistant steel and/or, depending on the size, the RIS-SM 156 could be constructed of concrete with steel rebar cores that attach along the outside of the RIS 100 to help strength and minimize bending and can be stopped and/or capped to strengthen the connection with caps (not shown). In another embodiment, the RIS-SM 156 could be larger than the Loops 154 where the Loops 154 are instead a mechanism to tie a connection to the RIS-SM 156, where a particular RIS-SM 156 could be significantly larger than inside diameter of a particular Loop 154 or series of Loops 154 (not shown).

The RIS-SM 156 can have a number of items attached and/or part of the fabrication. When the RIS-SM 156 is a rod-like unit, say of steel for instance, the RIS-SM 156 could have a Rotating BackStop 151, where the Rotating BackStop 151 can be turned to run parallel with the RIS-SM 156, thus allowing the RIS-SM 156 to pass through a particular Loop 154. In some embodiments and instances, the Rotating BackStop 151 can be turned by some means, say by a tool, gravity, pressure, weight, imbalance, and/or a Rotating BackStop conditionally means, to prevent the RIS-SM 156 from being able to pass through a particular Loop 154, back through a particular Loop 154, through all Loops 154 and/or the like.

In addition, a Retracting Catch 177, say similar to a typical umbrella with a spring-like retractable catch along the shaft that can be used to let the RIS-SM pass in one particular direction through a particular Loop 154 and/or Loops 154, but not backward via an engaging means, say by a tool, gravity, pressure, weight, imbalance, and/or a Retracting Catch conditionally means, such as always ready to engage via a spring mechanism. There could also be methods and/or conditions to disengage the Rotating BackStops 151 and the Retracting Catches 177, so that the RIS 100 units can be adjusted, flexed, maneuvered, and/or taken apart as needed.

In another embodiment, the RIS-SM 156 could be a steel cable that is strung through and/or connect to a series of loops 154 or a particular Loop 154, where the cables are fabricated with protective materials that are appropriate for the environment, say salt water usage; and where the steel cables (or similar) would help add rigidity when and where attached along the outside of the HOS 200 and/or at a particular section of the RIS 100 units. Further, where the cables could then be anchored at the top and bottom by something other than the HOS 200, say be an anchor, the anchoring system 144, the tethers 142, the tethering system, and the like. In some embodiments, the cables are the tethers and part of the tethering system. In an embodiment, the cables could also employ the hydraulic arms that may or may not be attached to the anchoring system 144, as described in FIG. 4*b*.

In an embodiment, the steel cables and/or the tethers 142 could even be attached to robotic submarines 700, boats and the like that could be utilized to pull the HOS 200 as needed during changes in underwater current, interior pressures, and the like. In another embodiment, the RIS-SM 156 could be rope like material that is strung through the loops 154, and where it works similar to the previous steel cable embodiment, functionality, capabilities and the like.

FIG. 20*a* depicts a frontal view of an embodiment of another connector means (e.g. joint connector means) referred to as a Hinged Clamp Strap 191 (hereinafter "HCS"). The HCS 191 could utilize a variety of adjustment means, in this depiction the adjustment means has a spring loaded hinge 181*a* attached to a particular HCS 191*a* and another spring loaded hinge 181*b* attached to a particular HCS 191*b*.

The HCS 191 in general could be applied before deployment into the sea water 136 with tools or could be designed to be tool-less or a relatively tool-less system where the user 20 could simply open the jaws on the HCS 191 and place the HCS 191 where needed. For instance, say around the inserted-twist connection, the overlapping-twist connection, and/or a similar type of connection of the two RIS 100*a* and 100*b* units to help prevent the units from coming apart, breached, damaged; and/or to support/attach additional hardware, sensors, RFIDs, power sources, cables, wires, and/or the like. The Loop 154 and the End Stop 152 can also be attached to the HCS 191. The HCS 191 can come in variety of shapes, sizes, diameters, materials such as metals and/or plastics, and can have a variety of different types of Loops 154 and a variety of different types of End Stops 152 attached.

FIG. 20*b* is a frontal view depicting the HCS 191*b* for typically clamping together two FCS 100 units that also interlocked. The HCS 191*b* helps reinforce the underlying connection between the RIS 100 units and also provides hardware, such as the Loops 154 and End Stops 152. Similar to the ACS 155 the Loop and the End Stop connections to the HCS can be hinged also. Similar to FIGS. 19*a-d*, FIGS. 20*a-d* also allow for the RIS-SM 156 to be passed through the Loops 154 and stop at the End Stops 152, and/or be attached to outside and the like.

FIG. 20*c* is a frontal view of the HCS 191*a* depicting the ability to bridge together two FCS 100 units that do not necessarily interlock otherwise. The HCS 191*a* is similar to two HCS 191*b* that are connected together via a plurality of HCS vertical-members 185 that create the structural strength and connection between upper and lower half of the HCS 191*a* and thus the strength of the connection for the two underlying RIS 100 units. The hinge 181*a* is taller on the HCS 191*a* to allow the hinge 181 to connect to both halves of the HCS 191*a*.

In addition, there can be a HCS membrane 183 to help seal any joints underneath. Further, the HCS membrane 183 can have an adhesive and/or waterproofing product applied to the inside. The HCS membrane 183 is depicted on the inside of the HCS 191 in FIG. 20*c*, but could be on the outside similar to the RIS Collar 180, but attached. The ability to have either an inside or an outside HCS membrane 183 would apply to the other similar collars/straps.

Similar to the ACS 155, the HCS 191 does not have to be balanced symmetrical with either the same part, types of parts, and/or number of parts, say of the Loops 154 and/or End Stops on each side; can have a variety of different configurations of Loops 154 and End Stops. Further, the HCS 191 does not have to have either the Loop 154 or the End Stop 152 on a particular side or on any of the sides of the ACS 155.

FIG. 20*d* is a top or bottom view of an embodiment depicting the HCS 191 with two symmetrically placed Loops 154 and two symmetrically places End Stops 152. The HCS 191 can be pre-fabricated in a range of inside diameters appropriate for the RIS 100 units and the like. The HCS 191 can be opened at the hinge 181*b* and be secured shut with a HCS catch bar 195 in a HCS overlap 189 section.

FIG. 20*e* is a perspective view of an embodiment of the HCS 191 in an open position along the hinge 181*b* before wrapping in around the RIS 100 unit. FIG. 20*f* is a cutaway and truncated perspective view of the HCS overlap 189 section, where a HCS catch 187 can be employed to catch the HCS catch bar 195, similar to a metal leash clip Style C with a swivel for a secure lock on a dog leash. In another embodiment, the HCS overlap 189 section could have a locking mechanism attached (not show) and locked together with a say a lock and key mechanism, paddle lock with a loop type connection, and/or the like. In another embodiment the HCS overlap could be attached with other means, say with a snap, bolt, hasp, hook, adhesives, twist-lock, and the like.

Figure 21A:
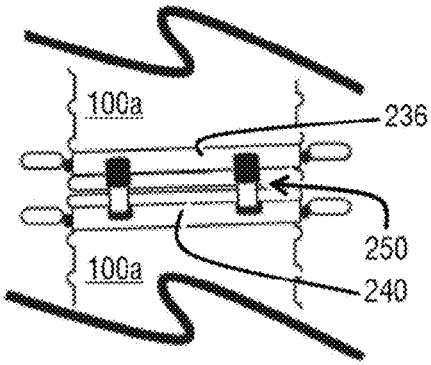
FIG. 21*a* depicts a truncated frontal view of embodiment of another connect (e.g. joint connector) where two collars snap together with a connector buckle mechanism similar to a ski boot buckle.

FIG. 21*a* depicts a truncated frontal view of embodiment of another connect (e.g. joint connector) where two collars snap together with a connector buckle mechanism similar to a ski boot buckle. A top ski boot-like connector collar 236 (hereinafter "T-SBCC" 236) which is strapped around a particular RIS 100*a* unit and is buckled together with a bottom ski boot-like connector collar 240 (hereinafter "B-SBCC" 240) which is strapped around a particular RIS 100*b* unit. The connection between the two halves creates a ski boot-like connection 250 (hereinafter "SBC" 250).

Figure 21B:
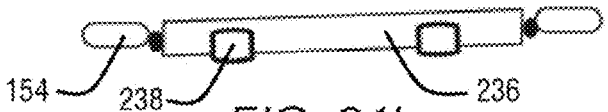
FIG. 21*b* is a frontal view depicting the T-SBCC 236 and a ski boot-like connector catch half mechanism 238 (hereinafter SBC-CHM" 238) which is typically utilized for catching the buckle from the B-SBCC 240 and clamping the two collar units together to finish the SBC 250.

FIG. 21*b* is a frontal view depicting the T-SBCC 236 and a ski boot-like connector catch half mechanism 238 (hereinafter SBC-CHM" 238) which is typically utilized for catching the buckle from the B-SBCC 240 and clamping the two collar units together to finish the SBC 250. The T-SBCC 236 and the B-SBCC 240 can also help reinforce the underlying connection between the RIS 100*a* and RIS 100*b* units that may or may not have the inner structural coils 102s and/or may or may not be interlocked. In addition, there can be a T-SBCC membrane 255 connected to the T-SBCC 236 which is not shown (inside or outside), and could be similar to say the HCS membrane 183 to help seal any joints underneath. Further, the T-SBCC membrane 255 can have an adhesive and/or waterproofing product applied to the inside.

Figure 21C:
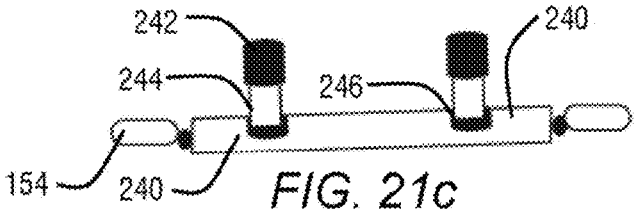
FIG. 21*c* is a frontal view of the B-SBCC 240 depicting a ski boot-like connector buckle 242 (hereinafter "SBCB" 242) which is connected to a ski boot-like connector rotating arm 244 (hereinafter "SBC-RA" 244) which is connected to the B-SBCC 240 with a ski boot-like connector base hinge 246 (hereinafter SBC-BH" 246.

FIG. 21*c* is a frontal view of the B-SBCC 240 depicting a ski boot-like connector buckle 242 (hereinafter "SBCB" 242) which is connected to a ski boot-like connector rotating arm 244 (hereinafter "SBC-RA" 244) which is connected to the B-SBCC 240 with a ski boot-like connector base hinge 246 (hereinafter SBC-BH" 246. The T-SBCC 236 and the B-SBCC 240 can also provide connected hardware, such as the Loops 154 and the End Stops 152. Similar to the ACS 155 and the HCS 191, the Loop 154 and the End Stop 152 connections to the T-SBCC 236 and the B-SBCC 240 can be hinged and rotate. Similar to FIGS. 19*a-d* and FIGS. 20*a-d*, the FIGS. 21*a*-22*d* also allow for the RIS-SM 156 to be passed through the Loops 154 and stop at the End Stops 152, and/or be attached to outside and the like.

Figure 21E:
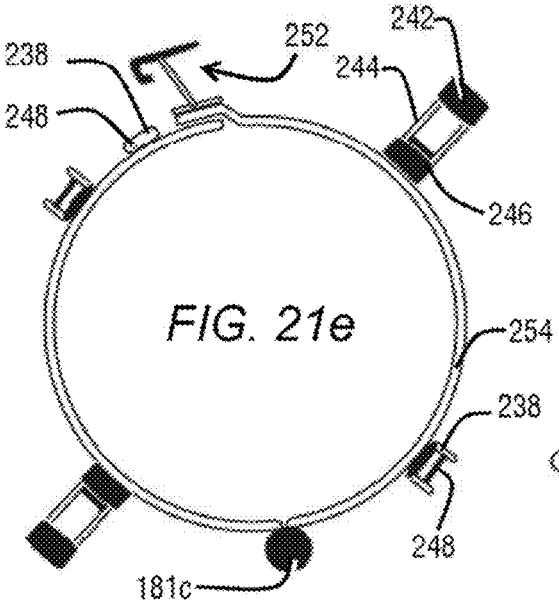
FIG. 21*e* is a top or bottom view of an embodiment depicting a Special Ski Boot-like Connector Collar 254 (hereinafter "S-SBCC" 254) with hardware from both the T-SBCC 236 and the B-SBCC 240.
Figure 21D:
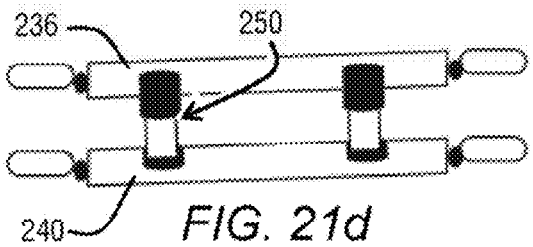
FIG. 21*d* is a frontal view depicting the completed SBC 250 connection of the T-SBCC 236 and the B-SBCC 240.

FIG. 21*d* is a frontal view depicting the completed SBC 250 connection of the T-SBCC 236 and the B-SBCC 240. The SBC 250 connection between the T-SBCC 236 and the B-SBCC 240 can add structural strength and thus strengthen the connection for the two underlying RIS 100 units. In an embodiment, the SBC 250 can be constructed the same or similarly, and/or can work the same or similarly to Abraham Lichowsky's "Ski Boot Tightening Buckle" U.S. Pat. No. 4,193,171 and herein entirely incorporated by reference.

FIG. 21*e* is a top or bottom view of an embodiment depicting a Special Ski Boot-like Connector Collar 254 (hereinafter "S-SBCC" 254) with hardware from both the T-SBCC 236 and the B-SBCC 240. The S-SBCC 254 could also have the Loops 154 and the End Stops 152 connected to the outside which is not shown in FIG. 21*e*, but similar to say the ACS 155 and the HCS 191. The S-SBCC 254, the T-SBCC 236, and the B-SBCC 240 can all be pre-fabricated in a range of inside diameters appropriate for the particular RIS 100 units and the like. The S-SBCC 254, the T-SBCC 236, and the B-SBCC 240 can all be opened at a hinge 181*c* and be shut with a ski boot-like connector buckle half mechanism 252 (hereinafter "SBCB-HM" 252).

The S-SBCC 254, the T-SBCC 236 and the B-SBCC 240 could all be applied before deployment into the sea water 136 with tools or could be designed to be tool-less or a relatively tool-less system where the user 20 simply opens the jaws on the S-SBCC 254, the T-SBCC 236, and the B-SBCC 240 at the hinge 181*c* and places the collar(s) upon the outside of a particular RIS 100 and/or HOS 200 joint where needed.

The Loop 154 and the End Stop 152 can also be attached to the S-SBCC 254, the T-SBCC 236 and the B-SBCC 240. The S-SBCC 254, the T-SBCC 236 and the B-SBCC 240 can all come in variety of shapes, sizes, diameters, materials such as metals and/or plastics, and can have a variety of different types of the Loops 154 and a variety of different types of the End Stops 152 attached.

Similar to the ACS 155 and the HCS 191; the S-SBCC 254, the T-SBCC 236 and the B-SBCC 240, do not have to be balanced symmetrical with either the same part, types of parts, and/or number of parts, say of the SBC-CHM 238, SBCB-HM 252, the Loops 154 and/or the End Stops on each side; can have a variety of different configurations of the SBC-CHM 238, SBCB-HM 252, the Loops 154 and the End Stops 152. Further, the S-SBCC 254, the T-SBCC 236 and the B-SBCC 240, do not have to have any particular amount of the SBC-CHMs 238, SBCB-HMs 252, the Loops 154 or the End Stops 152 on a particular side or on any of the sides of the S-SBCC 254, the T-SBCC 236 or the B-SBCC 240.

Figure 22B:
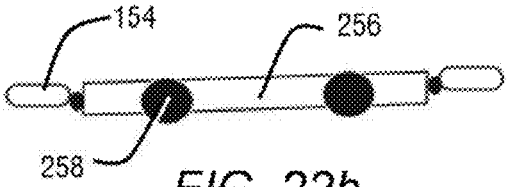
FIG. 22*b* is a frontal view depicting the T-CSC 256 and a "strap connector knob catch" 258 (hereinafter "SCKC" 258) which is typically utilized for catching a "strap connector loop" 262 (hereinafter "SCL" 262) from the B-CSC 260 in FIG. 22*c* and thus connecting the two collar units together to finish the SKCC 266.
Figure 22C:
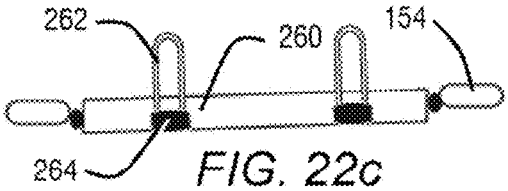
FIG. 22*c* is a frontal view of the B-CSC 260 depicting the SCL 262 which is connected to a strap connector base connection 264 (hereinafter "SCBC" 264).
Figure 22A:
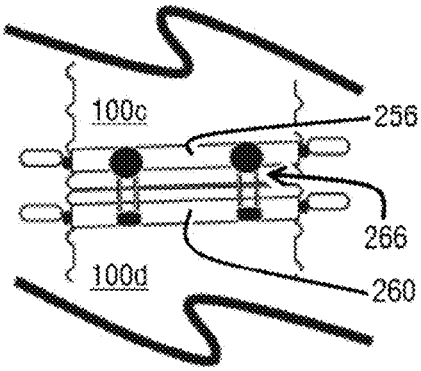
FIG. 22*a* depicts a truncated frontal view of embodiment of another connector (e.g. joint connector) where two collars connect together via a strap and knob catch mechanism.

FIG. 22*a* depicts a truncated frontal view of embodiment of another connector (e.g. joint connector) where two collars connect together via a strap and knob catch mechanism. A "top collar for strap connector" 256 (hereinafter "T-CSC" 256) is strapped around a particular RIS 100*c* unit and is buckled together with a "bottom collar for strap connector" 260 (hereinafter "B-CSC" 260) which is strapped around a particular RIS 100*d* unit. The connection between the two halves creates the strap and knob catch connection 266 (hereinafter "SKCC" 266).

FIG. 22*b* is a frontal view depicting the T-CSC 256 and a "strap connector knob catch" 258 (hereinafter "SCKC" 258) which is typically utilized for catching a "strap connector loop" 262 (hereinafter "SCL" 262) from the B-CSC 260 in FIG. 22*c* and thus connecting the two collar units together to finish the SKCC 266. The T-CSC 256 and the B-CSC 260 can also help reinforce the underlying connection between the RIS 100*c* and RIS 100*d* units that may or may not have the inner structural coils 102s and may or may not be interlocked. In addition, there can be a T-CSC membrane 268 connected to the T-CSC 256 which is not shown, but could be similar to say the T-SBCC membrane 255 and the HCS membrane 183 to help seal any joints underneath. Further, the T-CSC membrane 268 can have an adhesive and/or waterproofing product applied to the inside.

FIG. 22*c* is a frontal view of the B-CSC 260 depicting the SCL 262 which is connected to a strap connector base connection 264 (hereinafter "SCBC" 264). The T-CSC 256 and the B-CSC 260 can also provide connected hardware, such as the Loops 154 and the End Stops 152. Similar to the ACS 155, the HCS 191, the T-SBCC 236, and the B-SBCC 240; the Loop 154 and the End Stop 152 connections to the T-CSC 256 and the B-CSC 260 can be hinged and rotate.

Figure 22D:
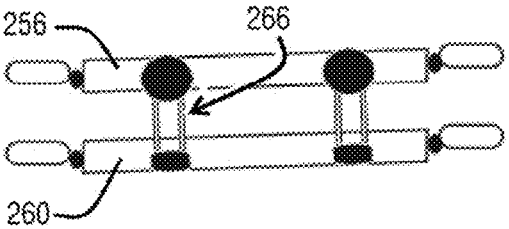
FIG. 22*d* is a frontal view depicting the completed SKCC 266 connection of the T-CSC 256 and the B-CSC 260. The SKCC 266 connection between the T-CSC 256 and the B-CSC 260 can add structural strength and thus strengthen the connection for the two underlying RIS 100 units.

FIG. 22*d* is a frontal view depicting the completed SKCC 266 connection of the T-CSC 256 and the B-CSC 260. The SKCC 266 connection between the T-CSC 256 and the B-CSC 260 can add structural strength and thus strengthen the connection for the two underlying RIS 100 units. Similar to the S-SBCC 254 in FIG. 21*e*, the T-CSC 256 and the B-CSC 260 can have a range of attached hardware. The T-CSC 256 and the B-CSC 260 could also have the Loops 154 and the End Stops 152 connected to the outside and similar to say the ACS 155 and the HCS 191. The T-CSC 256 and the B-CSC 260 can all be pre-fabricated in a range of inside diameters appropriate for the particular RIS 100 units and the like. The T-CSC 256 and the B-CSC 260 can all be opened at a hinge 181*d* (not shown, but similar to 181*c*) and can be shut with the SBCB-HM 252 or similar.

There can also be a Special-CSC 270 (hereinafter "S-SCS" 270), similar to the S-SBCC 254. The S-SCS 270, the T-CSC 256 and the B-CSC 260 could all be applied before deployment into the sea water 136 with tools or could be designed to be tool-less or a relatively tool-less system where the user 20 simply opens the jaws on the S-SCS 270, the T-CSC 256, and the B-CSC 260 at the hinge 181*d* and places the collar(s) around a particular RIS 100 unit and/or the HOS 200 where needed. The Loop 154 and the End Stop 152 can also be attached to the S-SCS 270, the T-CSC 256 and the B-CSC 260. The S-SCS 270, the T-CSC 256 and the B-CSC 260 can all come in variety of shapes, sizes, diameters, materials such as metals and/or plastics, and can have a variety of different types of the Loops 154 and a variety of different types of the End Stops 152 attached.

Similar to the ACS 155 and the HCS 191; the S-SCS 270, the T-CSC 256 and the B-CSC 260 can be employed around the inserted-twist connection, the overlapping-twist connection, and/or a similar type of connection of the two RIS 100*a* and 100*b* units to help prevent the units from coming apart, breached, damaged; and/or to support/attach additional hardware, sensors, RFIDs, power sources, cables, wires, and/or the like.

In addition, and similar to the ACS 155 and the HCS 191; the S-SCS 270, the T-CSC 256 and the B-CSC 260, do not have to be balanced symmetrical with either the same part, types of parts, and/or number of parts, say of the SCKC 258; the SCL 262 and the SCBC 264; the SBC-CHM 238, the SBCB-HM 252, the Loops 154 and/or the End Stops 152 on each side; can have a variety of different configurations of the SCKC 258; the SCL 262 and the SCBC 264; the SBC-CHM 238; SBCB-HM 252; the Loops 154 and the End Stops 152. Further, the S-SCS 270, the T-CSC 256 and the B-CSC 260, do not have to have any particular amount of the SCKC 258; the SCL 262 and the SCBC 264; the SBC-CHM 238, the SBCB-HM 252, the Loops 154 and/or the End Stops 152; on a particular side or on any of the sides of the S-SCS 270, the T-CSC 256 or the B-CSC 260.

Figures 23A, 23B, 23C, 23D, 23E, 23F:
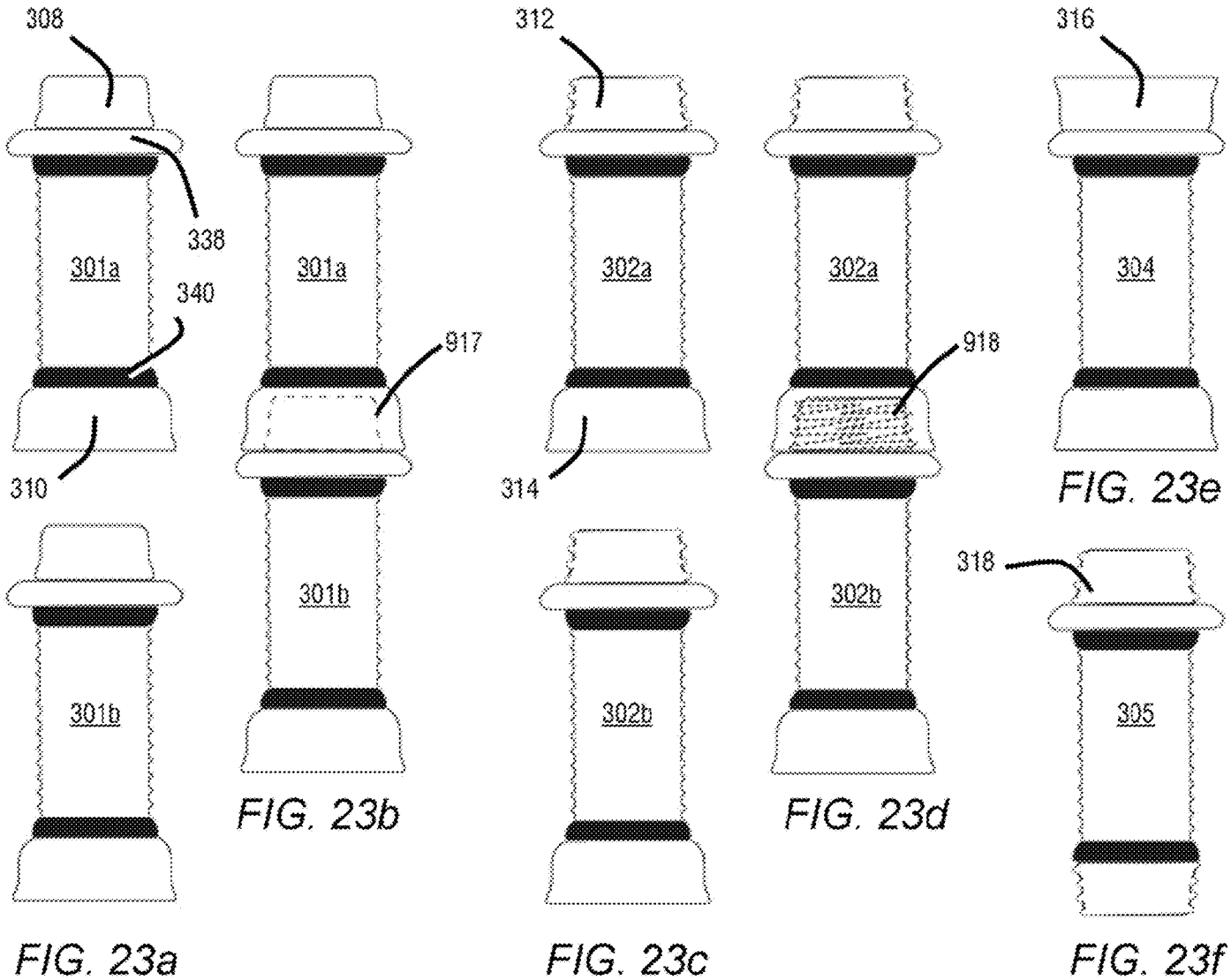
FIG. 23*a* is a frontal view depicting an embodiment of a special RIS 100 unit with pre-fabricated non-threaded connectors already pre-attached (hereinafter referred to as a "RIS-PC 301).
FIG. 23*b* is a frontal view depicting the completed interconnection between the RIS-PC 301*a* and the RIS-PC 301*b* where the non-threaded male 308 end on the top portion of the RIS-PC 301*b* was inserted up into the rim 338.
FIG. 23*c* is a frontal view depicting an embodiment of a special RIS 100 unit with pre-fabricated threaded connectors already pre-attached (hereinafter referred to as a "RIS-PC 302).
FIG. 23*d* is a frontal view depicting the completed interconnection between the RIS-PC 302*a* and the RIS-PC 302*b* where the threaded male 312 end on the top portion of the RIS-PC 302*b* was inserted and threaded up to the rim 338.
FIG. 23*e* is a frontal view depicting an embodiment of a special RIS 100 unit with pre-fabricated female connectors already pre-attached at both ends (hereinafter referred to as a "RIS-PC 304).
FIG. 23*f* is a frontal view depicting an embodiment of a special RIS 100 unit with pre-fabricated male connectors already pre-attached at both ends (hereinafter referred to as a "RIS-PC 305).

FIG. 23*a* is a frontal view depicting an embodiment of a special RIS 100 unit with pre-fabricated non-threaded connectors already pre-attached (hereinafter referred to as a "RIS-PC 301). In this embodiment a particular RIS-PC 301*a* has a non-threaded male 308 end attached to a rim 338 which limits the amount of insertion and the rim 338 is connected to the RIS-PC 301*a*. A gasket 340 helps seal the joint. A non-threaded female 310 end also connects to the RIS-PC 301*a* and the joint is sealed by the gasket 340. Beneath the RIS-PC 301*a* is another similar RIS-PC 301*b* before the two units are interconnected. The pre-attached connectors can be attached by collars, straps, pressure connections, but generally with an adhesive.

FIG. 23*b* is a frontal view depicting the completed interconnection between the RIS-PC 301*a* and the RIS-PC 301*b* where the non-threaded male 308 end on the top portion of the RIS-PC 301*b* was inserted up into the rim 338. A dotted line 917 depicts an outline of the non-threaded male 308 end on the top portion of the RIS-PC 301*b* inside the RIS-PC 301*a*. These non-threaded interconnections may or may not utilize pressure, adhesives and the like, but generally would be created before deployment and incorporate adhesives and pressure to test the connection strengths for any breaches, weaknesses, and/or leaks before deployment.

FIG. 23*c* is a frontal view depicting an embodiment of a special RIS 100 unit with pre-fabricated threaded connectors already pre-attached (hereinafter referred to as a "RIS-PC 302). In this embodiment a particular RIS-PC 302*a* has a threaded male 312 end pre-attached to the rim 338 which limits the amount of insertion and the rim 338 is connected to the RIS-PC 302*a*. A threaded female 314 end is also pre-attached to the RIS-PC 301*a* and the joint is sealed by the gasket 340. Beneath the RIS-PC 302*a* is another similar RIS-PC 302*b* before the two units are interconnected.

FIG. 23*d* is a frontal view depicting the completed interconnection between the RIS-PC 302*a* and the RIS-PC 302*b* where the threaded male 312 end on the top portion of the RIS-PC 302*b* was inserted and threaded up to the rim 338. A dotted line 918 depicts the outline of the threaded male 308 end on the top portion of the RIS-PC 302*b* inside the RIS-PC 302*a*. These threaded interconnections may or may not utilize pressure, adhesives and the like. The benefit of the threading allows the RIS units to interconnected relatively easier after deployment and also allows for the Inserted Materials 170 to flow from the RIS-PC 302*b* into and through the RIS-PC 302*a*

FIG. 23*e* is a frontal view depicting an embodiment of a special RIS 100 unit with pre-fabricated female connectors already pre-attached at both ends (hereinafter referred to as a "RIS-PC 304). In this embodiment, the RIS-PC 304 could have a variety of female connectors pre-attached, where say each end is threaded, each end is non-threaded, or where one end is threaded and one is not. These threaded interconnections and non-threaded interconnections may or may not utilize pressure, adhesives, and the like. The benefit of the threading allows the units to interconnected after deployment and also allows for the Inserted Materials 170 to flow from the RIS-PC 302*b* into and through the RIS-PC 302*a*

FIG. 23*f* is a frontal view depicting an embodiment of a special RIS 100 unit with pre-fabricated male connectors already pre-attached at both ends (hereinafter referred to as a "RIS-PC 305). In this embodiment, the RIS-PC 305 could have a variety of male connectors pre-attached, where say each end is threaded, each end is non-threaded, or where one end is threaded and one is not. Further, due to the flexibility of the typical RIS unit 100 and its typical structural coil, there could be embodiments where the threaded end of both the male and the female connectors could be designed to accept non-threaded ends; and the non-threaded ends could be designed to accept threaded ends.

Figures 24A, 24B:
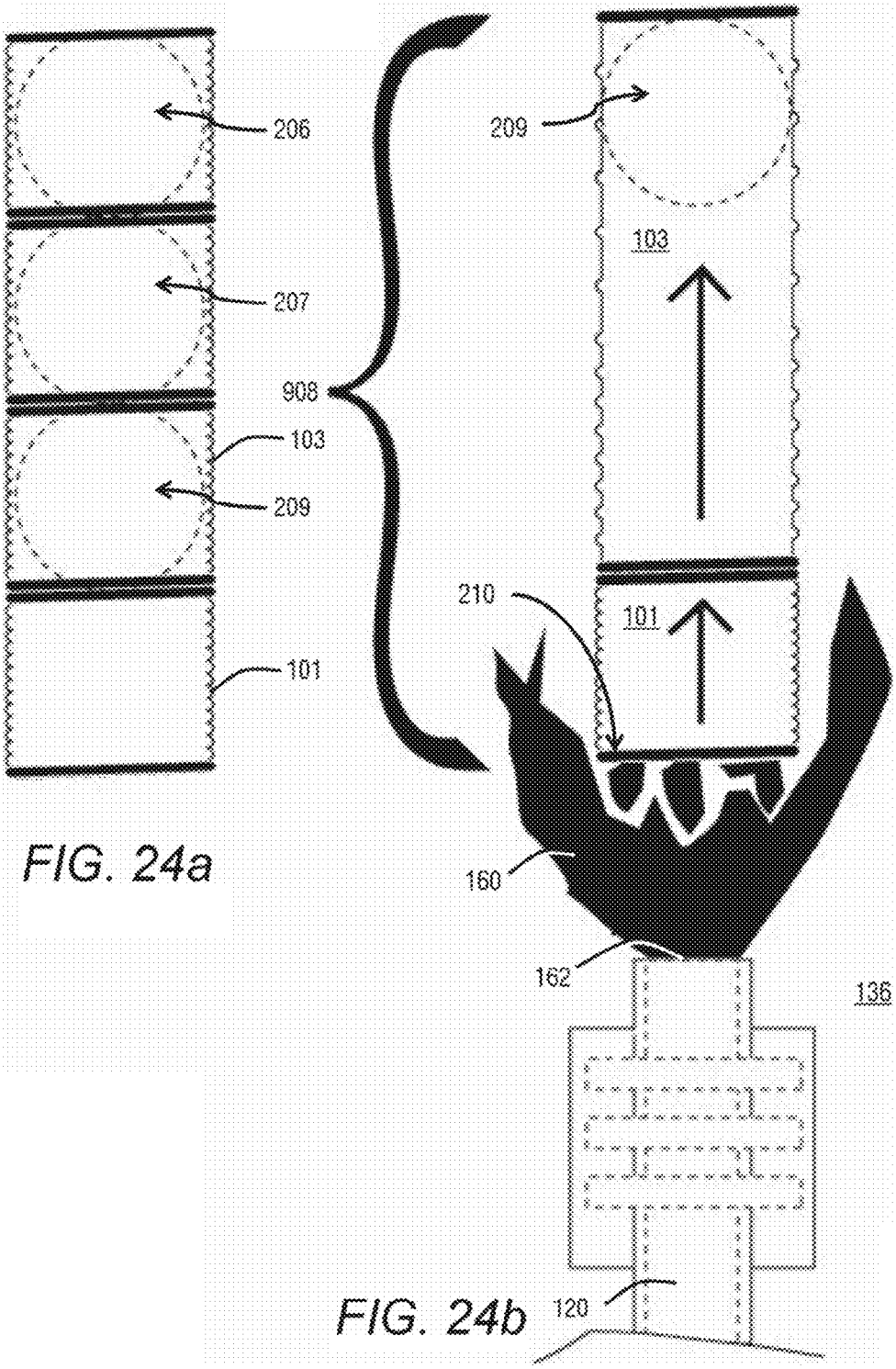
FIG. 24*a* depicts an embodiment where a Pre-inserted Control Material(s) 206 (hereinafter "PICM(s)" 206) can be pre-inserted inside the RIS 100 before filling the HOS 200 with Fluid Product(s) 160.
FIG. 24*b* depicts an embodiment where the pre-inserted buoyant material 209 in the particular RIS 103 unit is the balloon filled with air and thus the buoyant material 209 helps create a number of benefits.

FIG. 24*a* depicts an embodiment where a Pre-inserted Control Material(s) 206 (hereinafter "PICM(s)" 206) can be pre-inserted inside the RIS 100 before filling the HOS 200 with Fluid Product(s) 160. For instances, the PICM 206 could be a buoyant material 209, such as an air-filled ball or balloon-like structure (not to be confused with the CB 600) that takes the majority of the space in a fully and/or relatively compressed a particular RIS 103 unit as shown in FIG. 24*a*. The PICM 206 can be strategically placed inside the HOS 200 and the PICM 206 does not have to be inside each particular RIS 101 unit.

Some PICMs 206 can be the buoyant material 209 while other materials can be a weighted material(s) 207 that relatively drop to bottom of the HOS 200 when unobstructed. For instance, the weighted material 207 would drop to bottom of the HOS 200 to the RIS 101 unit when a lower PICM 206 that is made of the buoyant material 209 (the air-filled balloon or ball) is, say popped and/or collapses. Thus allowing the escaping air to work its way around the above dropping the PICMs 206 of the weighted material 207, such as a pre-designed amount of weight. In an embodiment, the predesigned amount of weight could either be allowed to drop to the seabed 134 before completely attaching the HOS 200 to the wellhead pipe 120 opening 162 in early deployment.

In another embodiment, some PICMs 206 (e.g. buoyant 209 and weighted 207) could be forced to the sea surface 132 from the relative pressure from the Fluid Product 160. In another embodiment, some PICMs 206 (e.g. buoyant 209 and weighted 207) could be channeled to branches 148 where it could perform a function, benefit, and/or be possibly removed. In some embodiments, the PICMs 206 (e.g. buoyant 209 and weighted 207) would each have unique IDs (e.g. RFID, VLF-IDs), and/or sensors embedded or attached, to track each individual unit.

FIG. 24*b* depicts an embodiment where the pre-inserted buoyant material 209 in the particular RIS 103 unit is the balloon filled with air and thus the buoyant material 209 helps create a number of benefits. For instances, in one embodiment the HOS 200 could be deployed in as compressed a state as possible with the specific PICM(s) 206 strategically located within the HOS 200 as in FIG. 24*a*. In this embodiment, the HOS 200 along with RIS-E would be allowed to drop below the sea surface 132 and remain relatively compressed as long as necessary to help the deployment, and subsequently cause the HOS 200 top to shoot to the sea surface 132 when a certain event and/or events help trigger the expansion.

For instances, some sections of the RIS 100 could be restricted/constricted partially or fully closed (e.g. by a collar, strap, and/or the like) to help control the pressures inside the HOS 200, designated section by section. Further, where the flow of the PICMs 206 and/or the eventual flow of Fluid Products 160 could be controlled section by section. In some embodiments, separate sections could be deployed into sea water, relatively expanded, and subsequently interconnected in the sea water 132.

In some embodiments, some of the PICMs could have a buoyancy adjustment means and/or a weight adjustment means, where the buoyancy adjustment means and/or the weight adjustment means could be conditional and/or triggered at different events, stages and/or at different sea depths. For instance, some buoyant materials 209 could be constructed in a manner that caused it to collapse, pop, and/or move a particular direction (say up/down) within the HOS 200 a certain depths and/or triggered by other events, such as the opening and closing of branches 148 along the HOS 200.

A bottom rim 210 could be weighted down and/or anchored at, say the measurable safe distance above the wellhead pipe 160 opening 162, or at a "measurable distance determined to be sufficient to allow the Fluid Product 160 pressure to force the HOS 200 to shoot to the surface" (referred to as the "Measurable Distance Determined to be Sufficient Pressure" or hereinafter "MDDSP").

This expansion of the HOS 200 and/or similar to the sea surface 132 would be aided by the PICMs 206 that are buoyant materials 209 that could conditionally either remain inflated and rise to the sea surface 132 or leak/collapse/pop where the air escapes to the sea surface 132, but. An advantage of this invention and embodiment is that these PICMs 206 that aid in the deployment with be relatively easily removed when they shoot into open air at the sea surface 132 and captured in the CR 599 pool when compared to some of the restrictive riser systems that were deployed by BP® and the Gulf of Mexico Response Team.

As the flow of the Fluid Products 160 begins to relatively straighten out the HOS 200 to the sea surface 132 (similar to FIGS. 6*a*-6*c*), the RIS-SM 156 can be added and/or attached as and where needed to help strength the HOS 100. In some embodiments, the PICMs 206 are employed before the HOS 200 is connected to the wellhead pipe 120, the STH 201, and/or similar. In this embodiment, once the Fluid Product 160 appears to be reliably flowing freely up to the sea surface 132 through the HOS 200 with minimal resistance from any bends in the HOS 200 and the HOS 200 has been adequately strengthened out with any additional and/or necessary structural elements, such as by RIS-SM 156, a number of attachment methods can be tested and/or employed at the I-RIS 140. In some embodiments, the PICMs 206 can be added throughout the STACCO 99 and through the timeframe of deployment. In some embodiments, the PICMs 206 can be later introduced into a particular section of the STACCO 99, the HOS 200, the RIS 100, and/or similar.

Figure 25A:
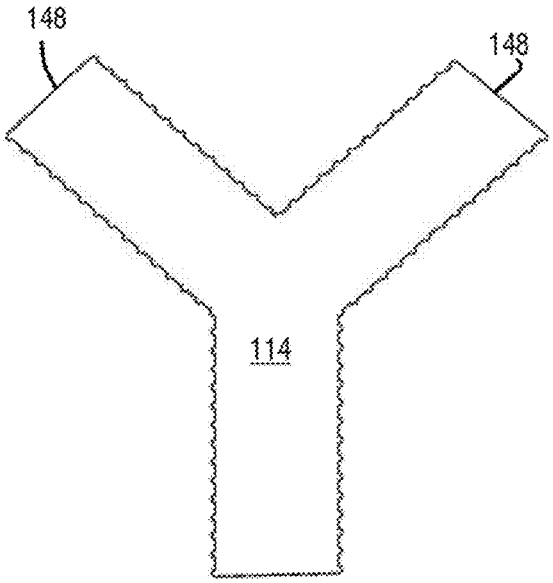
FIG. 25*a* depicts an embodiment of a special RIS 100 unit that allows for a number of branches 148.

FIG. 25*a* depicts an embodiment of a special RIS 100 unit that allows for a number of branches 148. In addition to the special I-RIS 140 and the RIS-E end pieces, there can be special embodiment of the RIS 100 pieces or units that allow for these branches 148 for channeling the Fluid Product 160 into a plurality of channels or directions. Some directions may be intentional be or become dead-ends, some directions may to all the way to the sea surface 132, some directions may lead to CB 600s, or the like. The branches 148 can be as simple as a "Y-shape" 114 that creates two separate branches 148 for connecting two separate and subsequent RIS 100 units to continue the run of the HOS 200, but now in two directions.

There could also be a plurality of branches 148 and a variety of connection types for connecting subsequent RIS 100 units similar to those junctions and connections types created and employed, say similar to how there is a variety of PVC parts and connection types for household plumbing that can be interconnected and utilized. The plurality of RIS 100 units all stemming form, say a singular base I-RIS 140 from the wellhead pipe 120 opening 162 can perform a number of purposes. All the separate RIS 100 branches 148 could run to the sea surface 132 to fill multiple CRs 599, and/or to help minimize pressure within the HOS 200 system itself. Some RIS 100 branches 148 could be closed off (capped off) and/or opened as needed to reduce and/or build pressure inside the HOS 200 system and/or within a particular RIS 100 branch 148 that is opened at the sea surface 132.

In one embodiment, employing the branching 148 would require attaching an inner and outer "Y-shape" 114 unit above the sea surface 132 before deploying the particular RIS 100 into the sea water 136 to, say minimize potential complications trying to attach the RIS 100 units later or trying to wrap an Inner RIS 100 with an Outer RIS 100 after it's been deployed. In another embodiment, the "Y-shaped" 114 unit can simply be collapsed and/or removed, since it is made of flexible material. In addition, a hose attached to pumps can be snaked down the interior of the HOS 200 from the top to promote the Fluid Product 160 flow of gas and/or oil to the sea surface 132 (e.g. see more details on a Catheter 124, and the vacuum hose 122).

Figure 25B:
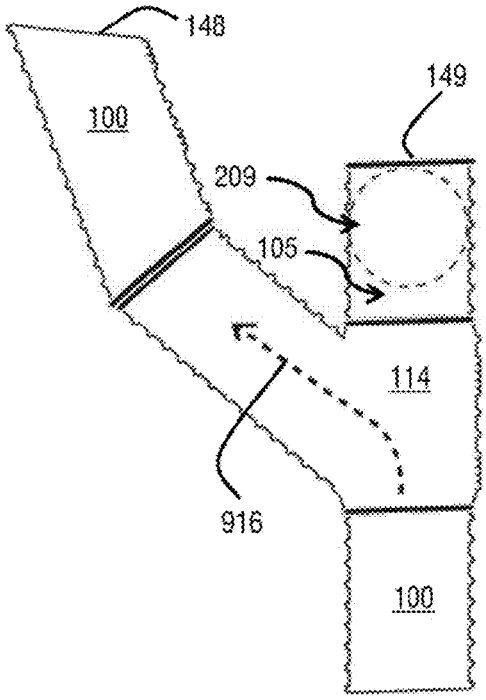
FIG. 25*b* depicts an embodiment whereby the buoyant material 209 can be captured by a special Terminating RIS 105 section.

FIG. 25*b* depicts an embodiment whereby the buoyant material 209 can be captured by a special Terminating RIS 105 section. This special Terminating RIS 105 section can be partially and/or fully opened and/or closed to promote the flow of both PICMs 206 and Fluid Products 160. By closing off the special Terminating RIS 105 the flow of the Fluid Product 160 can be rerouted to a particular branch 148 along the dotted line and arrowhead (depicted as a 916) in FIG. 25*b*.

Figure 25C:
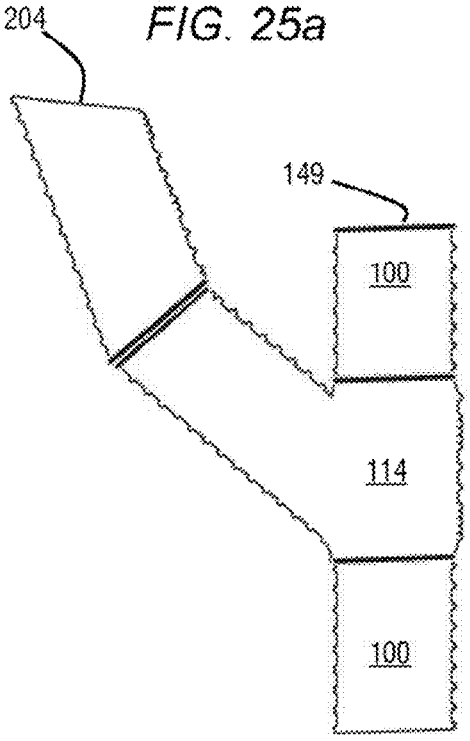
FIG. 25*c* depicts an embodiment where the "Y-shape" 114 could be utilized to cover a leak underneath (not seen under "Y-shape" 114 in FIG. 25*c*) and thus rerouting the previously escaping Fluid Product 161 now through a branch 204.
Figure 25D:
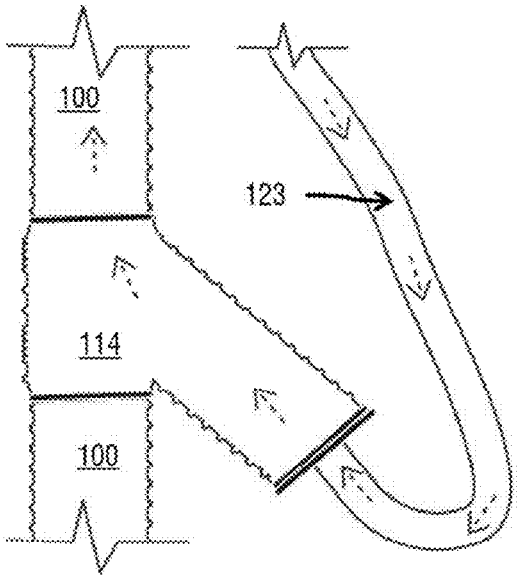
FIG. 25*d* depicts an embodiment where a "Y-shape" 114 branch 204 could be connected to a hose 123 for pumping elements into the STACCO 99 system.

FIG. 25*c* depicts an embodiment where the "Y-shape" 114 could be utilized to cover a leak underneath (not seen under "Y-shape" 114 in FIG. 25*c*) and thus rerouting the previously escaping Fluid Product 161 now through a branch 204. The branch 204 also helps prevent pressure from building up underneath the "Y-shape" 114. FIG. 25*d* depicts an embodiment where a "Y-shape" 114 branch 204 could be connected to a hose 123 for pumping elements into the STACCO 99 system. For instances, the hose 123 could be attached to the "Y-shape" 114 branch and could have an element such as air forced through the hose 123 to promote the flow inside the HOS 200.

The other end of the hose 123 could be connected to tank of compressed air that resides near the "Y-shape" 114 branch 204 connect (not shown), say floating, on the seabed 134, and/or it could be located onboard the drillship 130 or similar at the sea surface 132. There could several benefits of forcing air and/or other elements through the HOS 200 from this connection. The elements introduced into the "Y-shape" 114 branch 204 could be regulated to adjust the volume, pressure, temperature, and the like. In some embodiments, the forced air could include the RFID pellet, the sensor pellet, the combination RFID/Sensor pellet where the pellets can each be uniquely tracked as the move throughout the HOS 200 to monitor flows and the like.

In an embodiment, there is a special RIS 100 unit referred to as a RIS-Stopcock 198 (not depicted) that constructed and functions like a traditional industry standard "stockcock" unit that can be rotated to change the flow inside of a tube. The RIS-Stopcock 198 can allow for a number of direction changing for the flow of the Fluid Product 160 and the like within the HOS 200 and similar. In one embodiment, the RIS Stopcock 198 can change the direction between two branches 148. In one embodiment, the RIS Stopcock 198 can stop the flow all together.

Figures 26A, 26B, 26C, 26D, 26E:
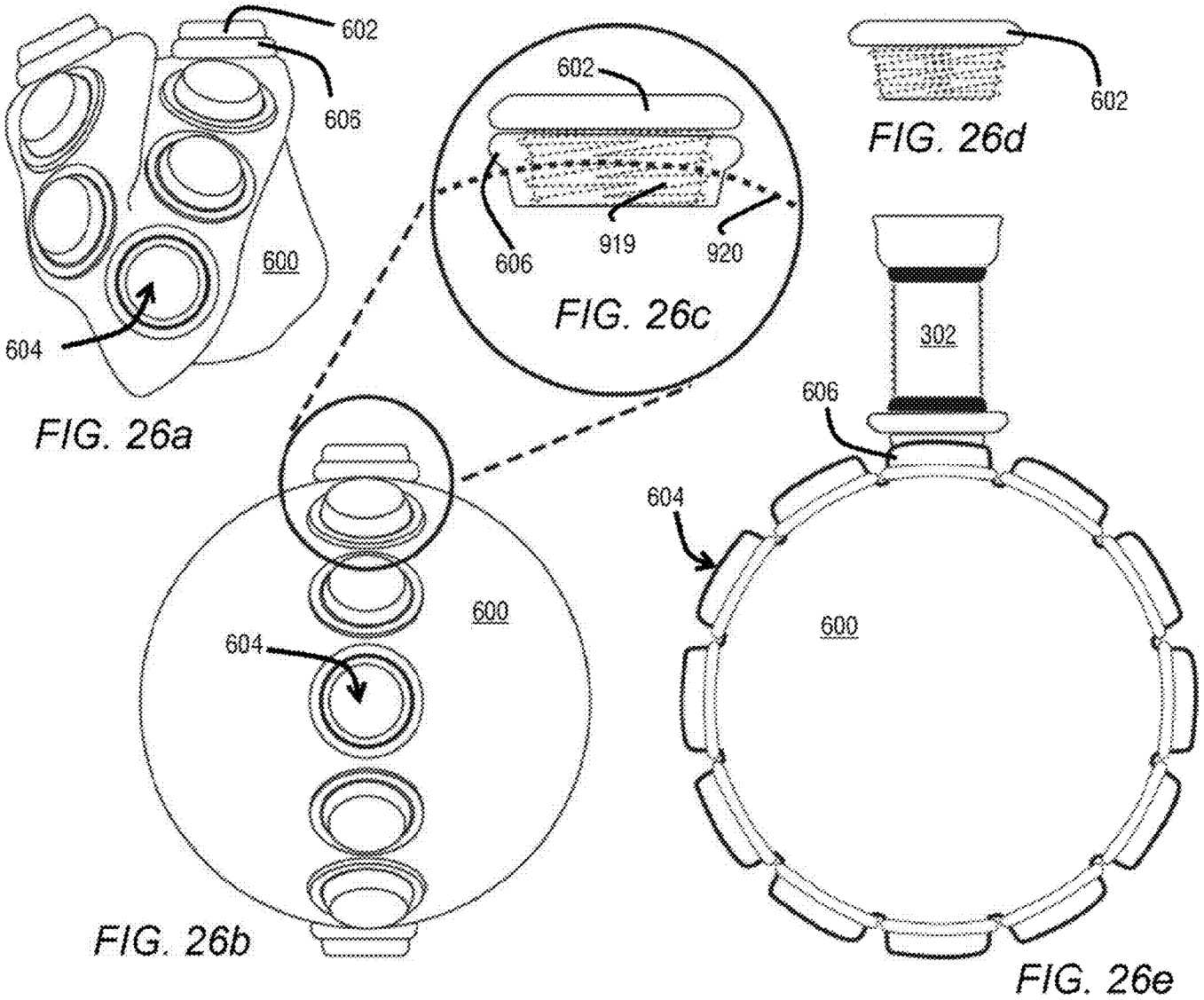
FIG. 26*a* is a perspective view of an embodiment of a special collection unit referred to as the Collection Balloon 600 ("CB" 600) in a relatively deflated state.
FIG. 26*b* is a side view of an embodiment of the CB 600 in a relatively inflated state where the CB portals 604 are arranged around the parameter and relatively aligned in this embodiment.
FIG. 26*c* is an enlarged truncated frontal view from FIG. 26*b* of an embodiment of the CB Cap 602 screw into the CB portal 604 up to the CB portal rim 606.
FIG. 26*d* is an enlarged frontal view of an embodiment of just the CB Cap 602.
FIG. 26*e* is a frontal view of an embodiment of the CB 600 in a relatively inflated state where the CB portals 604 are arranged around the parameter and relatively aligned 90 degrees differently in this view when compared to FIG. 26*b*.

FIG. 26*a* is a perspective view of an embodiment of a special collection unit referred to as the Collection Balloon 600 ("CB" 600) in a relatively deflated state. A Collection Balloon Cap 602 (hereinafter "CB Cap" 602) has been screwed into a CB portal 604 up to a CB portal rim 606. The CB portal 604 refers generally to an entryway/gateway or window that allows for interconnectivity with and into the CB 600 from outside the CB 600.

FIG. 26*b* is a side view of an embodiment of the CB 600 in a relatively inflated state where the CB portals 604 are arranged around the parameter and relatively aligned in this embodiment. However, the CB portals 604 do not have to aligned, symmetrical, balanced, and can be arranged wherever convenient and/or appropriate. In some embodiments, a new CB portal 604 could be applied anywhere to the outside of the CB 600 where no CB portal 604 was currently, with, say an adhesive where the required entryway/gateway/hole dimensions could be added later, if and as necessary.

FIG. 26*c* is an enlarged truncated frontal view from FIG. 26*b* of an embodiment of the CB Cap 602 screw into the CB portal 604 up to the CB portal rim 606. A dotted line 920 depicts an outer surface of the CB 600 and another dotted line 919 depicts a threading channel inside the connection. FIG. 26*d* is an enlarged frontal view of an embodiment of just the CB Cap 602.

FIG. 26*e* is a frontal view of an embodiment of the CB 600 in a relatively inflated state where the CB portals 604 are arranged around the parameter and relatively aligned 90 degrees differently in this view when compared to FIG. 26*b*. In this embodiment, the CB Cap 602 has been replaced with the RIS-PC 302 unit. In this embodiment the RIS-PC 302 has a threaded male 312 end now interconnected into the CB portal rim 606 which limits the amount of insertion. In another embodiment, the CB portal 604 could have exposed connectors similar to the threaded male 312 and where a threaded female 314 end could connect to the CB 600 (not shown). This last embodiment may lend itself better for situations where there is already significant pressure and/or flow coming from inside the CB 600 and through the connection.

Figures 27A, 27B, 27C, 27D, 27E, 27F:
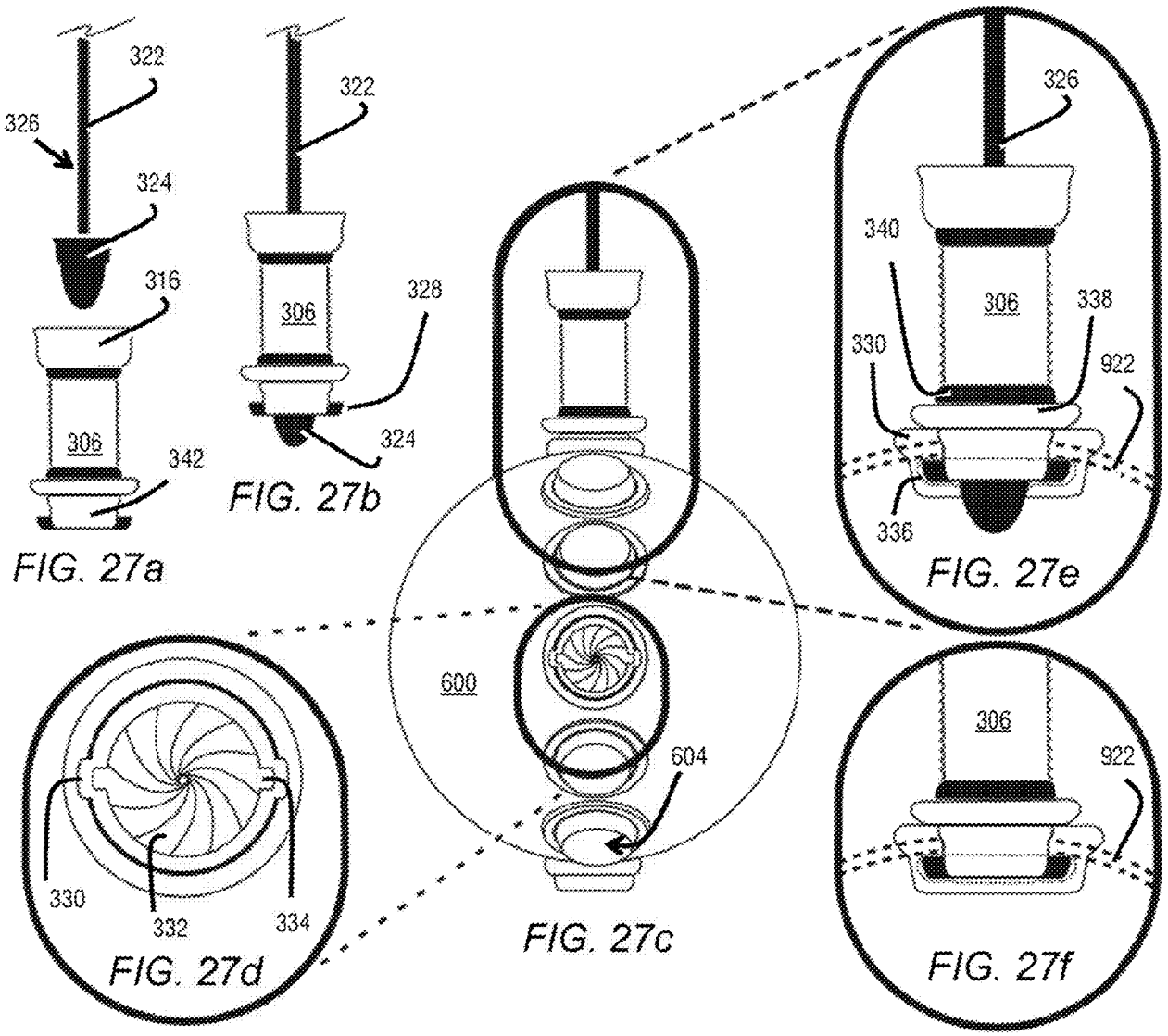
FIG. 27*a* is a truncated frontal view depicting an embodiment of a special RIS 100 unit with pre-fabricated twist-lock connectors already pre-attached (hereinafter referred to as a "RIS-TL 306) and a RIS plunger 326 tool.
FIG. 27*b* is a truncated frontal view depicting an embodiment of the RIS plunger 326 tool which is now relatively fully inserted into the RIS-TL 306 unit.
FIG. 27*c* is a side view of an embodiment of the CB 600 in a relatively inflated state where the CB portals 604 are arranged around the parameter of the CB 600 and relatively aligned.
FIG. 27*d* is an enlarged frontal view of an embodiment of the same CB 600 in FIG. 27*c* that depicts a special CB twist-lock portal rim referred to as a SCB-TLPR 330.
FIG. 27*e* is an enlarged side view of an embodiment of the same CB 600 in FIG. 27*c* that depicts the SCB-TLPR 330 where it has been inserted with the RIS plunger 326 tool through the CB-SD 332 (not depicted).
FIG. 27*f* is a similar enlarged frontal view of the embodiment in FIG. 27*e* that depicts the RIS-TL 306 unit that is twist-locked into SCB-TLPR 330 and whereby the RIS plunger 326 tool has been removed.

FIG. 27*a* is a truncated frontal view depicting an embodiment of a special RIS 100 unit with pre-fabricated twist-lock connectors already pre-attached (hereinafter referred to as a "RIS-TL 306) and a RIS plunger 326 tool. In this embodiment the RIS-TL 306 has a twist-lock male 342 end pre-attached to a rim 338 which limits the amount of insertion, and the rim 338 is connected to the RIS-TL 306. The gasket 340 helps seal the joint. A female 316 end also pre-attached to the RIS-TL 306 and the joint is sealed by the gasket 340. Above the RIS-TL 306 is the RIS plunger 326 tool depicted before the tool has been inserted into the RIS-TL 306.

FIG. 27*b* is a truncated frontal view depicting an embodiment of the RIS plunger 326 tool which is now relatively fully inserted into the RIS-TL 306 unit. In this embodiment, the twist-lock male 342 end of the RIS-TL 306 has a pair of teeth projecting outward, each referred to as a twist lock tooth 328. The RIS plunger 326 tool has a plunger handle 322 and a plunger head 324 end that can be inserted down into the RIS-TL 306 unit.

FIG. 27*c* is a side view of an embodiment of the CB 600 in a relatively inflated state where the CB portals 604 are arranged around the parameter of the CB 600 and relatively aligned. FIG. 27*d* is an enlarged frontal view of an embodiment of the same CB 600 in FIG. 27*c* that depicts a special CB twist-lock portal rim referred to as a SCB-TLPR 330. In this embodiment, the SCB-TLPR 330 has a pair of openings each referred to as a twist lock opening 334 for allowing the insertion of the each twist lock tooth 328 into the RIS-TL 306 unit via the twist lock opening 334.

In this embodiment, there is a special CB portal with a specially designed spiral door referred to as a CB spiral door 332 (hereinafter "CB-SD" 332) which is typically seal closed when no RIS 100 units are present, such as the RIS-TL 306 unit. In this embodiment, the CB-SD 332 has a spiral pattern of overlapping pleated material that is sealed together to prevent, say any of the Fluid Product 160 out and/or any sea water 136 or air 138 in. In some embodiments, this seal can be broken with or without the RIS plunger 326 tool. In some embodiments, the CB-SD 332 could be partially and/or fully torn away, ideally leaving a clean opening.

In some embodiments, the CB-SD 332 could return to its closed state after removing the RIS-TL 306. This ability to return to a closed state could be accomplished with a series of elastic properties embedded into each pleated hem at the rim (along the outlines) in the CB-SD 332 spiral pattern where, say an appropriate amount of downward and/or upward pressure would open the CB-SD 332, and where removing the RIS-TL 306 would cause the elastic properties of the pleated hems to close the door back in, and ideally, completely shut off. In some embodiments, the CB-SD 332 door would have several layers to help seal off any potential leaks. In some embodiments, the CB-SD 332 door could also work in conjunction with and allow the connection of the CB Cap 602 or similar to seal off any leaks.

FIG. 27*e* is an enlarged side view of an embodiment of the same CB 600 in FIG. 27*c* that depicts the SCB-TLPR 330 where it has been inserted with the RIS plunger 326 tool through the CB-SD 332 (not depicted). A double dotted line 922 depicts both an outer and an inner surface of the CB 600. A "twist lock opening and catch" referred to TLOC" 336 is the opening for the pair of twist lock teeth 328 on the RIS-TL 306 unit to whereby twist and lock-in the connection.

The plunger handle 322 can be as long as necessary and practical for inserting the RIS-TL 306 unit into, say the SCB-TLPR 330 from above. In some instances, that may be from a user who is relatively close up, say on the drillship 130 or from an undersea diver. While in other instances, that be from a relatively longer distances, say from the robotic submarine 700 or even from a special extremely long plunger handle, referred to as a XPH 346 (not shown). The XPH 346 could be jointed and/or flexible like a plumber's snaking tool to allow it to bend around corners, obstacles and the like.

FIG. 27*f* is a similar enlarged frontal view of the embodiment in FIG. 27*e* that depicts the RIS-TL 306 unit that is twist-locked into SCB-TLPR 330 and whereby the RIS plunger 326 tool has been removed. In another embodiment, the RIS-TL 306 unit could simply replace the CB Cap 602 without there being the CB-SD 332 door style design, where there could instead be a pressure/tension fit.

In some embodiments the RIS-TL 306 unit has the twist-lock male 342 end interconnected into the SCB-TLPR 330 which can then lock the RIS-TL 306 unit into the twist-lock connection. In another embodiment, the CB portal 604 could instead have connectors exposed similar to the twist-lock male 342 end and where another special RIS 100 could have a female end pre-attached that could connect to the CB 600 similarly to the connection with the SCB-TLPR 330 (not shown). This last embodiment may lend itself better for situations where the there is significant pressure and/or flow coming from inside the CB 600 and through the connection. This last embodiment may also make connections after deployment easier. In some embodiment, there could be a special CB Female Cap 348 used (not shown), when the portal/connection is not being utilized.

Figures 28A, 28B, 28C, 28D, 28E:
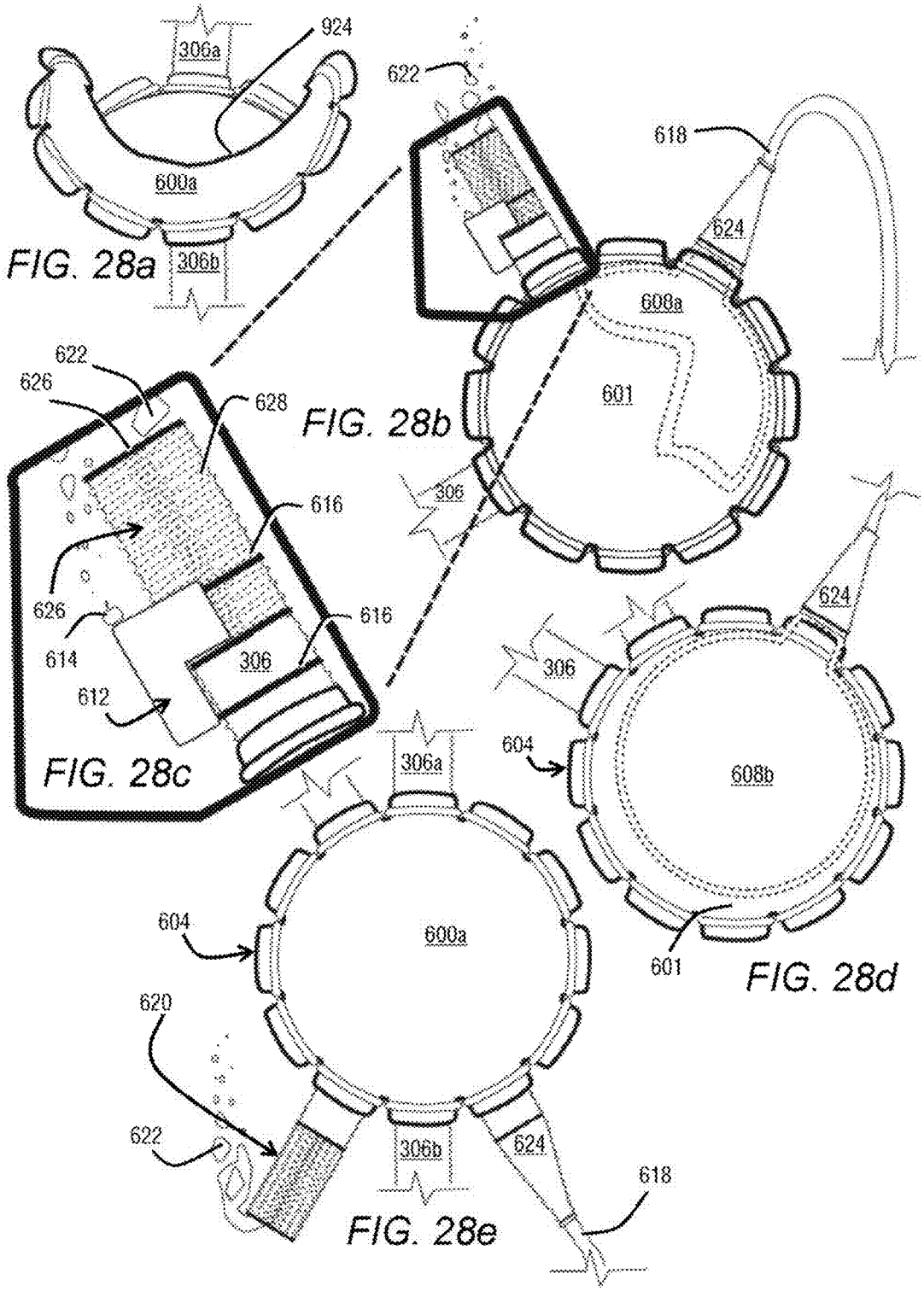
FIG. 28*a* is a truncated frontal view of an embodiment of a particular Collection Balloon 600, referred to as a CB 600*a* depicted here in a relatively deflated state.
FIG. 28*b* is a truncated frontal view of an embodiment of a special Collection Balloon 600 with a diaphragm-like mechanism inside referred to as a Lunged CB 601 depicted here in a relatively deflated state.
FIG. 28*c* is an enlarged truncated frontal view from FIG. 28*b* of a Self Cleaning Filter Assembly 626, a Motor Assembly 612, a Motor Vent 614, and a Motor Assembly Connector Belt 616 connected to the Lunged CB 601. The Motor Assembly 612 protects the motor and allows for underwater operation and the Motor Vent 616 allows the Motor Assembly 612 to be vented.
FIG. 28*d* is a truncated frontal view of a similar embodiment of the Lunged CB 601 depicted in FIG. 28*b*, but herein a relatively inflated state.
FIG. 28*e* is a truncated frontal view of a similar embodiment of the CB 600*a* depicted in FIG. 28*a*, but here in a relatively inflated state.

FIG. 28*a* is a truncated frontal view of an embodiment of a particular Collection Balloon 600, referred to as a CB 600*a* depicted here in a relatively deflated state. This depiction could represent an instance of what may similarly appear, say just after the earlier deployment of the CB 600*a*, after the Fluid Product 160 begins to start flowing inside from the bottom, as in starting into a particular RIS-TL 306*b* unit upward, to another particular RIS-TL 306*a* unit and thus also subsequently causing the CB 600*a* to fill up and become relatively expanded and more buoyant. A line 924 depicts a fold in the CB 600*a* and is not necessarily the outline of the CB 600*a* unit.

FIG. 28*b* is a truncated frontal view of an embodiment of a special Collection Balloon 600 with a diaphragm-like mechanism inside referred to as a Lunged CB 601 depicted here in a relatively deflated state. In this embodiment, the Lunged CB 601 has an Inner Lung 608*a*, but it could have a plurality of Inner Lungs 608 in different sizes, shapes, materials, functions, purposes, and made of a variety of materials. This depiction could represent an instance of what may similarly appear, say as the Inner Lung 608 has exhaled or is in a relatively deflated state 608*b* (the double dotted line) relative to the size of the Inner Lung 608 at capacity.

The material that causes the CB Lung 608 to inhale and/or exhale can come from a variety of means and methods. In this embodiment, a Bronchi Hose 618 is the conduit for the material which is truncated on one end in this depictions, but could be connected to tanks with a respirator mechanism located in the sea water 136, along the seabed 134, attached to the robotic submarines 700, and/or located above the sea surface 136 on a floating device and/or say the drillship 130 (more ahead).

The other end of the Bronchi Hose 618 is connected to a special transducer referred to as a Relatively Rigid Transducer 624 which in turn is connected to the Lunged CB 601. The Relatively Rigid Transducer 624 can come in a variety of shapes, sizes, diameters, and the like, but is relatively more rigid that the transducer 116 mentioned early, to limit the amount of expansion and contraction the Relatively Rigid Transducer 624 has during a respiration cycle. The respiration cycle can be predefined and conditional. In one embodiment, the respiration cycle is a combination of a relatively complete inhale/inflated-state and a relatively exhale/deflated-state for a particular Inner Lung 608. In another embodiment, the respiration cycle is a combination of a relatively complete inhale/inflated-state and a relatively exhale/deflated-state for all the Inner Lungs 608 that are connected to a particular respirator system (more details ahead in FIG. 29).

FIG. 28*c* is an enlarged truncated frontal view from FIG. 28*b* of a Self Cleaning Filter Assembly 626, a Motor Assembly 612, a Motor Vent 614, and a Motor Assembly Connector Belt 616 connected to the Lunged CB 601. The Motor Assembly 612 protects the motor and allows for underwater operation and the Motor Vent 616 allows the Motor Assembly 612 to be vented. The Motor Assembly Connector Belt(s) 616 allows the Motor Assembly 612, which is ideally relatively lightweight, to be connected to sections of, say any RIS 100 type unit, and in this depiction to the RIS-TL 306 and the Self Cleaning Filter Assembly 626. In one embodiment, the Motor Assembly is mounted on the surface of the CB 600 or the Lunged CB 601.

The Self Cleaning Filter Assembly 626 is meant to allow out any Non-Fluid-Type Products 622, such as water (e.g. sea water 136) and any gases (eg. air 138) through a Self Cleaning Filter 628 (depicted by a dotted line outline). In this embodiment, the Self Clean Filter could be constructed of baffle materials that would allow the proper materials and fluids to flow through, but relatively restrict the flow of any Fluid Products 160. In an embodiment, the Motor Assembly 612 could rotate a portion of the Self Cleaning Filter Assembly 626 and in a manner that could, say scrape off a sufficient amount of the Fluid Products 160 that may be present, while preventing any Non-Fluid Type Products 622 from escaping out a Filter open end 626 of the Self Cleaning Filter Assembly 626. The scraped off Fluid Product 160 could be collected and stored in another CB 600 designated for such material (not shown).

FIG. 28*d* is a truncated frontal view of a similar embodiment of the Lunged CB 601 depicted in FIG. 28*b*, but herein a relatively inflated state. In this embodiment, the Lunged CB 601 has an Inner Lung 608*b*, but it could have a plurality of the Inner Lungs 608 in different sizes, shapes, materials, functions, purposes, and made of a variety of materials. This depiction could represent an instance of what may similarly appear, say as the Inner Lung 608 has inhaled or is in a relatively inflated state 608*b* (the double dotted line) relative to the size of the Inner Lung 608 at capacity. In other embodiment, there could be one or a plurality of Inner Lungs 608 that are much small, say only large enough to block a single CB portal 604 opening.

FIG. 28*e* is a truncated frontal view of a similar embodiment of the CB 600*a* depicted in FIG. 28*a*, but here in a relatively inflated state. In this embodiment, the CB 600*a* has a Filter Assembly 620 at the bottom and with the Motor Assembly 612 and without the Inner Lung 608. This embodiment and depiction of the CB 600*a* could be an instance of the first CB 600 connected to the HOS 200 from the I-RIS 140 where the Lunged CB 601 could be connected further upward. In addition, the Inner Lung 608 and/or the Lung capacity (e.g. to inhale/exhale) via a Respirator Assembly system (FIG. 29) can be added later, as needed, and/or removed as needed.

Figure 29:
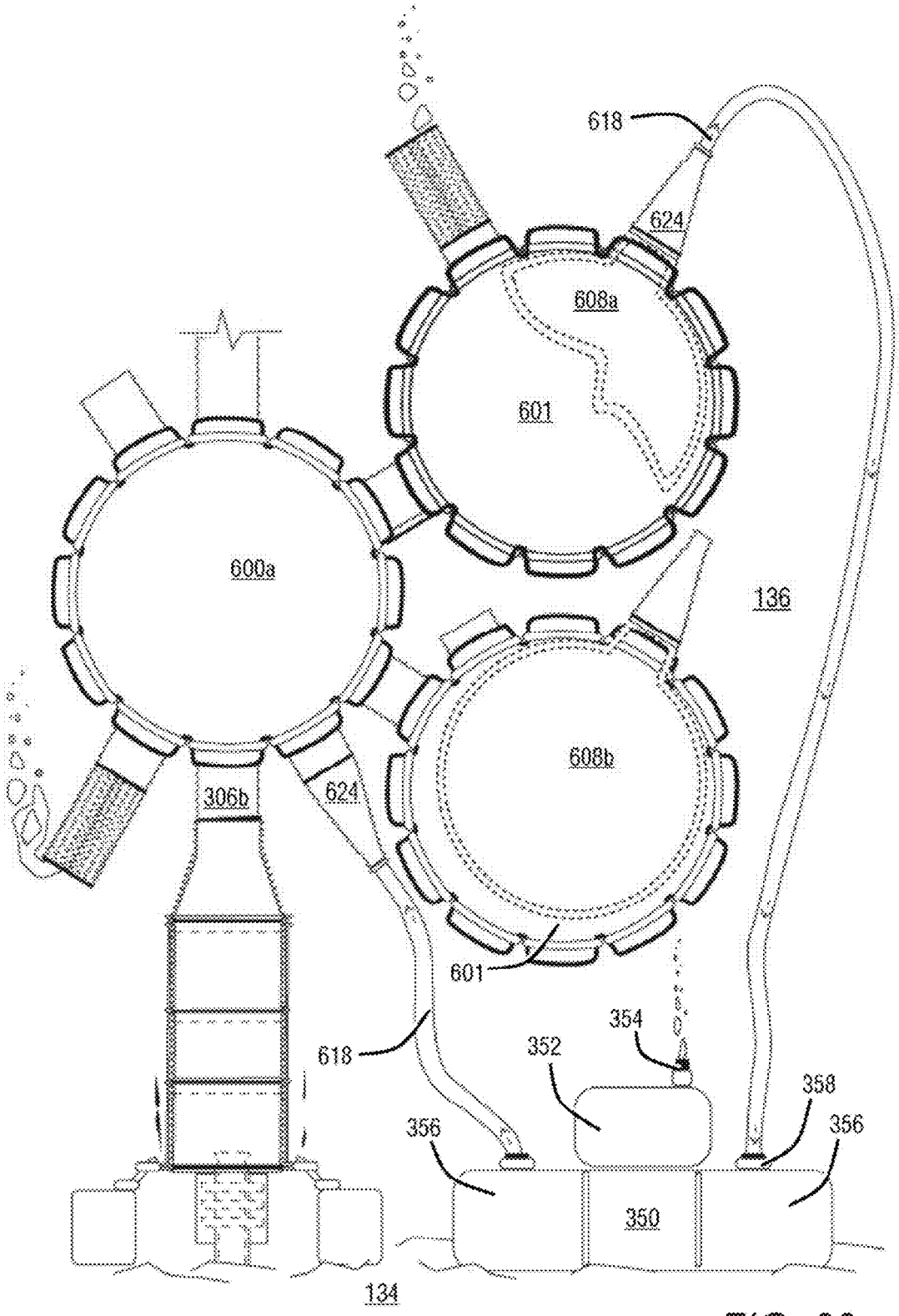
FIG. 29 is a frontal view of an embodiment depicting the STACCO 99 where there are a number of the CB 600 embodiments connected along the HOS 200.

FIG. 29 is a frontal view of an embodiment depicting the STACCO 99 where there are a number of the CB 600 embodiments connected along the HOS 200. The CB 600*a* closest to the sea surface 132 and where a series including the Lunged CB 601 embodiments are connected along the HOS 200. In this embodiment, a Respirator Assembly 350 system includes a Respirator Assembly motor 352, a two way blower and fan assembly, a Respirator Assembly motor vent 354 and a pair of Respirator Trachea 356 chambers that are connected to the Bronchi Hose 618 via a Respirator hose connection 358.

In this embodiment, ideally the Respirator Assembly 350 system can transfer the air through the system, say from the relatively complete inhale/inflated-state and a relatively exhale/deflated-state, and/or whatever the predefined conditions are for the respiration cycle (FIG. 28). In addition, ideally enough capacity to support all the interconnected Inner Lungs 608 and Outer Lungs 610 (FIG. 38).

The two way blower and fan assembly is generally located in the center chamber and has the ability to change directions, where for a conditional period of time the two way blower and fan assembly is blowing in one direction, up until an action or the conditional period has been met, whereby the two way blower and fan assembly changes direction and starts blowing in opposite direction.

The conditional period could be timer based and &/or conditionally-based and collectively based upon preset data metrics incorporating real-time pressure gauges, on volume of, say respiratory substances (e.g. the air 138 &/or water 136) that has passed in a particular direction.

The Respirator Trachea 356 chambers control the volume and what reparatory substances, controlled substances, and the like, are allowed to flow in which direction and when.

In some embodiments, the controlled substances could include the RFID pellet, the sensor pellet, the combination RFID/Sensor pellet where the pellets can each be uniquely tracked as the move throughout the HOS 200 to monitor flows and the like. The Respirator Trachea 356 chamber could be a set location for tracking the placement, movement/flow, volume, and the like; of the RFID pellet, the sensor pellet, the combination RFID/Sensor pellet as they pass through the Lungs.

In another embodiment, a separate Respirator Assembly 350 system can transfer the air through the system (see FIG. 38), say for other sections besides the Lungs, where there is a circulation system of circulation substances (e.g. the air 138 &/or water 136) that has continually passed in one particular direction. In this embodiment, a separate Respirator Trachea 356 chamber could also be a set location for tracking the placement, movement/flow, volume, and the like; of the RFID pellet, the sensor pellet, the combination RFID/Sensor pellet as they pass through the circulation system.

Figure 30B:
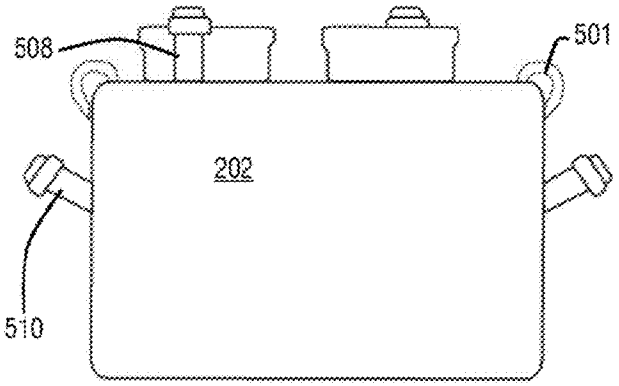
FIG. 30*b* depicts a frontal view of an embodiment of the STH 202.
Figure 30A:
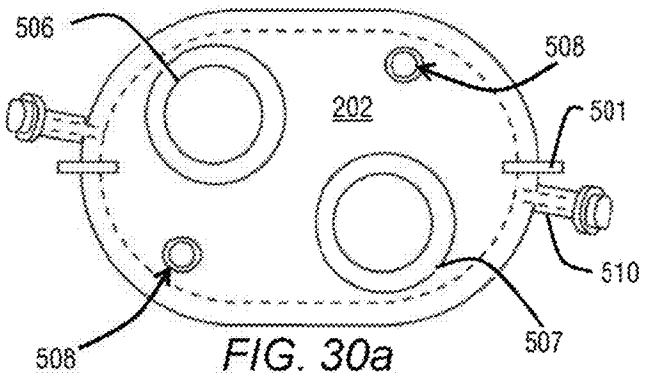
FIG. 30*a* depicts a top view of an embodiment of another STH 202, but instead of one top STH opening 506 for connecting the HOS 200, the STH 202 has two top STH openings for connecting the two HOS 200s or as a backup opening.

FIG. 30*a* depicts a top view of an embodiment of another STH 202, but instead of one top STH opening 506 for connecting the HOS 200, the STH 202 has two top STH openings for connecting the two HOS 200s or as a backup opening. In this embodiment and similar to STH 201, a key to constructing the STH 202 is to not make the two top STH openings 506 too small, so to help eliminate clogs, from say methane hydrate crystals. In this embodiment, the STH 202 would have a relatively significant sized opening for the two top STH openings 506 (typically with an inside diameter relatively larger than opening of the wellhead pipe 120 opening 162 being covered). Each of the two STH openings 506 has a rim with the STH lip 507 that ideally is specially developed and constructed to be best-suited for accepting a range of potential connections means to the HOS 200 (e.g. via the I-RIS 140).

FIG. 30*b* depicts a frontal view of an embodiment of the STH 202. FIG. 30*c* also depicts a frontal view of an embodiment of the STH 202 but depict the hollow interior cavity with a dotted line 911 before the connection of the two I-RIS 140s that is depicted from above and truncated. The preformed handles 501 allow the STH 202 to be connected to and maneuvered. The STH side vents 510 and the STH top vents 508 each with the vent cap 509 can be used for a variety of functions and there can be a plurality of each.

For instance the STH top vents 508 could instead be uncapped during the connection of one or both of the I-RIS 140s to help reduce pressure. In addition, the STH top vents 508 could be fitted with a hose and a filtration system for venting out selected items, say air, gases, and/or water. Further, a vacuum could be fitted to the STH top vents to improve the seal and/or other conditions inside the STH 202.

The STH side vents 510 could be used for the same functions as the STH top vent(s) 508, and/or could be connected to a system that pumps into or out of the STH 202.

For instance the STH top vents 508 could be setup for releasing pressure, while the STH side vents could be setup for increasing pressure via a pump system (more ahead).

Figure 30D:
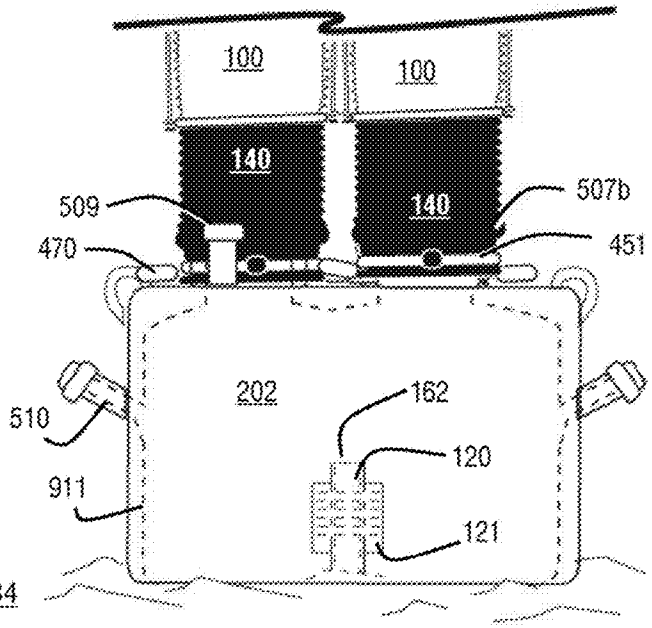
FIG. 30*d* depicts the same frontal view and embodiment of the STH 202 with the hollow interior cavity with the dotted line 911, and also includes a dotted line depiction of the wellhead pipe 120, the wellhead pipe opening 162, the BOP 121, and the two truncated separate HOS 200s each with the RIS 100 unit interconnected with the I-RIS 140 on the end of each HOS 200 and now both connected to the STH 202.
Figure 30C:
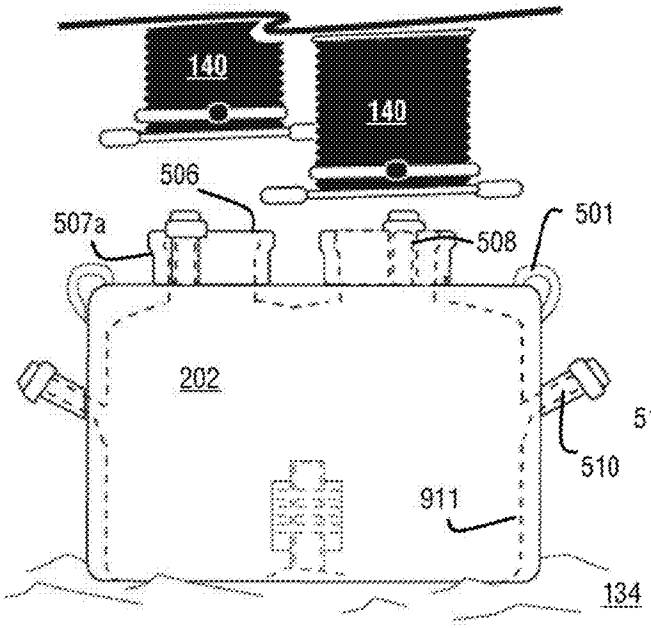
FIG. 30*c* also depicts a frontal view of an embodiment of the STH 202 but depict the hollow interior cavity with a dotted line 911 before the connection of the two I-RIS 140s that is depicted from above and truncated.

FIG. 30*d* depicts the same frontal view and embodiment of the STH 202 with the hollow interior cavity with the dotted line 911, and also includes a dotted line depiction of the wellhead pipe 120, the wellhead pipe opening 162, the BOP 121, and the two truncated separate HOS 200s each with the RIS 100 unit interconnected with the I-RIS 140 on the end of each HOS 200 and now both connected to the STH 202. Each I-RIS 140 has a visible bulge depicted by a 507*b* on left version where the I-RIS 140 is form fitted around the underneath STH lip 507*a* (from FIG. 30*a*). The I-RIS Collars 451 have been tightened and secured with the I-RIS Collar Locks 452 around each I-RIS 140.

Figures 31A, 31B, 31C, 31D:
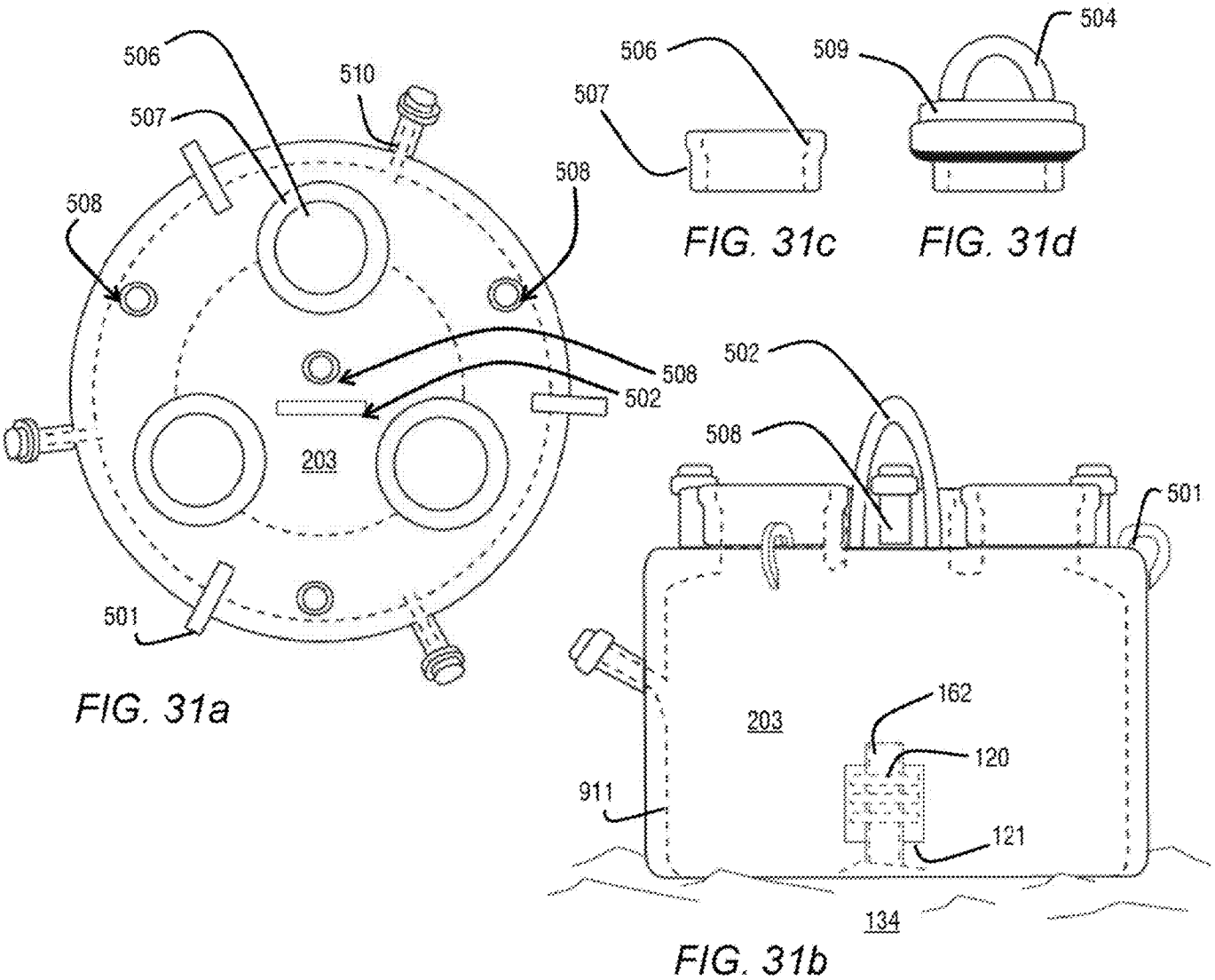
FIG. 31*a* depicts a top view of an embodiment of another STH 203, but instead of one or two top STH openings 506 for connecting the HOS 200, the STH 203 has three top STH openings for connecting three HOS 200s or as backup openings.
FIG. 31*b* depicts a frontal view of the same embodiment of the STH 203 but depict the hollow interior cavity with a dotted line 911 before the connection of any I-RIS 140s (not shown). The preformed handles 501 allow the STH 203 to be connected to and maneuvered.
FIG. 31*c* depicts an enlarged breakaway view and embodiment of the STP opening 406 with the rim and the STH lip 507.
FIG. 31*d* depicts another enlarged breakaway view of the same embodiment, but with the vent cap 509 inserted.

FIG. 31*a* depicts a top view of an embodiment of another STH 203, but instead of one or two top STH openings 506 for connecting the HOS 200, the STH 203 has three top STH openings for connecting three HOS 200s or as backup openings. In this embodiment and similar to STH 201 and STH 202, each of the three STH openings 506 has a rim with the STH lip 507 that ideally is specially developed and constructed to be best-suited for accepting a range of potential connection means to the HOS 200 (e.g. via the I-RIS 140).

FIG. 31*b* depicts a frontal view of the same embodiment of the STH 203 but depict the hollow interior cavity with a dotted line 911 before the connection of any I-RIS 140s (not shown). The preformed handles 501 allow the STH 203 to be connected to and maneuvered. The STH 203 also has another special handle referred to as a center handle 502. FIG. 31*c* depicts an enlarged breakaway view and embodiment of the STP opening 406 with the rim and the STH lip 507.

FIG. 31*d* depicts another enlarged breakaway view of the same embodiment, but with the vent cap 509 inserted. In an embodiment the vent cap 509 can have a cap handle 504 to allow the cap to be relatively easier to rotate and maneuver under water. The vent caps 509 can be used for a variety of functions and there can be a plurality for all the openings. For instances, two of the STH openings could be connected to separate HOS 200s, while the third could be capped as a backup. The STH side vents 510 could be used for the same functions as the STH top vent(s) 508, and/or could be connected to a system that pumps into or out of the STH 203. For instance the STH top vents 508 could be setup for releasing pressure, while the STH side vents could be setup for increasing pressure via a pump system (more ahead). In addition, there is a dotted line depiction of the wellhead pipe 120, the wellhead pipe opening 162, the BOP 121. In this embodiment, the STH 203, could either be centered over the wellhead pipe 120, one of the three top STH openings 506, and/or some other placement.

Figure 32B:
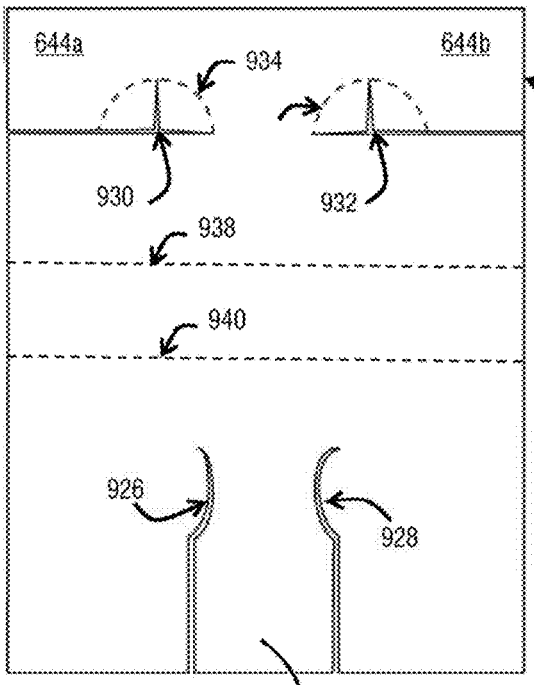
FIG. 32*b* is a top plan view of an embodiment of a Leaking Pipe Wrap 640 for wrapping around the Leaking Pipe 636.
Figure 32C:
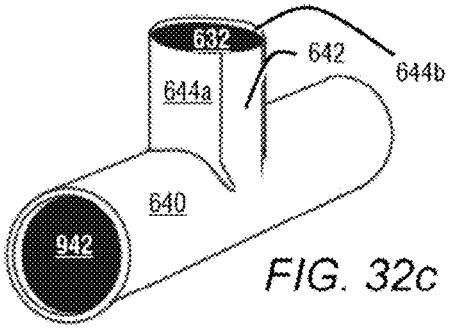
FIG. 32*c* is a perspective view of an embodiment of the Leaking Pipe Wrap 640, after taking the flat material in FIG. 32*b* and forming the material to create the instance depicted here in FIG. 32*c*.
Figure 32D:
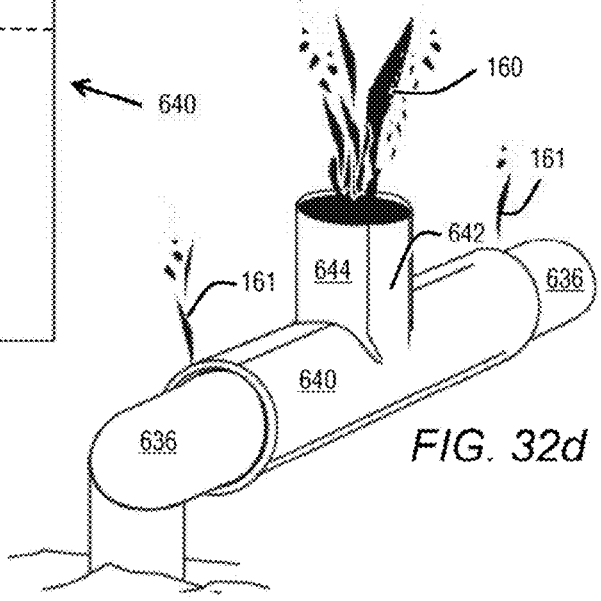
FIG. 32*d* is a perspective view of an instance of the Leaking Pipe Wrap 640, after taking the flat material in FIG. 32*b* and forming the material around the Leaking Pipe 636.
Figure 32A:
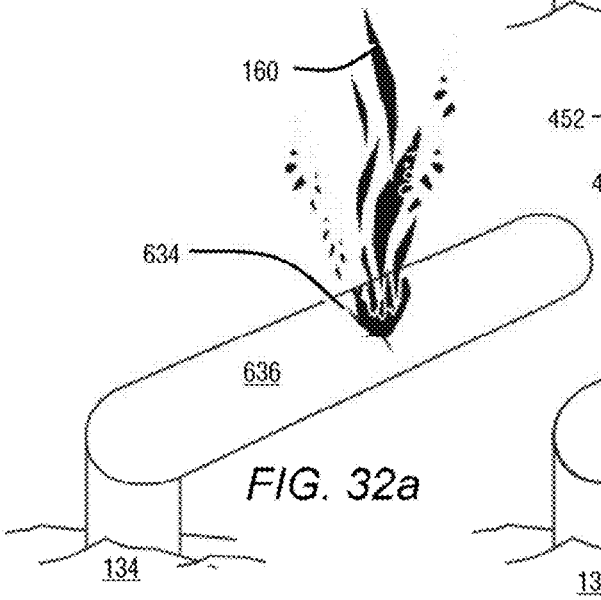
FIG. 32*a* is a perspective view of a Leaking Pipe 636, say near or at the seabed 134 with a Leaking Pipe Crack 634 where the Fluid Product 160 is leaking.

FIG. 32*a* is a perspective view of a Leaking Pipe 636, say near or at the seabed 134 with a Leaking Pipe Crack 634 where the Fluid Product 160 is leaking. In this instance, it would generally be difficult to place the STHs 201, 202, or 203.

FIG. 32*b* is a top plan view of an embodiment of a Leaking Pipe Wrap 640 for wrapping around the Leaking Pipe 636. The Leaking Pipe Wrap 640 can be made of a variety of flexible materials, such as flexible sheet metal, plastic, rubber, and the like. An Outline of the Wrap 658 in its flat state can be any shape and/or aspect ratio, and ideally would be designed and fabricated to perfectly fit the Leaking Pipe 636. A plurality of die cuts 926, 928, 930, and 932 create the bendable shapes for the Leaking Pipe Wrap 640.

A plurality of dotted lines 934 and 936 depicted a portion of the anticipated diameter of the Leaking Pipe 636 and depending on the materials of the Leaking Pipe Wrap 640 can be completely cutout along the dotted line (say if flexible steel) or folded back along the dotted line (say if rubber). If the size of the Leaking Pipe 636 cannot easily be predetermined, a series of pleats 938 and 940 can be added to the Leaking Pipe Wrap 640 where the pleats are fused together but can be pulled about if need to extend the Leaking Pipe Wrap 640 for a larger diameter on a particular Leaking Pipe 636.

FIG. 32*c* is a perspective view of an embodiment of the Leaking Pipe Wrap 640, after taking the flat material in FIG. 32*b* and forming the material to create the instance depicted here in FIG. 32*c*. In this embodiment, a corner flange 644*a* and a corner flange 644*b* wrap together to create a Wrap Top Opening 632 that will ideally be placed over the Leaking Pipe Crack 134 on the Leaking Pipe 636 in such a manner to cause the majority, if not all the Fluid Product 160 come up through the Wrap Top Opening 632.

Depending on conditions, such as the type of material that the Leaking Pipe Wrap 640 is made of, the depth of the Leaking Pipe 636, the pressure of the Fluid Product escaping, the type of Fluid Product 160 leaking, the type and size of leak, and the integrity of the rest of the pipe around the Leaking Pipe Crack 634, it may be prudent to create some of the material bends, shaping, connecting, and/or welds in advance of underwater deployment. The Leaking Pipe Wrap 640 can serve several purposes. In an embodiment, there could be several layers of multiple Leaking Pipe Wraps 640, say where the first layer is of a particular Leaking Pipe Wrap 640 that is made of rubber, and a subsequent Leaking Pipe Wrap 640 that is made of flexible sheet metal. A hollow interior depicted by a 942 could also depict the Rubber Leaking Pipe Wrap 640 with the flexible sheet metal Leaking Pipe Wrap over the top.

FIG. 32*d* is a perspective view of an instance of the Leaking Pipe Wrap 640, after taking the flat material in FIG. 32*b* and forming the material around the Leaking Pipe 636. After the corner flanges 644*a* and 644*b* wrap together, the remainder of the Leaking Pipe Wrap 640 can be wrapped around the Leaking Pipe 636 where a Pipe Fix Neck Back 642 comes around and meets the corner flanges 644*a* and 644*b*. These three flanges can be formed around a separate circle shape (not shown) to add strength and with an opening to allow the Fluid Product through. In addition, these three flanges 644*a*, 644*b* and 642 can be held together with one of the several collar types described and/or welded together. Ideally most, if not all the Fluid Product 160 would flow up through the Wrap Top Opening 632, but some may continue to be the escaping Fluid Product 161 depicted along the ends of the Leaking Pipe Wrap 640.

Figure 32E:
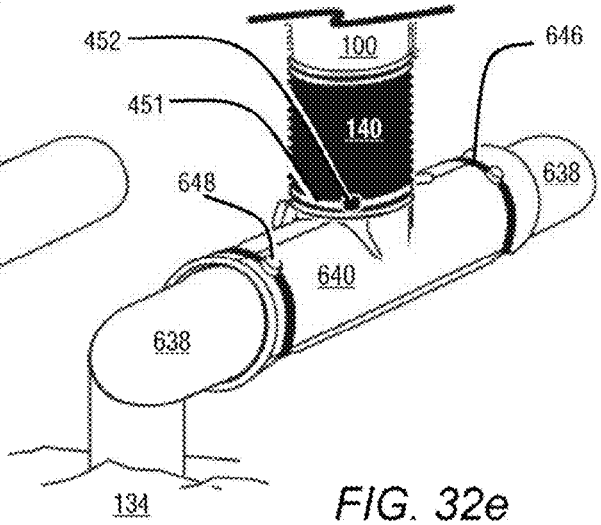
FIG. 32*e* is a truncated perspective view of an embodiment of the Leaking Pipe Wrap 640, after the I-RIS 140 and the rest of the truncated HOS 200 has been attached to the Wrap Top Opening 632.

FIG. 32*e* is a truncated perspective view of an embodiment of the Leaking Pipe Wrap 640, after the I-RIS 140 and the rest of the truncated HOS 200 has been attached to the Wrap Top Opening 632. In this embodiment, the Leaking Pipe Wrap 640 has a pair of collars each referred to as a Pipe Wrap Strap 646 and each with a Pipe Wrap Strap Buckle 648. Ideally, tightening the Pipe Wrap Strap 646 via the Pipe Wrap Strap Buckle 648 will help reduce or eliminate the escaping Fluid Product 161 that was depicted in FIG. 32*d*.

Once the majority of the Fluid Product is being captured, the Leaking Pipe 636 becomes a Repaired Pipe Leak 638. However, some of the benefit of the Leaking Pipe Wrap 640 and related elements is to be able to relatively quickly capture a majority of the Fluid Product 160 that was otherwise escaping into the sea and not perfection of say, collecting all the escaping Fluid Product 161. Further, this embodiment could be adjusted over time with additional materials, such as gaskets, welds, adhesives, braces, collars, straps, patches, leak seals, and the like to become relatively more permanent, but typically this embodiment would be a temporary fix until, say the relief well was successfully completed.

A benefit of the Leaking Pipe Wrap 640 is that the drillship 130 could store a number of the Leaking Pipe Wraps 640 in its flat state from FIG. 32*b* and in a range of typically (historically) used sizes and be relatively better prepared to address the Leaking Pipe 636 faster. In addition, the storage of the Leaking Pipe Wraps 640 could include a range of material types, so that the Leaking Pipe Wraps could be layered if necessary. For example, the first layer of the Leaking Pipe Wrap 640 could go in one direction where the Pipe Fix Neck Back 642 faces in one directions and where the subsequent layer has the Pipe Fix Neck Back 642 facing in other direction to help strengthen the two layers and reduce the likelihood of weak spots and/or leaks.

Figures 33A, 33B, 33C, 33D:
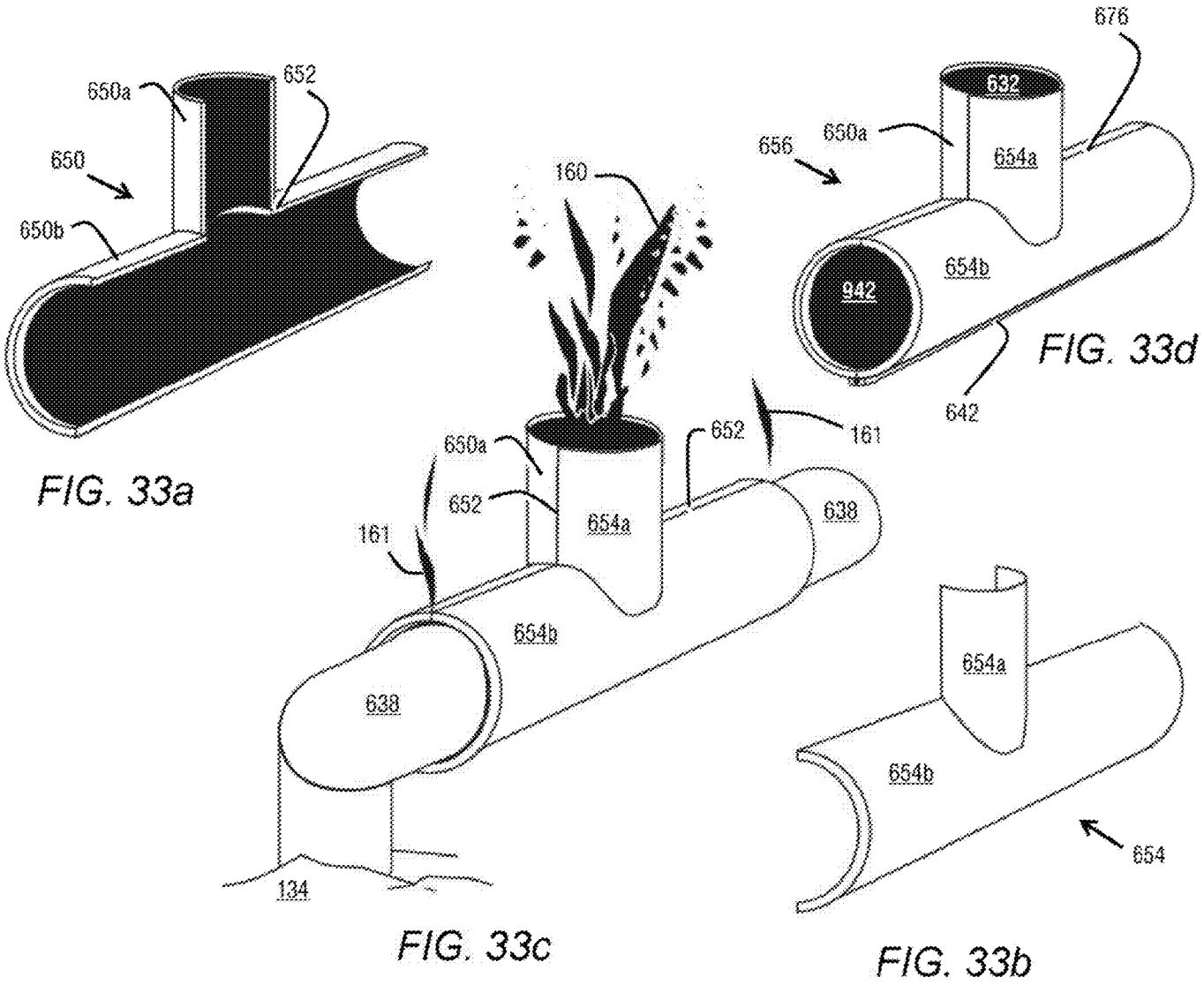

FIG. 33*a* is perspective view of another embodiment of repairing the Leaking Pipe 636, with two halves that come together to create a Complete Pipe Fix Unit 656. Starting with a Pipe Fix T Half A 650 (hereinafter "PFTH-A" 650) which is similar in shape to an upside down "T-Shape" connector that has been sliced in half. The PFTH-A 650 has a Neck Shaft 650*a* and a Pipe Shaft 650*b* that depending on the materials used, can be connected with adhesives and/or a weld 652.

FIG. 33*b* is perspective view of embodiment of the other half of the Complete Pipe Fix Unit 656. In this embodiment, a Pipe Fix T Half B 650 (hereinafter "PFTH-B" 654) which is similar in shape to the other slice of the upside down "T-Shape." The PFTH-B 654 has a Neck Shaft 654*a* and a Pipe Shaft 654*b* that depending on the materials used, can be connected with adhesives and/or the weld 652.

The PFTH-A 650 and the PFTH-B 654 units can be made of a variety of rigid and/or flexible materials, such as flexible sheet metal, plastic, rubber, and the like, but mostly a relatively rigid material such as steel, formed concrete with steel reinforcement, some combination of these materials, and/or the like. Ideally the diameter or a range of diameters are known and/or can be relatively anticipated, so that the PFTH-A 650, PFTH-B 654, and the related parts, materials, and tools can be designed, constructed, assembled, and stored on the drillship 130 before the Leaking Pipe 636 actual occurs.

FIG. 33*c* is a perspective view of an embodiment of the Complete Pipe Fix Unit 656, after connecting the PFTH-A 650 and the PFTH-B 654 units via say adhesives, welds 652, collars, belts, and/or the like. FIG. 33*d* is a perspective view of an embodiment of the Complete Pipe Fix Unit 656, where the PFTH-A 650 and the PFTH-B 654 units are connected by a Pipe Fix Hinge 642 along the bottom and where a Pipe Fix Top Seam can be closed with a range of methods, including an overlap with a gasket, adhesives, welds 652, collars, belts, and/or the like.

In addition, the Complete Pipe Fix Unit 656 could be utilized in conjunction with the Leaking Pipe Wrap 640 where the Leaking Pipe Wrap 640 could be applied first and subsequently the Complete Pipe Fix Unit 656 could go over the top or vice versa. In addition, there could be more than two layers, where multiple layers of each could be applied over the top of the other. Once the majority of the Fluid Product is being captured, the Leaking Pipe 636 (FIG. 32*a*) becomes the Repaired Pipe Leak 638. However, similar to the Leaking Pipe Wrap 640 some of the benefit of the Complete Pipe Fix Unit 656 and related elements is to be able to relatively quickly capture a majority of the Fluid Product 160 that was otherwise escaping into the sea and not perfection of say, collecting all the escaping Fluid Product 161. Further, this embodiment could be adjusted over time with additional materials, such as gaskets, welds, adhesives, braces, collars, straps, patches, leak seals, and the like to become relatively more permanent.

Figures 34A, 34B, 34C, 34D:
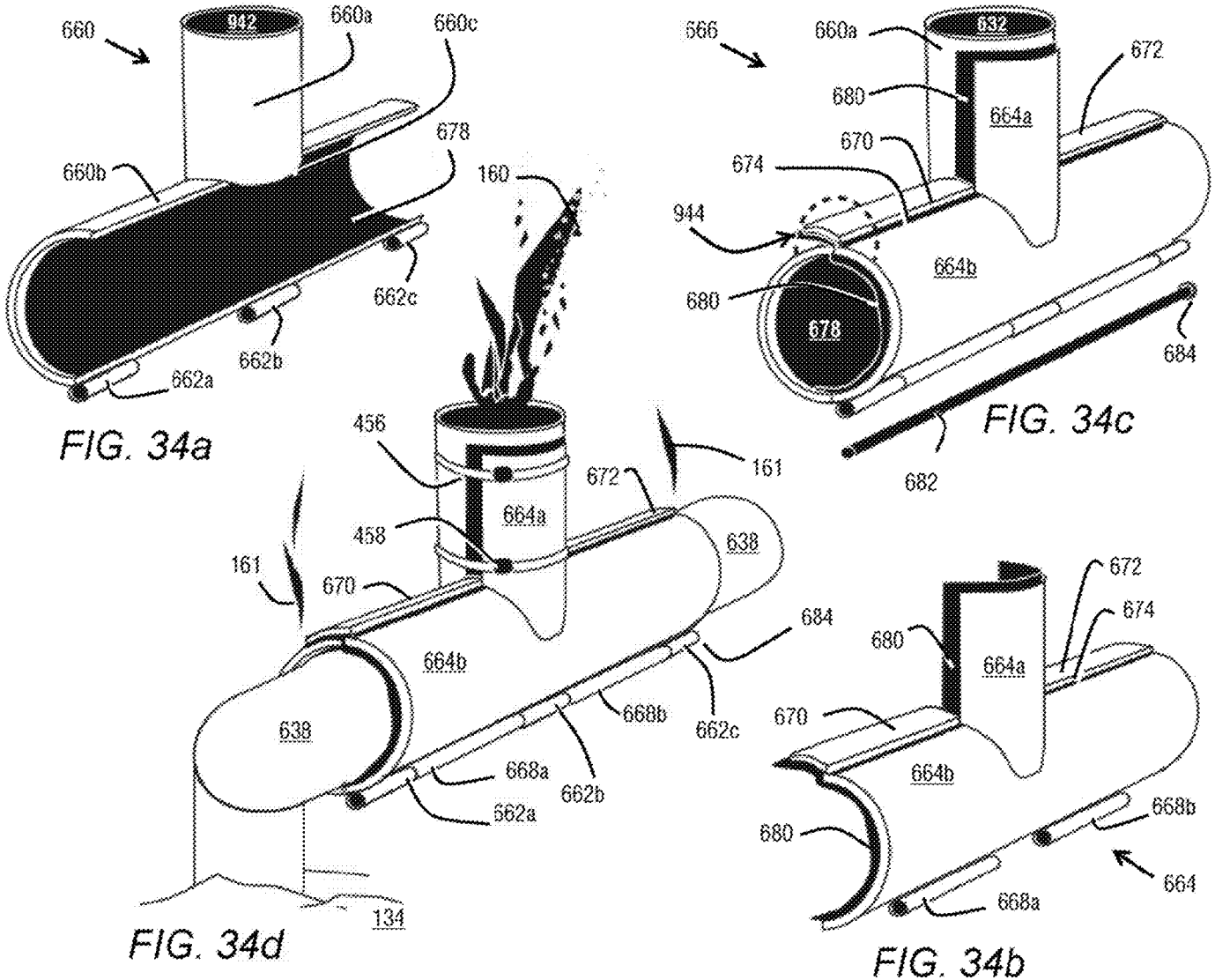
FIG. 34*a* is perspective view of another embodiment of repairing the Leaking Pipe 636, with two halves that also come together, but to instead create a Hinged Pipe Fix Unit 666.
FIG. 34*b* is perspective view of embodiment of the other half of the Hinged Pipe Fix Unit 666.
FIG. 34*c* is a perspective view of an embodiment of the Hinged Pipe Fix Unit 666, after closing along the bottom hinge and connecting the two separate halves of the HFH-A 660 and the HFH-B 664.
FIG. 34*d* is a perspective view of an embodiment of the Hinged Pipe Fix Unit 666 after sandwiching the Leaking Pipe 636 with the separate halves of the HFH-A 660 and the HFH-B 664.

FIG. 34*a* is perspective view of another embodiment of repairing the Leaking Pipe 636, with two halves that also come together, but to instead create a Hinged Pipe Fix Unit 666. Starting with a Hinged Fix Half A 660 (hereinafter "HFH-A" 660) which is similar in shape to an upside down "T-Shape" connector where a "T-cross" 660*b* shape has been sliced in half, but where a "T-neck" 660*a* shape has not been similarly sliced in half. The "T-neck" 660*a* shape has a "T-neck-bottom lip" 660*c* that is high enough to allow an opposing half referred to as a Hinged Fix Half B 664 (hereinafter "HFH-B" 664) to swing shut underneath the "T-neck-bottom lip" 660*c*.

Depending on the materials used to construct the HFH-A 660, the two shapes of the "T-cross" 660*b* shape and the "T-neck" 660*a* shape can be connected with adhesives, the weld 652, and/or created from a poured mold from, say concrete with reinforced steel. The HFH-A 660 also has a series of three hinge pin receptors 662*a*, 662*b*, 662*c* arranged along the bottom to accept a pair of hinge pin receptors from the opposing half or the HFH-B 664. The hinge pin receptors 662*a*, 662*b*, and 662*c* can also be connected with adhesives, the weld 652, and/or created from a poured mold from, say concrete with reinforced steel.

In an embodiment, the HFH-A 660 can also have a HFH-A membrane lining 678 that can be made of a variety of flexible materials, say rubber, and is meant to help seal the joints between the separate halves of the HFH-A 660 and the HFH-B 664 when brought together and closed. The HFH-A membrane lining 680 can be allowed to protrude beyond the edges, trimmed tightly to the HFH-A 644, or recessed inward from the edges as is depicted in FIGS. 34*a* and 34*c*.

FIG. 34*b* is perspective view of embodiment of the other half of the Hinged Pipe Fix Unit 666. In this embodiment, the base shape of the HFH-B 664 is similar in shape to an upside down "T-Shape" connector that has been sliced in half. The HFH-B 664 has a "T-cross" 664*b* shape and a "T-neck" 664*a* that depending on the materials used, can be connected with adhesives, the weld 652, and/or created from a poured mold from, say concrete with reinforced steel.

The HFH-B 664 also has a series of two hinge pin receptors 668*a* and 668*b*, 662*c* arranged along the bottom to accept the three hinge pin receptors from the opposing half or the HFH-A 660. The hinge pin receptors 668*a* and 668*b* can also be connected with adhesives, the weld 652, and/or created from a poured mold from, say concrete with reinforced steel. In an embodiment, the HFH-B 664 can be made of steel with a pair of Hinged Overlap Doors 670 and 672 that are connected with a pair of HFH-B top hinges 674. The pair of the Hinged Overlaps 670 and 672 can each be attached to the HFH-B top hinges 674 via a variety of means, including screws, bolts, adhesives, welds, and the like. The long HFH-B hinge 674 can be attached to the "T-cross" 664*b* shape via a variety of means, including screws, bolts, adhesives, welds, and the like.

In an embodiment, the HFH-B 664 can also have a HFH-B membrane lining 680 that can be made of a variety of flexible materials, say rubber, and is meant to help seal the joints between the separate halves of the HFH-A 660 and the HFH-B 664 when brought together and closed. The HFH-B membrane lining 680 can be trimmed tightly to the HFH-B 644 or allowed to protrude beyond the edges as is depicted in FIG. 34*b*-34*d*.

FIG. 34*c* is a perspective view of an embodiment of the Hinged Pipe Fix Unit 666, after closing along the bottom hinge and connecting the two separate halves of the HFH-A 660 and the HFH-B 664. In this embodiment, a HFH bottom hinge pin 682 would already be inserted down the center of the series of hinge pin receptors 662*a*, 662*b*, 662*c*, 668*a* and 668*b*, but is also depicted below to show the part and a HFM bottom hinge pin head 684. The HFH bottom hinge pin 682 allows the separate halves of the HFH-A 660 and the HFH-B 664 swing apart before sandwiching the Leaking Pipe 636 (FIG. 32*a*), say for those particular Leaking Pipes 636 where the Hinged Pipe Fix Unit 666 can be slide and/or floated underneath. In some cases, it may be necessary to insert the HFH bottom hinge pin 682 after sandwiching the Leaking Pipe 636 with the separate halves of the HFH-A 660 and the HFH-B 664.

FIG. 34*c* also depicts the ability to rotate the Hinged Overlap Doors 670 and 672 connected to the HFH-B top hinges 674 where a dotted arc 944 depicts a potential rotation range for the Hinged Overlap Door 670. The potential rotation range would depend on any obstacles, the materials used in the HFH-B membrane lining 680 and the conditions at the Leaking Pipe 636, say the temperatures, but ideally enough of the potential range to allow for the Hinged Overlap Doors 670 and 672 to be flipped backward or open enough before sandwiching the Leaking Pipe 636 with the separate halves of the HFH-A 660 and the HFH-B 664.

In some embodiments, it may be necessary to cut away the excess membrane for completing a connection in a particular section, say for adhesives and/or the weld 652. In other embodiments, the Hinged Overlap Doors 670 and 672 could be flipped downward and not need any additional materials to close off the majority of the leak, due to say a small leak, the weight of the Hinged Overlap Doors 670 and 672, the placement of the leak on the Leaking Pipe 636, the pressure of the leak, and the like. In other embodiments and/or instances, a range of sealed closure methods could be added, including an overlap with a gasket, adhesives, welds 652, collars, belts, straps, and/or the like (not shown in FIG. 34*c*). For instance, the Pipe Wrap Strap 646 and the Pipe Wrap Strap Buckle 648 could also be used around the Repaired Pipe Leak 638 and including the Hinged Overlap Doors 670 and 672 sections, to improve the seal and reduce leaks. Ideally, tightening the Pipe Wrap Strap 646 via the Pipe Wrap Strap Buckle 648 will help reduce or eliminate the escaping Fluid Product 161 that was depicted at the outside edges in FIG. 34*d*, but due care should be implemented to not further damage the underlying Leaking Pipe 636.

FIG. 34*d* is a perspective view of an embodiment of the Hinged Pipe Fix Unit 666 after sandwiching the Leaking Pipe 636 with the separate halves of the HFH-A 660 and the HFH-B 664. In this embodiment, the Hinged Pipe Fix Unit 666 has a pair of collars each referred to as a Neck Collar 456 and each with a Neck Collar Buckle 458. Ideally, tightening the Neck Collar 456 via the Neck Collar Buckle 458 will improve the integrity of the Hinged Pipe Fix Unit 666 neck, structure, and help reduce or eliminate any leaks around the Hinged Pipe Fix Unit 666 neck. The Neck Collar 456 via the Neck Collar Buckle 458 would typically be eventually, if not subsequently, surrounded by the I-RIS 140 and the rest of the truncated HOS 200 at the Wrap Top Opening 632 (now shown in this Fig.).

In addition, the Hinged Pipe Fix Unit 666 could be utilized in conjunction with the Leaking Pipe Wrap 640 where the Leaking Pipe Wrap 640 could be applied first and subsequently the Hinged Pipe Fix Unit 666 could go over the top or vice versa. In addition, there could be more than two layers, where multiple layers of each could be applied over the top of the other. Once the majority of the Fluid Product is being captured, the Leaking Pipe 636 (FIG. 32*a*) becomes the Repaired Pipe Leak 638. However, similar to the Leaking Pipe Wrap 640 some of the benefit of the Hinged Pipe Fix Unit 666 and related elements is to be able to relatively quickly capture a majority of the Fluid Product 160 that was otherwise escaping into the sea and not perfection of say, collecting all the escaping Fluid Product 161. Further, this embodiment could be adjusted over time with additional materials, such as gaskets, welds, adhesives, braces, collars, straps, patches, leak seals, and the like to become relatively more permanent.

Figure 35:
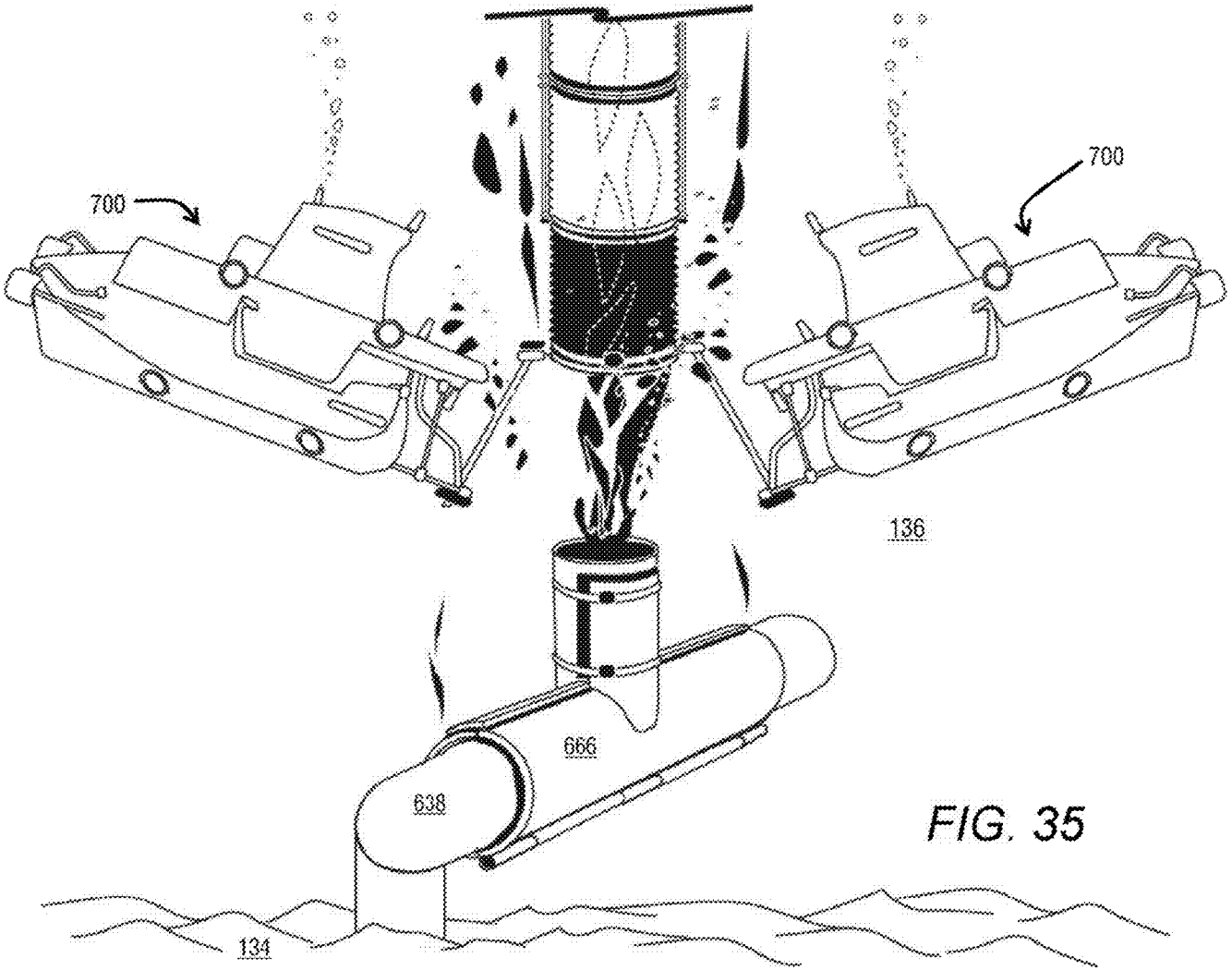
FIG. 35 depicts a perspective view from the front of an embodiment after setting up the Hinged Pipe Fix Unit 666 and the subsequent lowering over the top of the HOS 200 by the pair of robotic submarines 700 (in frontal view, not perspective) at or near the seabed 134 before attaching the HOS 200 to the Hinged Pipe Fix Unit 666.

FIG. 35 depicts a perspective view from the front of an embodiment after setting up the Hinged Pipe Fix Unit 666 and the subsequent lowering over the top of the HOS 200 by the pair of robotic submarines 700 (in frontal view, not perspective) at or near the seabed 134 before attaching the HOS 200 to the Hinged Pipe Fix Unit 666. In this embodiment, the Hinged Pipe Fix Unit 666 would have ideally been tested before lowering the HOS 200 for its integrity to connect the HOS 200 and the integrity of the Repaired Leaking Pipe 638 for its ability to support the potential stress from the HOS 200. In other embodiments, the Hinged Pipe Fix Unit 666, the Complete Pipe Fix Unit 656, and the Leaking Pipe Wrap 640 would all be constructed and/or deployed in a manner to allow for leaks and subsequent connections that are in a variety of angles, positions, and/or to deal with a variety of obstacles and the like (not shown).

Figure 36:
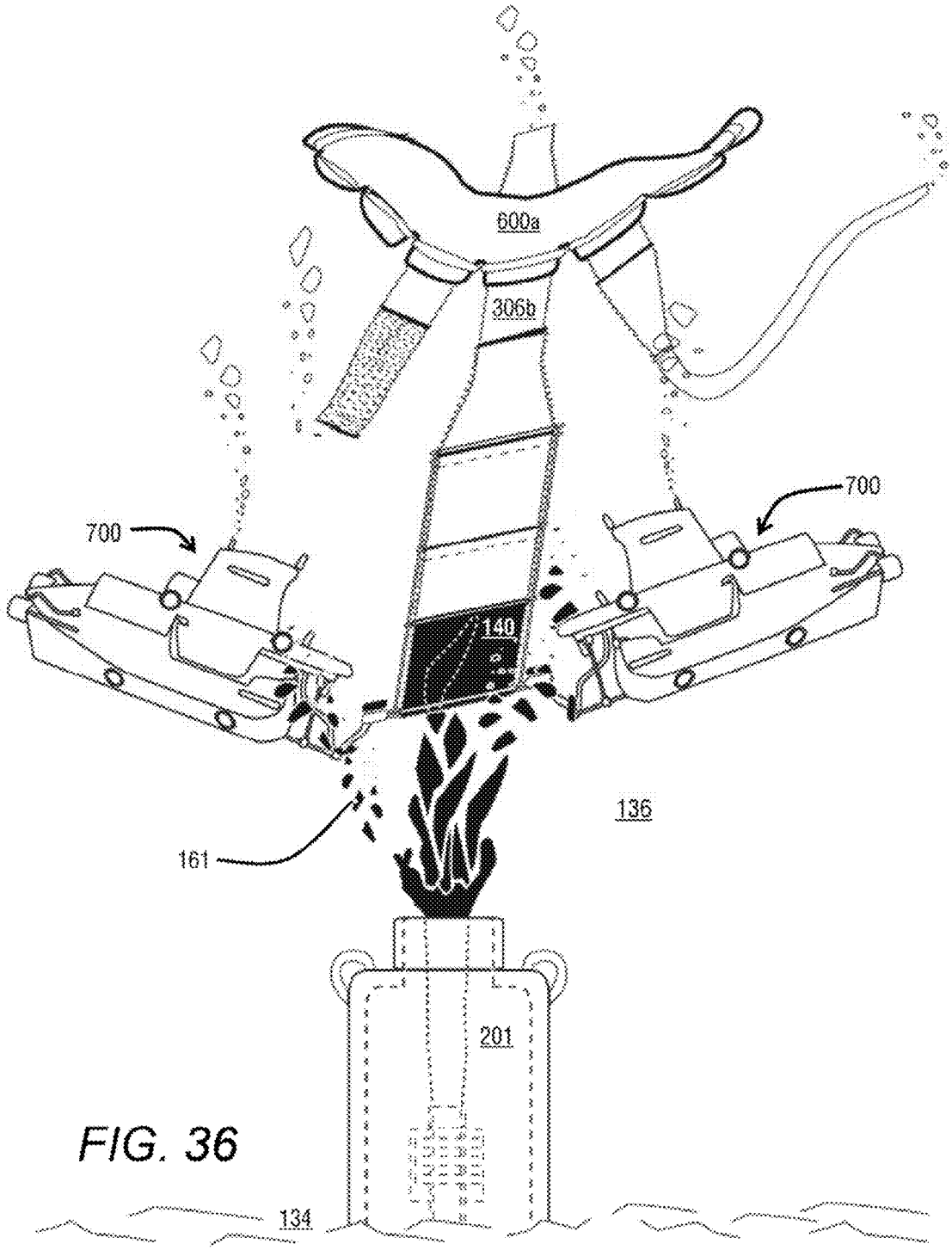
FIG. 36 depicts a frontal view of an embodiment of a subsequent lowering of the HOS 200 over the STH 201 near the seabed 134 by the pair of robotic submarines 700 before attaching to the STH 201.

FIG. 36 depicts a frontal view of an embodiment of a subsequent lowering of the HOS 200 over the STH 201 near the seabed 134 by the pair of robotic submarines 700 before attaching to the STH 201. In this embodiment, the STH 201 would have an open bottom that sits on the seabed 134 and would ideally be constructed heavy enough to sink into the sand and create a chamber that will allow the STACCO 99 to relatively limit the escaping Fluid Products 161 once the HOS 200 is mounted on top. In addition, ideally the STH 201 would be tested before lowering the HOS 200 for the STH's 201 integrity to connect the HOS 200 and for its ability to support the potential stress from the HOS 200. In this embodiment, the robotic submarines 700 are connected to a particular starting portion of the HOS 200 that has been preassembled with a deflated CB 600*a*.

FIG. 37 depicts a frontal truncated view of an embodiment of after attaching the HOS 200 over the STH 203 near the seabed 134. In this embodiment, the STH 203 (with the three opening vs. the one in the STH 201) would have an open bottom that sits on the seabed 134 and would ideally be constructed heavy enough to sink into the sand and create a chamber that will allow the STACCO 99 to relatively limit the escaping Fluid Products 161 now that the HOS 200 is mounted on top via the I-RIS 140. In addition, there could be additional and separate HOS 200 embodiments attached to the other two opening on the STH 203. In this embodiment, the CB 600 is relatively fully inflated and the connections are truncated from above and below, but could reach all the subsequent chain of connections and parts, such as CB 600 embodiments, could eventually make its way to the sea surface 132.

FIG. 38 is a cross section frontal view of an embodiment of the truncated STACCO 99 that is similar to FIG. 1 to depict the pathway of the HOS 200 and the Fluid Product 160. In this embodiment the drillship 130 is utilizing the Fluid Product Collection System 168; say with a vacuum system and the collection hose 122 where it can pump a captured Fluid Product 164 into the drillship 130. In one embodiment, the captured Fluid Product 164 could be any Fluid Product 160 that is located somewhere inside the STACCO 99. In this truncated instance, the captured Fluid Product 164 has entered the CB 600*a* from the bottom (e.g. from remainder of the HOS 200 connected to the STH 203 covering the wellhead pipe 120 opening 162, not shown).

From the CB 600*a* the captured Fluid Product 164 in this embodiment would naturally seek the pathway of least resistance due to the relatively lower density of the captured Fluid Product 164 to the higher density of the sea water 136 and thus travel up through the HOS 200 in the variety of pathways connected to the HOS 200 to the sea surface 132. For instances, once the captured Fluid Product 164 traveled into the CB 600*a* it could then travel up into the CB 600*b* above the CB 600*a* and eventually the captured Fluid Product 164 could fill both the CB 600*a* and the CB 600*b*.

In an embodiment, there could be a daisy chain of CB 600 units all the way to the sea surface, where the CB 600*b* would be connected to another CB 600*c* above the CB 600*b* and so on to the sea surface 132. In another embodiment, the CB 600*b* could have a branch of the HOS 200 that runs to the Collection Reservoir 599 or all the way into the Drillship 130. In another embodiment, once the CB 600*c* becomes relatively full of the captured Fluid Product 164, the CB 600*c* could be disconnected from the HOS 200, capped, and floated to the sea surface 132. The drillship 130 could utilized a wench or crane like system to lift the CB 600*c* from the sea surface 132 directly into the drillship 130 where it can be transported and or drained out and/or the drillship 130 could tether the CB 600*g* and eventually use the collection hose 122, as is depicted with a CB 600*f* which is still connected to the HOS 200.

In an embodiment, the captured Fluid Product 164 consists of variety of petroleum based products such as a methane gas 146 substance and an oil-based 150 substance, where the CB 600 units stacked one above the other could also help to separate the less dense substances. For instance, the methane gas 146 is less dense than the oil-based 150 substance which are both less dense than sea water 136, thus causing the methane gas 146 substance to rise to the relatively highest placed CB 600*c* in the daisy chain. In this depiction, all the CB units 600*a*, 600*b*, and 600*c* could have started off relatively deflated state until each unit became relatively full of the captured Fluid Products 164.

The depiction shows the CB 600*c* converting from the relatively deflated state as the CB 600*c* fills with the methane gas 146 substance. Below the CB 600*b* is the CB 600*b* which is depicted as being partially full of the oil-based 150 substance on the bottom half of the CB 600*b* and the remainder relatively full with the less dense methane gas 146 on the upper half. In some embodiments and depending on the conditions, such as the HOS 200 configuration, sea temperatures, respiratory elements, and the like, the opposite may occur where the CB 600*c* is the first to full inflate with the methane gas 146, followed by the CB 600. This ability to relatively separate the substances into separate CB 600 units is a time saving benefit and has other benefits where some CB 600 embodiments can be made of, say different materials and/or properties that are known to better perform with certain substances and the like.

In an embodiment, a Catheter 124 can be inserted down a particular channel of the HOS 200. The Catheter 124 could travel from the drillship 130 through the RIS-E 141 all the way to the I-RIS 140, but in this depiction the Catheter 124 is truncated and runs from the drillship 130 through the RIS-E 141 through a portion of the HOS 200 where the Catheter 124 enters the CB 600*a* before exiting the HOS 200 at the Transducer 116 out into the sea. In an embodiment, the Catheter 124 has the HOS probe 143 and/or similar connected to the probing end where the HOS probe 143 can be temporary and/or permanently attached.

The Catheter 124 can perform a range of functions. In one embodiment, the a surface pump, say mounted on the drillship 130 could pump an air 138 gas from the surface through the Catheter 124 unit the air 138 exited out in the Transducer 116 and then out into the sea where the air 138 would then simply float back to the sea surface 132. The benefit of pumping the air 138 through the Catheter 124 in this embodiment would be to help keep kinks out of the HOS 200. In another embodiment, other substances could be pumped through the Catheter 124 such as sea water 136, for a similar purpose. In some embodiments, the air 138 or the sea water 136 pumped through the Catheter 124 could be pre-treated, say by warming the temperature to help warm the inside of the HOS 200. In some embodiments the Catheter 124 could have small opening along the Catheter to emit the air 138, water, and/or the like from inside out into the HOS 200.

In an embodiment, an Outer Lung 610 is connected to the end of the Catheter 124 depicted by the double dotted line with two transducer attached. In this embodiment, the air 138, water, and/or the like could be relatively kept from escaping into the sea water 136 where the Outer Lung 610 would allow the air 138, water, and/or the like to be relatively pumped in and out to, say keep the molecules of the air 138, water, and/or the like moving and thus help warm up the temperature. At certain pressures, the air 138, water, and/or the like inside the Outer Lung 610 could be set to conditionally escape through one or both transducers into the sea water 136.

In another embodiment the Outer Lung 610 can be paired with another Outer Lung 610 or Inner Lung 608 where the paired Lungs exchange substances, say air, gases, water, and the like, that are stored inside and where each is interconnected, so that when one Lung is inhaling, the other paired Lund is exhaling (not shown in FIG. 38, but as described earlier).

In an embodiment, the HOS 200 can have branches that are capped with a special cap referred to as a RIS-Cap with Handle where handle on the RIS-Cap with Handle can be connected to the tether 142 and subsequently connect to the weighted material(s) 207. In earlier embodiments, the weighted material(s) 207 typically sat along the seabed 134, but in this embodiment the weighted material(s) 207 could be allowed to float and where the added weight could be utilized to the control the direction and elevation of the HOS 200 along it's pathway to the sea surface 132.

In embodiments where the captured Fluid Products 164 end up in the CR 599, these captured Fluid Products 164 typically exit the HOS 200 above the sea surface 132 through the RIS-E 141 and then flow back into the CR 599 as a HOS Exited Fluid Product 165. An upper rim of the CB 599 is depicted with a Collection Reservoir upper rim 598. In an embodiment, the Collection Reservoir upper rim 598 would have an inflated rim to help keep the unit afloat, say similar to an oversized children's swimming pool that is made of much heavier materials that can withstand the conditions of sea water 136, temperatures, and the range of Fluid Products that may be contained.

FIG. 39*a* is a frontal view of an embodiment of the CR 599. The CR 599 has a Canopy 560 and a Sealed Reservoir bottom 566. FIG. 39*b* is a frontal view of an embodiment of one of four sections of the Canopy 560. The Canopy 560 four sections are connected to a Canopy Hinge Mechanism 562 that allows the Canopy 560 four sections to rotate independently along the Canopy Hinge Mechanism 562. FIG. 39*c* is a truncated cross section view from the back (or opposite side of FIG. 39*d* view) of an embodiment with a dotted line 946 depicts a potential rotation arc for the Canopy 560. In this embodiment, the Canopy 560 overlap and the Canopy Hinge Mechanism 562 help prevent the HOS Exited Fluid Product 165 (HOS not shown until FIG. 39*e*) from going over a Reservoir Tube Rim 574 section by ideally capturing and shielding the HOS Exited Fluid Product 165 under the rim of the Canopy 560. In addition, the Canopy 560 overlap and the Canopy Hinge Mechanism 562 also help prevent some of the sea water 136 from going over the Reservoir Tube Rim 574 section by relatively capturing and shielding the sea water under the rim of the Canopy 560 from the other side.

FIG. 39*d* is a cross section view from the front of an embodiment of the CR 599 where the cross section has been cut through the center of a Reservoir Opening 572 for the HOS 200. The CR 599 has a plurality of Reservoir Tubes 570 which can interconnected, say with an adhesive means, for example along a Tube Seam 564. In this embodiment, the Reservoir Tubes 570 are generally an inflated section 586 of the CR 599, typically a material that can be inflated with air to allow the CR 599 to relatively float along the sea surface 132.

This embodiment, a Reservoir Sealed Bottom 566 creates an area to capture and collect the HOS Exited Fluid Product 165 that is depicted above the Reservoir Sealed Bottom 566 in the cross section. The Reservoir Sealed Bottom 566 would ideally be constructed of materials heavy enough to support the HOS Exited Fluid Product 165 and ideally without causing addition contamination to the sea water 136 or the HOS Exited Fluid Product 165. The Reservoir Sealed Bottom 566 would generally connect to the lowest rung of the Reservoir Tubes 570, but the Reservoir Sealed Bottom 566 could also have a plurality of layers and connect to higher rungs of the Reservoir Tubes 570.

FIG. 39*e* is a frontal view of an embodiment of a RIS-E Lip 580 that forms the top of the RIS-E 141 and the top of a RIS-E Lip 580 creates a RIS-E rim depicted by a line 950. FIG. 39*f* is a frontal view of an embodiment of a RIS-E Stem 582 which is overlapped by a RIS-E Collar 584. Similar to the Relatively Rigid Section 107, the RIS-E Stem 582 may or may not have an inner coil 102*b*. In instances where the RIS-E Stem 582 does have the inner coil 102*b* inside, the inner coil 102*b* would ideally still allow any Inserted Materials 170 from an adjacent unit below, say another RIS 100 unit, to travel down and inside the tubing of the inner coil 102*b* and thus continue the flow of any fluids and/or materials inside the structural coil 102 throughout the HOS 200. The RIS-E Collar 584 can be a rubber-like material that simply pulls over the top without any adhesives via a relatively tight fit or may be relatively permanently connected with say adhesives and/or the like.

FIG. 39*g* is a truncated cross section view from the front of an embodiment of the CR 599 where the cross section has been cut through the center of the Reservoir Opening 572 with the RIS-E 141 connected to the end of the HOS 200. In this embodiment, a dotted line 948 depicts an inside diameter opening of the RIS-E 141 which allows the captured Fluid Product 164 to overflow into the CR 599. Once the captured Fluid Products 164 overflow the RIS-E rim depicted by the line 950, the captured Fluid Product 164 becomes the HOS Exited Fluid Product 165.

In this embodiment the RIS-E Lip 580 has been form fitted from a rubber-like product that can simply drape over the Reservoir Tubes 570 without any adhesives or may be relatively permanently connected with say adhesives and/or the like. In this embodiment, the RIS-E Stem 582 can be form fitted to connect to the RIS-E Lip 580 without any adhesives or may be relatively permanently connected with say adhesives and/or the like. Depending on the conditions, such as materials used to construct the IS-E Lip 580, the RIS-E Stem 582, RIS-E Collar 584, and the overall CR 599; and in addition, the size of the oil spill, the distance from shore, the type of Fluid Products 160 involved, the size of the CR 599, there may be some instances where it may be advantageous to not use adhesives to connect either the IS-E Lip 580, the RIS-E Stem 582 and/or the RIS-E Collar 584 to each other and/or the CR 599 to thus allow for relatively flexibility and plasticity from, say the rolling of the sea surface 132.

FIG. 39*h* is a bottom view of an embodiment of the CR 599 that depicts the Reservoir Sealed Bottom 566. A dotted line 568 depicts the Reservoir Sealed Bottom 566 perimeter and a dotted line 556 depicts a Canopy Outer Perimeter 556. The white circle depicts the Reservoir Opening 572 for the HOS 200 and the attached RIS-E 141.

FIG. 39*i* is a top view of an embodiment of the CR 599 that depicts the Canopy with a dotted line and the Reservoir Tube Rim 574 perimeter with a full line. The dotted line 556 depicts the Canopy outer perimeter and a dotted line 558 depicts the Canopy Inner Perimeter. The Canopy 560 is made of four separate sections that are depicted with a series of dotted diagonal lines 554. A full line 578 depicts an inner perimeter of the Reservoir Tube Rim 574 and a full line 576 depicts an outer perimeter of the Reservoir Tube Rim 574. The full outlined white circle depicts the Reservoir Opening 572 for the HOS 200 and the attached RIS-E 141 and is partially covered by the Canopy 560 in this embodiment.

In an embodiment, ideally the CR 599 would keep the majority, is not all of the HOS Exited Fluid Product 165 contained inside the CR 599 until pumped up and/or collected. In an embodiment the CR 599 could be double walled and double bottomed similar to a double hulled ship, as a failsafe from a puncture to one of the two layers/walls. The bottom of the CR 599 would have a gasket that ideally from fits around the protruding HOS 200. In another embodiment, the CR 599 would also have a cover to protect both the HOS Exited Fluid Product 165 and the sea surface 132. The HOS Exited Fluid Product 165 that is contained in the CR 599 would typically be collected by the drillship 130 and/or the like.

There can be a variety of CR 599 sizes and a variety of construction methods. In an embodiment, the CR 599 is substantially larger than the depictions in FIG. 39*a*-39*i* and could ideally contain the entire volume of Fluid Products 160 escaping from the wellhead pipe 120 and/or similar in a set period; say one day, less the amount vacuumed by the drillship 130. In addition, there could be a plurality of the CR 599 used at one time. So for relatively large spills, there could be a variety and vast number of CR 599 units and sizes deployed and utilized simultaneously, rotated, and/or the like.

FIG. 40 is a frontal view of an embodiment of the STACCO 99 truncated that is similar to the depiction described in FIG. 1 and where there are a number of the CB 600 connected along the HOS 200. The CR 599 and the CB 600*f* at the sea surface 132 are utilizing the collection hose 122 with, say a vacuuming system, and/or the like. The CB 600*g* has been disconnected from the HOS 200 and now floating on the sea surface. The drillship 130 could utilized a wench or crane like system to lift the CB 600*g* from the sea surface 132 directly into the drillship 130 where it can be transported and or drained out and/or the drillship 130 could tether the CB 600*g* and eventually use the collection hose 122, as some CB 600 embodiments can be cleaned out and/or relatively emptied out and redeployed into the HOS 200, say by the robotic submarines 700.

Back in FIG. 4*b* which depicted the anchoring system 144 attached to the HOS 200 at the I-RIS 140 utilizing the tethers 142. This anchoring system 144 can also be attached further up the height of the HOS 200 to avoid any interference at the wellhead pipe 120 opening 162 and/or if the RIS Collar 180 is required near the bottom. A weight 207 is tethered 142 to the HOS 200 at or near a branching 148 unit.

In another embodiment the STACCO 99 and all its components can be used above the sea for channel Fluid Products, say along an above ground oil spill or a pipeline leak referred to as an Above Ground Pipe Leak 630 (hereinafter AGPL 630). For instances there could be an embodiment of the Hinged Pipe Fix Unit 666 that could be utilized in conjunction with the Leaking Pipe Wrap 640 where the Leaking Pipe Wrap 640 could be applied first to a particular AGPL 630, and where subsequently the Hinged Pipe Fix Unit 666 could go over the top or vice versa.

Once the majority of the Fluid Product 160 is being captured, the AGPL 630 (not shown, but say similar to FIG. 32*a*, if above ground) becomes an Above Ground Repaired Pipe Leak 631. Similar to the earlier benefits from the Leaking Pipe Wrap 640, the Hinged Pipe Fix Unit 666, and the related elements, this system and method ideally is able be to relatively quickly capture a majority of the Fluid Product 160 that was otherwise escaping onto the ground and not perfection of say, collecting all the escaping Fluid Product 161. However, in this embodiment above ground, adjustments could be easier to make over time with additional materials, such as gaskets, welds, adhesives, braces, collars, straps, patches, leak seals, and the like to become relatively more permanent.

Note that FIGS. 41 and 42 appear earlier after FIG. 10 and before FIG. 11.

This STACCO 99 is far less expensive than some of the very complex systems that were being attempted by the Gulf of Mexico Response Team in May and June of 2010. Consequently, unlikely a very expensive riser system where maybe only one is deployed, this overall system could allow for replacement parts, multiple paths, redundancy, and/or a backup STACCO 99 or backup HOS 200 to be in standby, should a problem materialize with the existing deployed HOS 200 that cannot be repaired promptly enough. This originally deployed HOS 200 could have sections closed off to contain the Fluid Products 160 within the originally deployed HOS 200.

Meanwhile, the standby STACCO or standby HOS 200 could be brought into utilization relatively quickly compared to massive delays that the Gulf of Mexico Response Team had between different riser attempts in May and June of 2010.

The methods attempted by the Gulf of Mexico Response Team in May and June of 2010 to capture the Fluid Products 160 and still allowing half the Fluid Products 160 into the sea. This invented system and methods are relatively less expensive, easier to repair, easier to deploy, easier to quickly change out, and consequently more effective. This invention allows the Fluid Product 160 to be channeled to the sea surface where it can be contained into reservoirs and pumped into drillships 130. The invention benefits from the massive pressure of the Fluid Products 160 instead of trying to control it and/or reduce it. This massive pressure allows the Fluid Products 160 to freely flow through up to the sea surface under its own pressure, yet channeled and controlled within the HOS 200, thus minimizing many other complications that the Gulf of Mexico Response Team has encountered such as with leaks at the wellhead pipe 120 opening, methane hydrate crystals forming, and trying to control the massive pressure at the wellhead pipe 120 opening.

The foregoing description of the present invention has been provided for purposes of illustration and description. It is not intended to be exhaustive or to limit the invention to the precise forms disclosed. Many modifications and variations will be apparent to the practitioner skilled in the art. Embodiments were chosen and described in order to best explain the principles of the invention and its practical application, thereby enabling others skilled in the art to understand the invention, the various embodiments and with various modifications that are suited to the particular use contemplated. It is intended that the scope of the invention be defined by the following claims and their equivalents.

What is claimed is:

1. An apparatus for collecting a liquid on top of a body of water after the liquid is brought from a source under a surface of the body of water to the surface of the body of water, comprising:

a bottom that floats atop the surface of the body of water, said bottom having an opening for coupling with a first end of a submersible structure through which the liquid flows into the apparatus;

wherein a second end of the submersible structure is placed adjacent to the source under the surface of the body of water;

a side wall connected to the bottom, said side wall and said bottom defining a reservoir for holding the liquid on top of the surface of the body of water; and a canopy pivotally connected to a rim of the side wall so that the canopy can pivot in a first direction to restrain the liquid within the reservoir from spilling over the rim into the body of water or pivot in a second direction to restrain the body of water from spilling over the rim into the reservoir.

2. The apparatus of claim 1, wherein the reservoir comprises a temporary containment vessel for the liquid.

3. The apparatus of claim 2, wherein the liquid in the temporary containment vessel is operationally connected into a drillship for vacuuming the liquid into the drillship.

4. The apparatus of claim 1, wherein the canopy is comprised of a flexible material.

5. The apparatus of claim 1, wherein the canopy is comprised of a rigid material.

6. The apparatus of claim 5, wherein the canopy connected the rim of the side wall can pivot due to a hinge mechanism.

7. The apparatus of claim 1, wherein the side wall is comprised of an inflatable tube.

8. The apparatus of claim 1, wherein the rim is comprised of an inflatable tube.

9. The apparatus of claim 1, wherein the opening includes an opening side wall.

10. The apparatus of claim 9, wherein the opening side wall can restrain the liquid within the reservoir from spilling into the body of water.

11. The apparatus of claim 10, wherein a riser can be inserted through said opening in the bottom.

12. The apparatus of claim 11, wherein the liquid is comprised of a petroleum-based product.

13. The apparatus of claim 12, wherein the inserted riser is connected to a hose collecting the petroleum-based product.

14. The apparatus of claim 13, wherein the opening side wall can restrain the liquid within the reservoir from spilling into the body of water after and during the inserting of the riser.

15. The apparatus of claim 14, wherein the bottom is comprised of a plurality of sealed layers.

16. The apparatus of claim 1, wherein the side wall is comprised of a plurality of a plurality of inflatable tubes which are suitably and operatively stacked to restrain and contain the liquid.

17. The apparatus of claim 1, wherein the canopy is comprised of a plurality canopy sections.

18. The apparatus of claim 1, wherein the reservoir further comprises a cover.

19. The apparatus of claim 1, wherein the reservoir is configured with a double walled construction.

20. The apparatus of claim 1, wherein the reservoir is configured with a double floored construction.

* * * * *